United States Patent [19]

Miura et al.

[11] Patent Number: 4,534,642

[45] Date of Patent: Aug. 13, 1985

[54] ELECTROPHOTOGRAPHIC COPYING APPARATUS FOR EFFECTING A COPYING OPERATION ON THE BASIS OF A SET COPYING CHARACTERISTIC

[75] Inventors: Kunihiko Miura, Hiratsuka; Shouji Takano, Kawasaki; Masashi Kimura, Yokohama, all of Japan

[73] Assignee: Tokyo Shibaura Denki Kabushiki Kaisha, Kawasaki, Japan

[21] Appl. No.: 451,798

[22] Filed: Dec. 21, 1982

[30] Foreign Application Priority Data

| | | | |
|---|---|---|---|
| Dec. 25, 1981 | [JP] | Japan | 56-215570 |
| Jan. 22, 1982 | [JP] | Japan | 57-8708 |
| Jan. 22, 1982 | [JP] | Japan | 57-8709 |
| Jan. 28, 1982 | [JP] | Japan | 57-12305 |

[51] Int. Cl.[3] ..... G03G 15/04

[52] U.S. Cl. ..... 355/14 E; 355/14 D; 355/3 DD

[58] Field of Search ..... 355/14 E, 14 D, 14 R, 355/3 DD, 3 R

[56] References Cited

U.S. PATENT DOCUMENTS

| | | | |
|---|---|---|---|
| 4,153,364 | 5/1979 | Suzuki et al. | 355/14 E |
| 4,256,401 | 3/1981 | Fujimura et al. | 355/14 E |

FOREIGN PATENT DOCUMENTS

| | | | |
|---|---|---|---|
| 2421998 | 9/1979 | Fed. Rep. of Germany | 355/14 E |
| 2941665 | 4/1980 | Fed. Rep. of Germany | 355/14 E |
| 3026952 | 2/1981 | Fed. Rep. of Germany | 355/14 E |

*Primary Examiner*—R. L. Moses

*Attorney, Agent, or Firm*—Cushman, Darby & Cushman

[57] ABSTRACT

An electrophotographic copying apparatus comprises a photoconductive drum, a charger for electrically charging the drum, an exposure unit for exposing the drum to form a latent image on the drum which correspond to the pattern of a document, a developer unit for developing the latent image, using one-component toner, a transfer unit for transferring a toner image to a paper sheet and a fixer unit for fixing the toner image.

In copying the document pattern, a document density-copy density characteristic, i.e. $\gamma$ characteristic, is set in accordance with the document density. According to the $\gamma$ characteristic the amount of exposure and the bias voltage to be applied on the developer unit are varied.

8 Claims, 49 Drawing Figures

ELECTROPHOTOGRAPHIC COPYING APPARATUS FOR EFFECTING A COPYING OPERATION ON THE BASIS OF A SET COPYING CHARACTERISTIC

BACKGROUND OF THE INVENTION

The present invention relates to an electrophotographic copying apparatus, and more particularly to electrophotographic copying apparatus using one-component developer particles.

Most of the conventional electrophotographic copying apparatuses have employed two-component developer composition composed of toner particles and carriers. There has recently been developed electrophotographic copying apparatuses using one-component developer particles, or one-component high resistance magnetic toner. This one-component type of the electrophotographic copying apparatus has some problems to be solved, however. When the two-component type electrophotographic copying apparatus copies a document with a high density ratio of the picture information, such as characters, numerals and graphics, to background, it provides a clean copy with little fog, like the copy obtained by the two-component type copying apparatus. But, when it copies documents at a low density ratio, e.g. diazo copied document and low density color document containing red, blue and yellow as fundamental colors, a quality of a copy image is insufficient because the copy image suffers from blurs and poor contrast. When copying a document with a wide density distribution and particularly requiring a good graduation, such as black and white or color photographs, the picture obtained has remarkably poor graduation and may not exactly reproduce of the document image information.

SUMMARY OF THE INVENTION

Accordingly, an object of the present invention is to provide an electrophotographic copying apparatus which may exactly reproduce the document image information.

According to the present invention, there is provided an electrophotographic copying apparatus which detects correlative information between a density of a picture pattern on a document and an amount of exposure when a photoconductive drum is exposed with an optical image of the document pattern, sets a given document pattern density-copy density characteristic, i.e. a $\gamma$ characteristic, and effects a copying operation on the basis of this characteristic obtained.

According to another aspect of the invention, there is provided an electrophotographic copying apparatus which sets a density of a document pattern, selects a developer bias voltage to be applied to a developer unit on the basis of the set density, and effects the copying operation on the basis of the document density.

According to yet another aspect of the invention, there is provided an electrophotographic copying apparatus which detects a density of a document pattern, sets an amount of exposure for exposing a photoconductive drum surface according to the density, and copies the document pattern according to $\gamma$ characteristic relating to the density.

BRIEF DECRIPTION OF THE DRAWINGS

DETAILED DESCRIPTION OF THE PREFERRED EMBODIMENTS

Figure 1:
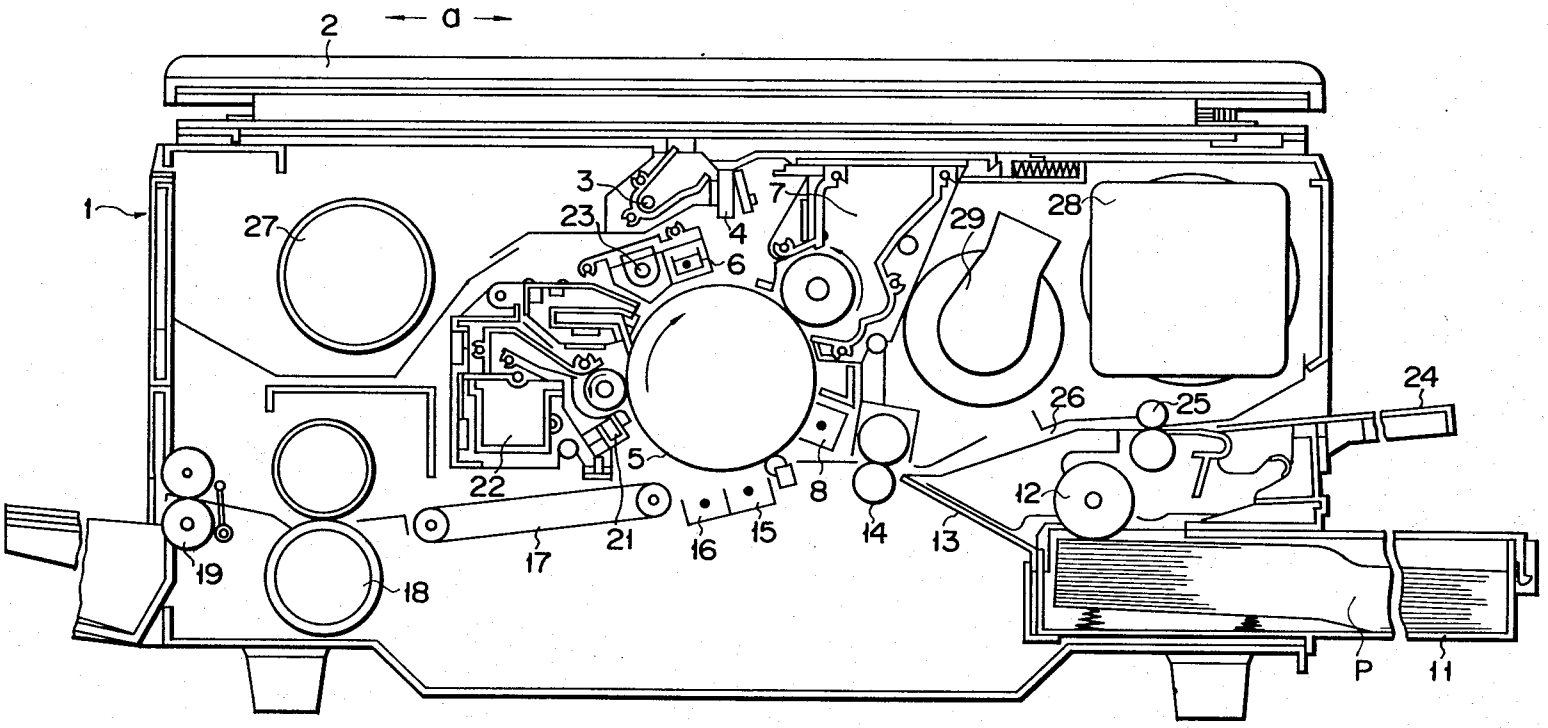
FIG. 1 is a side view of an internal structure of an electrophotographic copying apparatus according to an embodiment of the invention.

Referring to FIG. 1, there is shown an electrophotographic copying apparatus according to the invention. In the figure, a copying console 1 is provided with a document table 2 reciprocally movable in the direction of an arrow a. The document table 2 is covered with a document cover (not shown). An exposure lamp 3 is provided at a given location under the document table 2 for illuminating a document on the document table 2. A photoconductive drum 5 is so arranged as to receive light reflected from the document, through a convergent type transmission member 4. The photoconductive drum 5 rotates in the direction of an arrow, and the surface of the drum 5 is charged by a charger 6. An optical image representing a document pattern is projected on the charged drum surface, thereby forming a latent image on the surface. The latent image formed is developed by a developer unit 7. In the developing process, one-component developer agent of the developer unit 7 is attached to the latent image, to visualize the latent image as a toner image. After developing, the drum surface passes through a discharging unit 8 where the charge on the drum surface is neutralized.

A paper sheet P is transferred from a paper cassette 11 to a guide way 13 by a paper feed roller 12. The paper sheet P is aligned by an aligning roller 14 and transported to the transfer section, through the guide way 13. When the paper sheet P in close contact with the photoconductive drum 5 passes through a transfer charger 15, the toner image is transferred to the paper sheet P. The paper sheet P is separated from the surface of the photoconductive drum 5 by means of a separating charger 16 and is transferred to a heat roller 18 as a fixing unit by means of a transport belt 17. The heat roller 18 fixes or fuses the toner image on the paper sheet P. The paper sheet P is discharged to a copy tray 20 by a copy discharging roller 19. The photoconductive drum 5 after the transfer step is quenched by a discharging unit 21 and then residual toner on the surface of the photoconductive drum 5 is removed by a cleaning unit 22. Following the cleaning step, the photoconductive drum 5 is illuminated by a lamp 23 to quench the latent image formed thereon.

The paper sheet P fed from a manual feed guide member 24 is transferred to the aligning roller 14, through a guide way 26 by a paper transferring roller 25. A cooling fan 27 is provided for cooling atmosphere around a heat roller 18. A motor 28 is for moving the document table 2 and for rotating the photoconductive drum 5. An electromagnetic clutch 29 is for controlling a reciprocal movement of the document table 2.

Figure 2:
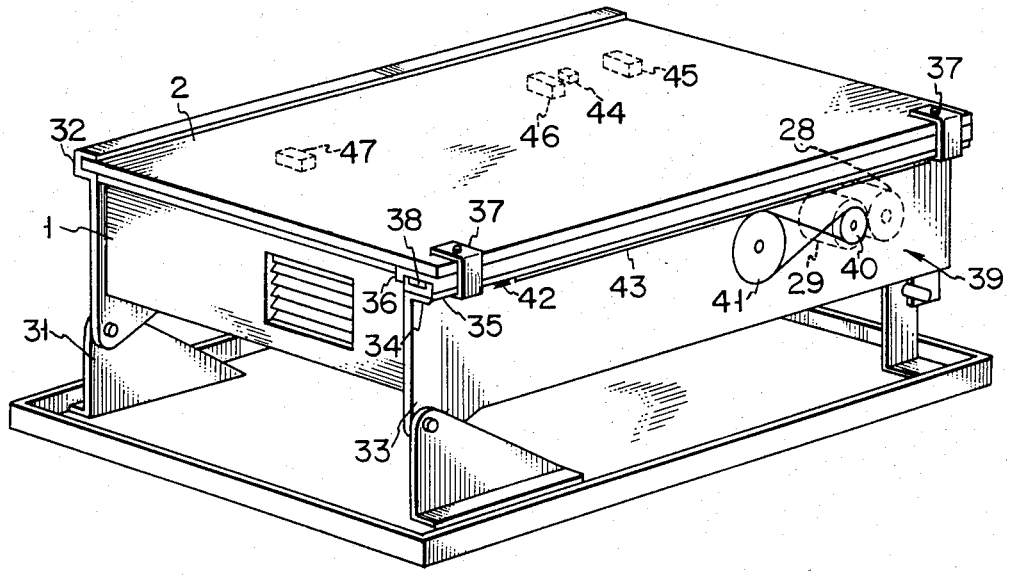
FIG. 2 shows a perspective view of a document table and a drive mechanism of the table.

Turning now to FIG. 2, there is shown the document table 2 and a drive mechanism for it. The document table 2, a tempered transparent glass plate, is slidably fitted at one side to a slide rail 32. The slide rail 32 has a cross section shaped like a squared C letter above a frame 31. The other side edge of the glass plate is supported by a holding rail 35, a guide rail 36 and a holding member 37. The holding rail 35 is a U-shaped member fixed to the L-shaped portion 34, and a sliding member 38 is placed in an elongated groove of the holding rail 35. An inverted U-shaped guide rail 36 is slidably fitted to the holding rail 35. The square C-shaped holding members 37 are fitted around the guide rail 36. The side edge of the document table 2 is fitted in the concave portion of the holding members 37. A document table drive mechanism 39 is mounted on the side of the frame 33. In the electromagnetic clutch 29, the motor 28 is coupled with the electromagnetic clutch 29 by a timing belt and a pulley 40 is fixed to the rotating shaft of the electromagnetic clutch 29. The pulley 40 is provided on the front side of the frame 33. A pulley 41 is provided close to the bottom portion of the document table 2. The pulleys 40 and 41 are coupled to each other by a belt. A drive wire 43 is wound around the pulley 41. One end of the drive wire 43 is fixed to the holding member 37 and the other end to the holding member 37 through a coiled spring 42. In operation, if the motor 28 rotates, the electromagnetic clutch 29 moves the document table 2 reciprocally in the direction of an arrow a.

Figure 3:
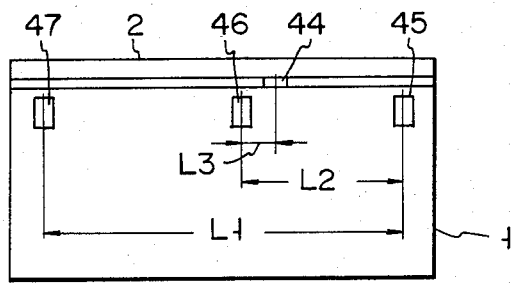
FIG. 3 is a side view of a document table position detecting section.

A position detecting section for detecting position of the moving document table 2 will be described referring to FIGS. 2 and 3. As shown in FIG. 2, a magnet 44 is provided at a given location on the back side of the document table 2 (in FIG. 2, closer to the right side). Three reed switches 45, 46 and 47 are provided at given intervals near the back side of the document table 2 in the upper side of the copying console 1. These components 45, 46 and 47 are combined to form a position detector. In response to the operations of the reed switches 45, 46 and 47, signals are produced and sent to a control system which in turn uses them as control signals for the document table driving mechanism 39 and a paper feed section. An example of relative positions of the magnet 44 and the reed switches 45, 46 and 47 will be described. The magnet 44 and the reed switches 45, 46 and 47 are aligned on a line. A distance Ll between the reed switches 45 and 47 on both sides is slightly longer than a longitudinal length of a document of the size (A3 or B4). A distance between the reed switch 44 on the right side and the reed switch 46 at the mid portion is slightly longer than the longitudinal length of the document of the minimum size (B5 size), for example. When the copying console 1 and the document table 2 positionally coincide with each other, the document table 2 stops. At this stop position, the magnet 44 is positioned slightly closer to the right side by a distance L3 from the reed switch 46.

The reed switch 45 on the right side is used as a start position detecting switch (referred to as "table start switch"), the reed switch 46 at the intermediate for a stop position detecting switch (referred to as "table home switch"), and the reed switch 47 on the left side for a limit switch (referred to as "table limit switch").

Although not shown, a reed switch for starting a paper (referred to as "paper start switch") is provided at a given location between the switches 45 and 46.

Figure 4:
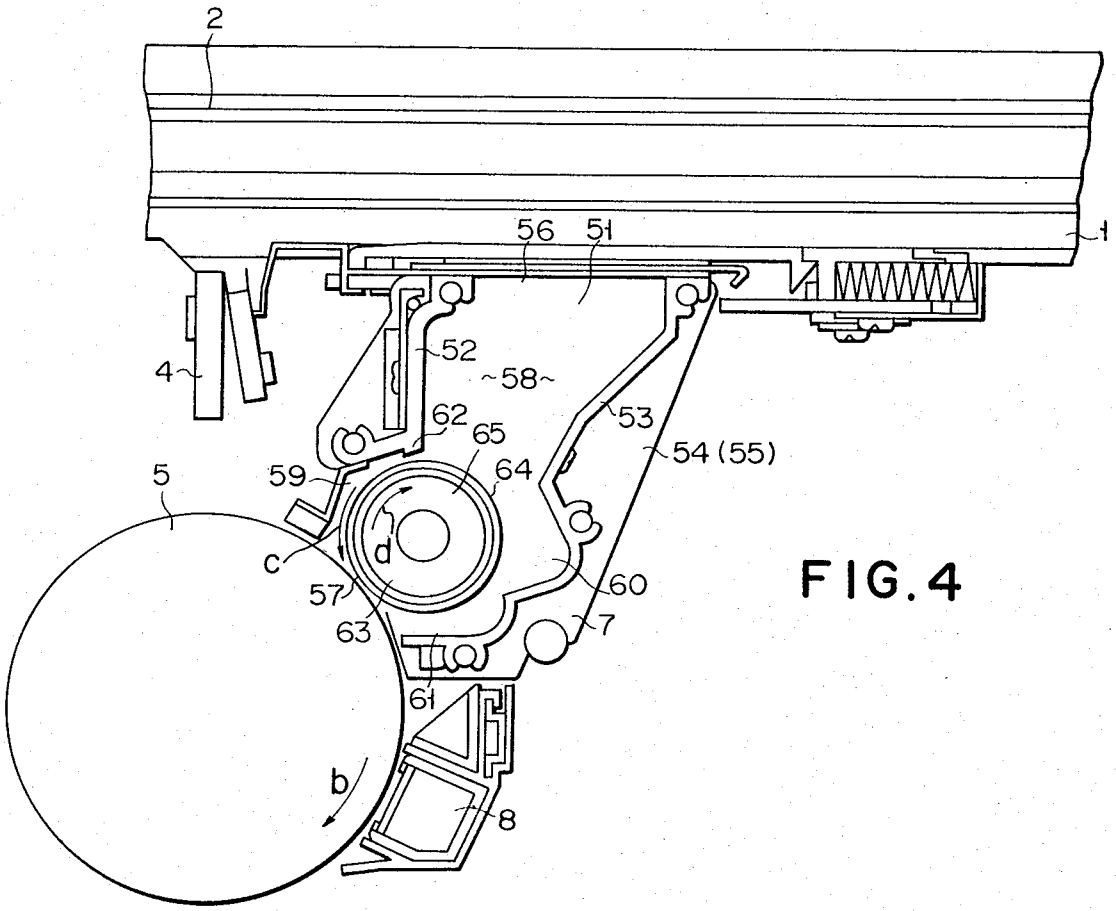
FIG. 4 is a side view of a developer unit.

A schematic illustration of the developer unit 7 using the one-component high resistance magnetic toner is given in FIG. 4. In the figure, a main frame 51 is comprised of first and second casings 52 and 53, and side frames 54 and 55 which are integrally formed at both ends as longitudinally viewed. In FIG. 4, only the frame 54 is shown. A toner feed opening 56 for supplying toner is cut at the upper portion of the main frame 51. The main frame 51 contains a toner container 58, a developer container 59, a toner temporary container 60, and a toner receptable 61. A doctor blade 62 is integrally formed at the corner of the first casing 52. The doctor blade 62 is for making uniform an amount of toner transferred by a developer roller 63 which is contained in the developer container 59. The developer roller 63 is comprised of a tubular rotating member 64 made of nonmagnetic material, such as stainless steel or aluminum, (hereinafter referred to as a "sleeve"), and a magnetic roller 65 provided within the sleeve 64. The sleeve 64 and the magnetic roller 65 are rotatably supported by the side frames 54 and 55, through ball bearings (not shown).

Figure 5:
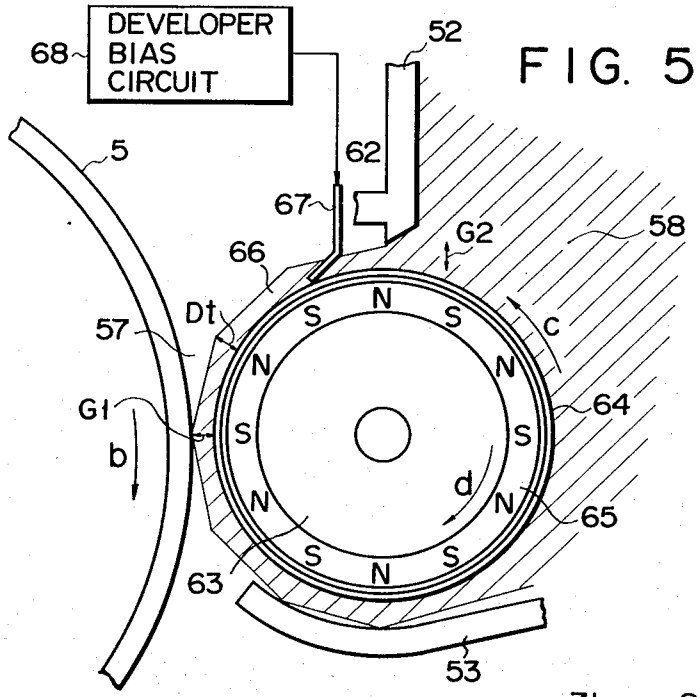
FIG. 5 is a side view of a developer roller and a peripheral section of the roller.

How to apply a bias voltage to the developer unit 7 thus constructed and how to transfer magnetic toner in the developer unit 7 will be described referring to FIG. 5.

The magnetic roller 65 is formed by a magnetic drum wherein N and S poles are alternately and equidistantly arranged along the periphery of the drum. With this arrangement, on the sleeve 64 are provided substantially orthogonal to the periphery of the sleeve provided on the outer periphery of the drum.

The sleeve 64 rotates in the direction of an arrow c with respect to the photoconductive drum 5 rotating in the direction of arrow b. The magnetic roller 65 rotates in the opposite direction as indicated by an arrow d. The sleeve 64 is partially exposed through a developer opening 57 formed in the main frame 51. A small gap Gl is provided between the outer periphery of the photoconductive drum 5 and the sleeve 64.

With such a construction, magnetic toner stored in the toner container 58 is attracted to the outer periphery of the sleeve 64 under influence of a magnetic field produced by the magnetic roller 65. In this case, magnetic toner is attracted upright on the outer periphery of the sleeve 64, like a soft brush. The attracted toner 66 is transferred in the direction of arrow c with the rotation of the sleeve 64. The toner 66 is then attracted to a latent image already formed on the surface of the photoconductive drum 5 through the gap Gl. In this way, the latent image is visualized or developed.

In the present embodiment the gap G2 between the tip of the doctor blade 62 and the sleeve 64 is set at about 0.35 mm. The gap G1 between the photoconductive drum 5 and the sleeve 64 is about 0.40 mm. The thickness Dt of the magnetic toner 66 after uniformed by the doctor blade 62 is 0.50 to 0.55 mm. At the position of the gap Gl between the photoconductive drum 5 and the sleeve 64, the magnetic toner 66 is slightly in contact with the surface of the photoconductive drum 5. In FIG. 5, a power feed blade 67 is in contact with the non-developing portion of the sleeve 64. The power feed blade 67 is supplied with an AC bias voltage (approximately 800 Hz) from the developer roller 63. The portions other than the developer roller 63, or the portions of the casings 52 and 53, are electrically isolated from the main frame 51 and the developer roller 63.

Figure 6:
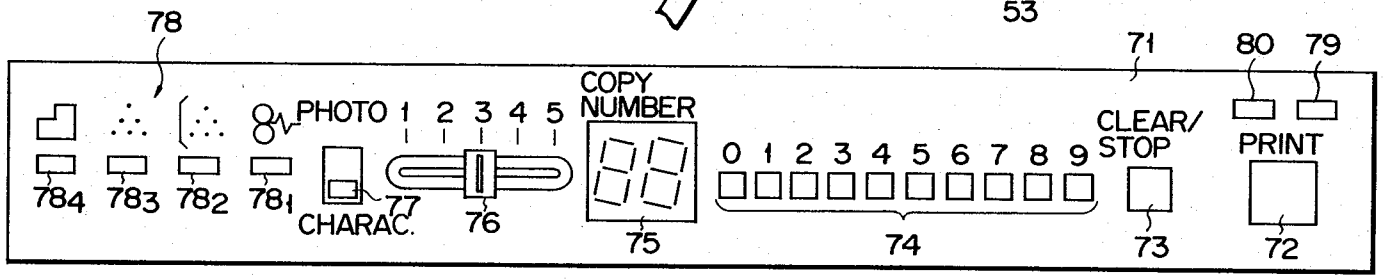
FIG. 6 is a plan view of an operation panel.

FIG. 6 shows an operation panel provided on the upper part on the front panel. In the figure, a panel 71 is provided with many keys and buttons for controlling the copy apparatus: a print key 72, a clear/stop key 73 to clear set data or to stop the copying operation, ten keys 74, copy number display window 75 for displaying the number of copies, resistor slider 76 for adjusting an amount of exposure, a document select switch 77 for selecting a kind of document contrast appropriate for the type of document being copied (e.g. documents requiring contrast, such as documents having characters and documents requiring gradiation such as photograhs), a machine condition indicator 78, a "ready" lamp 79, and a "wait" lamp 80. The machine condition indicator 78 is provided with a "jam" lamp $78_1$, a "cleaner" lamp $78_2$, a toner supply lamp $78_3$, and a paper supply lamp $78_4$.

Figure 7A:
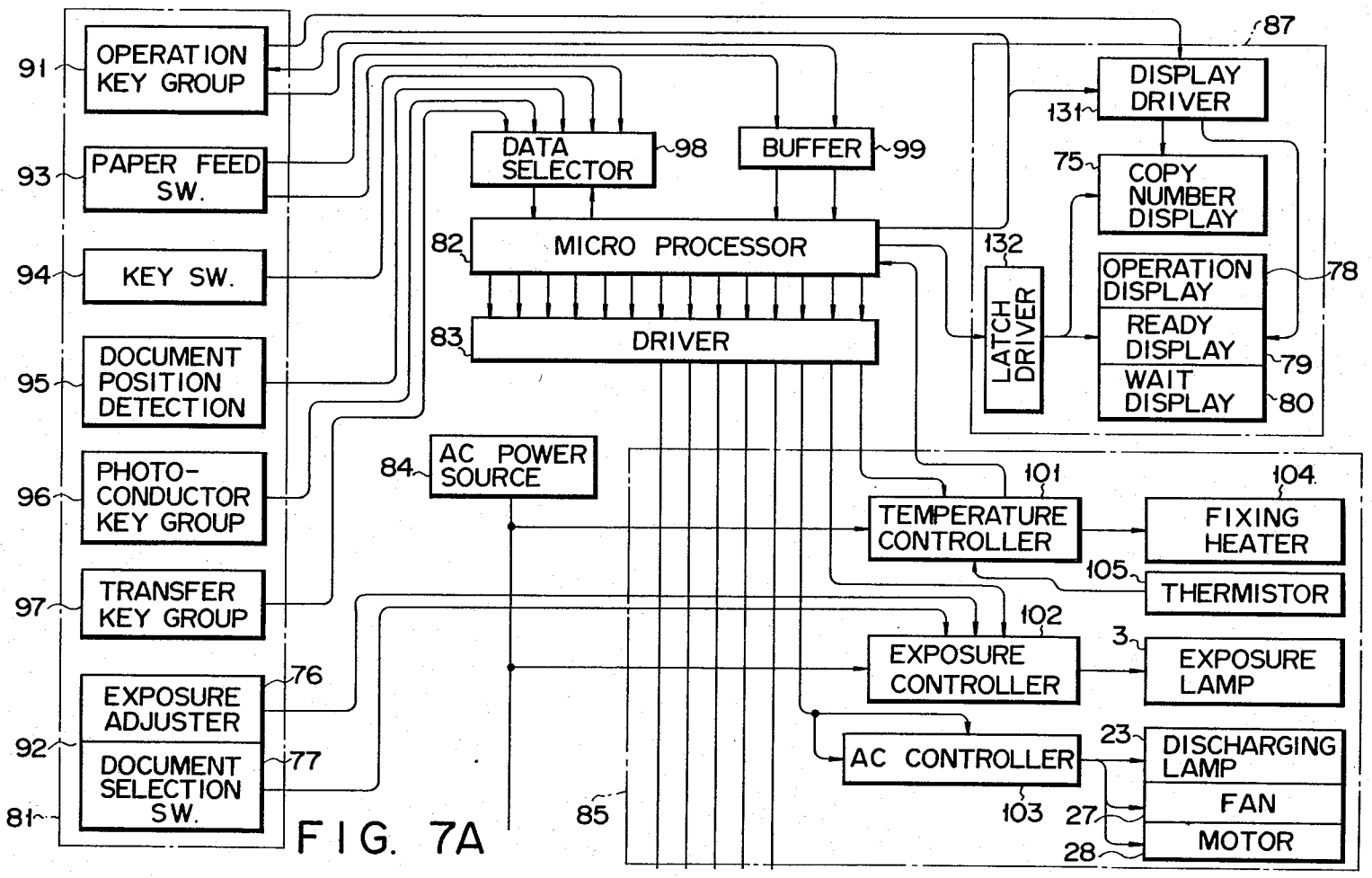
FIGS. 7A and 7B are block diagram of a control system of an electrophotographic copying apparatus according to the invention.
Figure 7B:
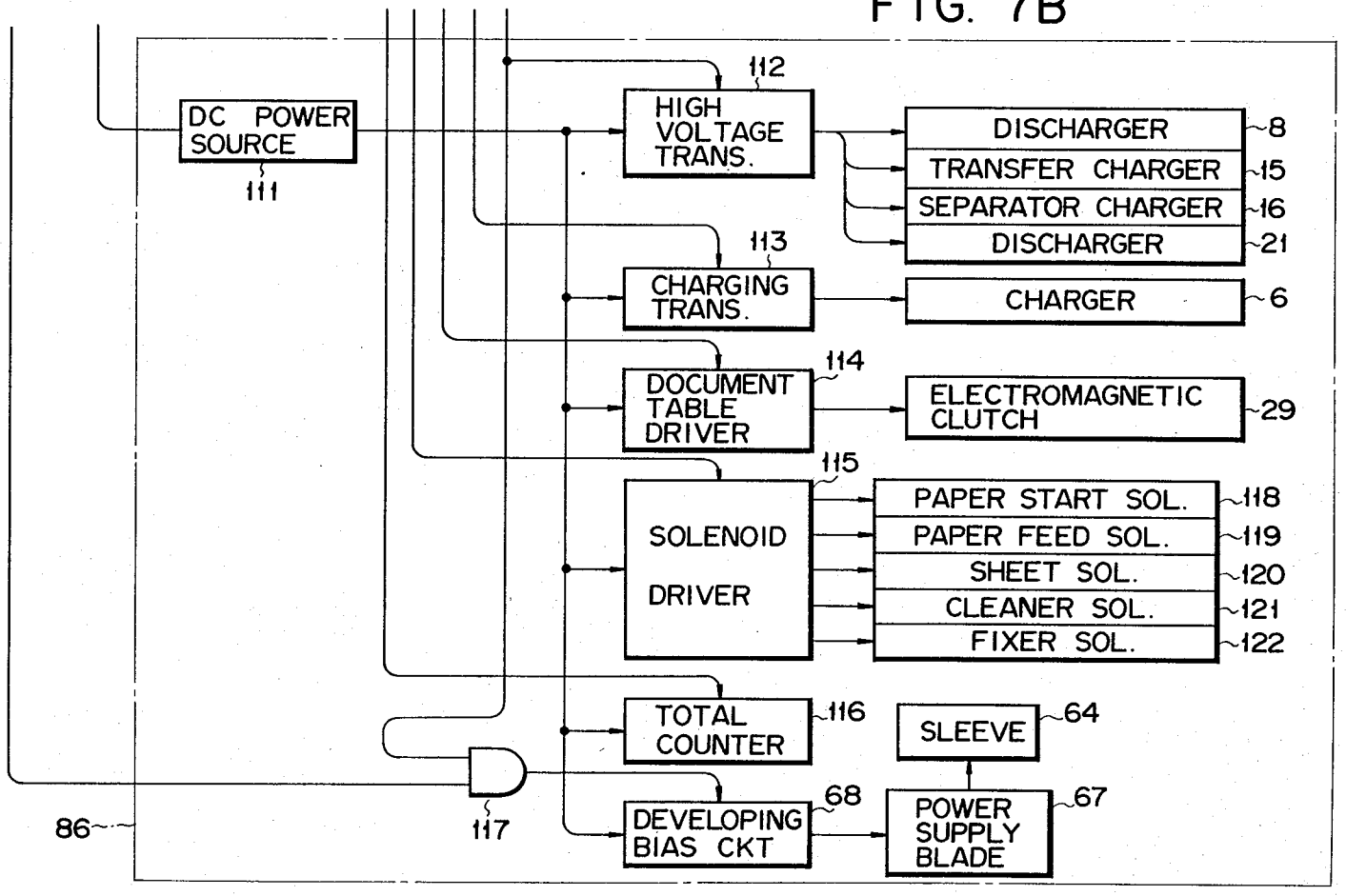

FIG. 7 is a block diagram of a control system for the copying apparatus described above. The control system comprises a switch unit 81, a microprocessor 82 for effecting an overall control and data processing, a driver 83 for forming various types of control signals on the basis of signals and data supplied from the microprocessor 82, an AC drive system 85 driven by the commercial AC power source 84, a DC drive system 86 driven by a DC power source, and a display system 87 for displaying various operating states of the copying apparatus.

In the switch unit 81, an operation key group 91 is provided. The group 91 is comprised of a print key 72, a clear/stop key 73, and ten keys 74. An exposure key group 92 is comprised of a resistor slider 76 and a document select switch 77. A paper feed key group 93 is comprised of a paper end switch (P-END-SW) for detecting end of paper fed by the paper feed roller 12, a sheet switch (SHEET-SW) for detecting paper manually inserted prior to the paper transferring roller 25, and a paper empty switch (P-EMP-SW) for sensing paper empty in the paper cassette 11. A document table position detecting key group 95 is composed of a key switch 94 for detecting mounting of a key counter (not shown), the table start switch (T-STR-SW) 45, the table home switch (T-HOME-SW) 46, the table limit switch (T-LIMIT-SW) 47, and a paper start switch (P-STR-SW). The photoconductor section key group 96 is comprised of a toner full switch (T-FULL-SW) for detecting a full state of collected toner in the cleaning unit 22, a cleaner cleaning switch for detecting the time of cleaning the inside of the cleaning unit 22, and a toner empty switch (T-EMP-SW) for detecting that the developer unit contains no toner. A transport key group 97 is comprised of an exit switch (EXIT-SW) for detecting end of paper exit prior to the copy exit roller 19. The signals from these keys except for an exposure key group 92 are input to the microprocessor 82 through a data selector 98 or a buffer.

The AC drive system 85 comprises a temperature control circuit 101 supplied with power from a commercial AC power source 84, an exposure control circuit 102 and an AC control circuit 103, a fixing heater 104 which is controlled by the temperature control circuit 101 and mounted and associated with the heat roller 18, and thermistor 105 for detecting temperature of the heat roller 18 and applying the detected signal to the temperature control circuit 101. The exposure control circuit 102 controls the exposure lamp 2 and the AC control circuit 103 controls the lamp 23, the cooling fan 27 and the motor 28.

The DC drive system 86 is comprised of a DC power source circuit 111 for converting an AC power from the commercial AC power source 85 to a DC power, e.g.

DC 24 V, a high voltage transformer 112 supplied with power from the DC power source circuit 111, a charger transformer 113, a document table drive circuit 114, a solenoid drive circuit 115, a total counter 116, an AND circuit 117, and the developer bias power supply circuit 68. The high voltage transformer 112 drives the discharging unit 8, the transfer charger 15, the separating charger 16, and the discharging unit 21. The charger transformer 113 drives the charger 6. The document table drive circuit 114 drives the electromagnetic clutch 29. The solenoid drive circuit 115 drives, on a case-by-case basis, a charger transformer (P-STR-SOL) 113 for controlling the aligning roller 14, a paper feed solenoid (P-FEED-SOL) 119 for controlling the paper feed roller 12, a sheet solenoid (SHEET-SOL) 120 for controlling the paper transferring roller 25, a cleaner solenoid (C-SOL) 121 for controlling the cleaning unit 22, and a fixing solenoid (N-SOL) 122 for controlling the heat roller 18.

The display system 87 is comprised of a display driver 131 receiving the operation key group 91, and a latch driver 132 for temporarily latching data from the microprocessor 82. The drivers 131 and 132 energize the copy number display window 75, the machine condition indicator 78, the "ready" lamp 79, and the "wait" lamp 80.

An overall operation of the control system thus arranged will be described referring to FIGS. 8 to 11. When the commercial AC power source 84 is turned on, the output port and RAM (ramdom-access memory) of the microprocessor 82 are cleared and then the copy number display window 75 displays "0". Further, the "wait" lamp 80 is lit. Then, a state of the cleaner cleaning switch is checked. If this switch is turned on, an error (ERR) is displayed, that is, a "cleaner" lamp $78_2$ lights. If it is turned off, it is checked whether or not a given time (about 5.4 sec.) passes from the check of the cleaner switch. This process is repeated till that time. If necessary, paper sheets left in the copying apparatus are forcibly made to exit. After the given time, the microprocessor 82 checks temperature of the heat roller 18 sensed by the thermistor 105 to check whether or not the copying apparatus is ready for copy. If it is ready, the copy number display window 75 displays "1". Subsequently, states of the key switch 94, the toner full switch and the paper empty switch are checked one after another. When these switches are in an undesirable state, the "ready" lamp 79 is still unlit.

Conversely, when these switches are in good condition, the "ready" lamp 79 is lit. Under this condition, the copying may be started.

After the number of copies is set by depressing the ten keys 74, the print key 72 is depressed to start the copying operation. When the print key 72 is depressed, the "ready" lamp 79 goes out and the cleaner solenoid 121 is turned on. After a given time of period (about 0.1 sec.), the motor 28 is driven. After a further given time (about 0.1 sec.), the fixing solenoid 122 and the high voltage transformer 112 are turned on. In the next step, a state of the document select switch 77 is checked. If it is turned on (photograph side), the developer bias power supply circuit 68 is turned on and an AC bias voltage is applied to the sleeve 64 of the developer unit 7. If the document select switch 77 is turned off (character side), the sleeve 64 of the developer unit 7 is still at ground potential, as will be described later. After a given period of time (about 0.31 sec.), a multiple continuous copy (MULT) is executed as shown in FIG. 9.

In the MULT mode, a state of the table start switch 45 is checked. When it is turned off, the document table retreat clutch of the electromagnetic clutch 29 is turned on to start the retreat of the document table 2. After a given time (about 0.1 sec.), the total counter 116 is turned on and the copy number display window 75 displays the number of copies as given by subtracting "1" from the set number of copies, in preparation for the counting of copies. Under this condition, the state of the paper start switch is checked. If it is turned off, after a given time (about 0.4 sec.), the state of the table start switch 45 is checked. If this switch 45 is turned off, the error is displayed after a given time (about 0.75 sec.). On the other hand, if the switch 45 and the paper start switch are turned on, the paper feed solenoid 119 is on after a given time (about 0.9 sec.), and the paper feed roller 12 rotates and feeds paper from the paper cassette 11. After a given time (about 0.83 sec.), the paper feed solenoid 119 is turned off and the paper feed ends. After a given time (about 0.1 sec.), the exposure lamp 3 lights to start the exposure process. Then, after a given time (about 0.1 sec.), the state of the table start switch 45 is checked. When this switch 45 is off, the error is displayed after a given time (about 0.06 sec.). If the switch 45 is turned off, after a givem time (about 0.05 sec.), the document table advance clutch of the electromagnetic clutch 29 is actuated to move the document table 2. After a given time (about 0.18 sec.), the charger transformer 113 is turned on to execute the charging process. Then, the state of the paper start switch is checked. If it is turned on, the paper start solenoid 118 is turned on and the paper P taken out by the paper feed roller 12 is aligned by the aligning roller 14. This operation proceeds according to a flow illustrated in FIG. 10. If the switch 45 is turned off, "ERROR" is displayed after a given time (about 0.73 sec.).

As described above, the paper sheet P is transferred to the photoconductive drum 5 by the aligning roller 14 and when the trailing end of the paper sheet P is detected by paper end switch, the charger transformer 113 is turned off after a given time (about 0.04 sec.). At this point, the charging process ends. On the other hand, when the paper sheet P is not detected, the document table 2 further advances and the magnet 44 turns on the reed switch (table limit switch) 47. When it is judged that this switch 47 is turned on, "ERROR" is displayed after a given time (about 0.7 sec.). Even if the limit switch 47 is turned on, "ERROR" is displayed after a given time (about 3 sec.). After the charge process is executed and completed in this way, it is checked whether the size of the document is smaller than B4 or not. If it is not smaller than B5, the document table advance clutch is released after a given time of period (about 0.03 sec.) and the document table 2 is stopped. After a given time (about 0.1 sec.), the document table retreat clutch is actuated, the document table 2 starts retreating and after a given time (about 0.06 sec.) the exposure lamp 3 is turned off. In this way, the document table 2 repeats the reciprocal movement and the magnet 44 turns on the reed switch (table home switch) 46. When it is judged that this switch 46 is turned on, the operation of the copying machine enters a flow of FIG. 11. When the switch 46 is turned off, "ERROR" is displayed after a given time (about 0.48 sec.).

As described above, if it is judged that the table home switch 46 is turned on, the state of the clear/stop key 73 is checked. If it is turned off, it is checked whether or not the copying apparatus is in a continuous copy mode.

When it is in a continuous copy mode, the state of the key switch 94 is checked. If it is turned on, the state of the paper empty switch is checked. When it is turned on, the state of the toner full switch is checked. If the toner full switch is turned off, the operation of the copying apparatus enters the continuous copy flow shown in FIG. 9. While the clear/stop key 73 is turned on, the copying apparatus is not in the continuous mode, the key switch 94 is turned off, the paper empty switch is turned off, and when the toner full switch is turned on, the next flow is executed. The document retreat clutch and the paper start solenoid 118 are then deenergized. In this step, the copy number display window 75 displays restoration of copy number and a state of the exit switch is checked to detect the end of paper exit. If the paper exit ends, the high voltage transformer 112 and the developer bias power supply circuit 68 are turned off after a given time (about 1.4 sec.). After a further given time (about 3.07 sec.), the fixing solenoid 122 is de-energized and the motor 28 is stopped after a given time (about 0.7 sec.). After a further given time (about 0.1 sec.), the cleaner solenoid 121 is de-energized. At this point, one cycle of the copying operation is completed.

In the copying apparatus, the microprocessor 82 interrupts the program during the course of its execution at given time intervals and resets various types of data. The interrupt is done for keeping the contents of the program.

Figure 12:
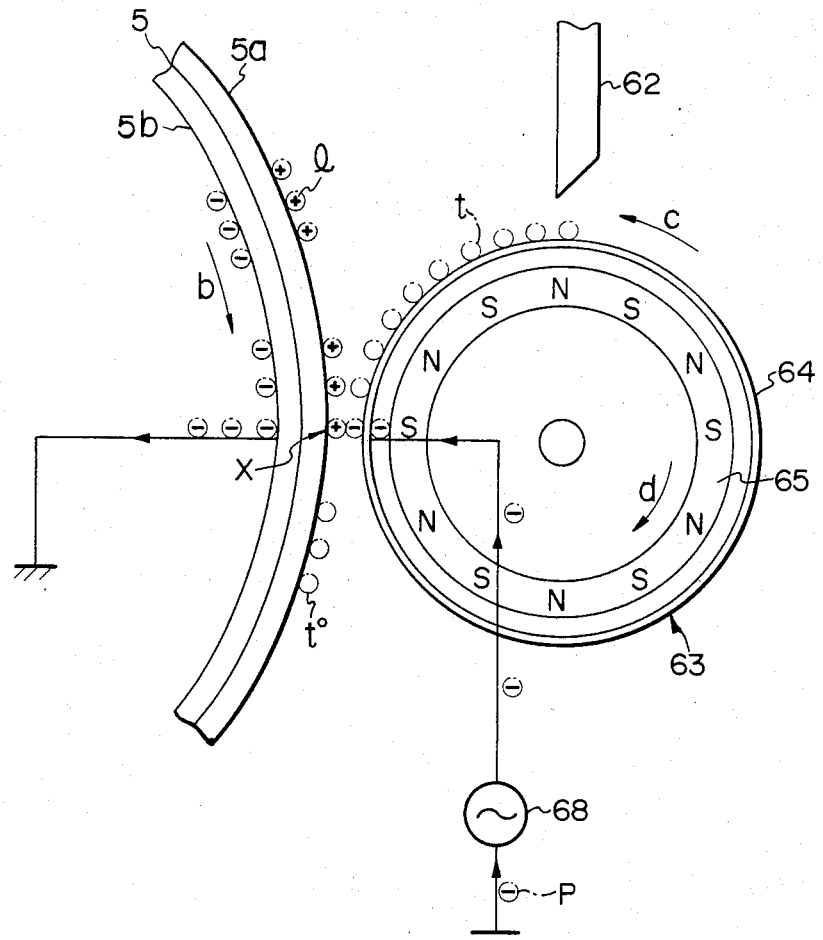
FIG. 12 shows a side view of a developer roller and a photoconductive drum in the developer unit.

The principles of development using one-component high resistance magnetic toner according to the present invention will be described in brief, referring to FIG. 12. In FIG. 12, the magnetic toner t is transferred in the direction of an arrow c with aid of a rotating magnetic field of the magnetic roller 65 and the sleeve 64 rotating in the direction of an arrow e. At this time, the thickness of the magnetic toner t has been fixed by the doctor blade 62. Positive charges are stored in the photoconductive layer 5*a* of the photoconductive drum 5, with its configuration corresponding to a document pattern. That is, a latent image l has been formed. The conductive layer 5*b* (made of aluminum) of the photoconductive drum 5 is grounded. The sleeve 64 of the developer unit 7 is also grounded through the developing bias power supply circuit 68. When the positive charge P stored in the photoconductive layer 5*a* reaches at a developing point X, opposite polarity, or negative, charge n is induced in the conductive layer 5*b*. The charge n is applied to the surface of the sleeve 64 through the developer bias power supply circuit 68, and is injected into the magnetic toner t. In this way, the development is performed when the one-component high resistance magnetic toner is used.

Figure 13:
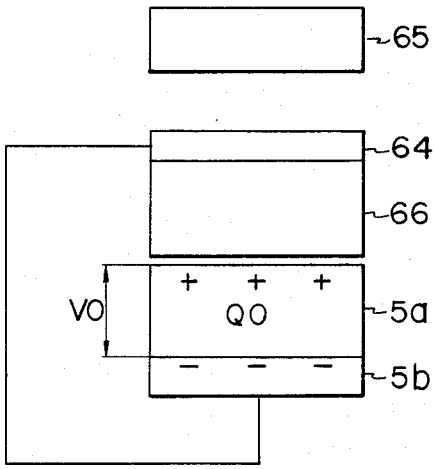
FIGS. 13 and 14 are schematic illustrations explaining the operation of the developer unit.
Figure 14:
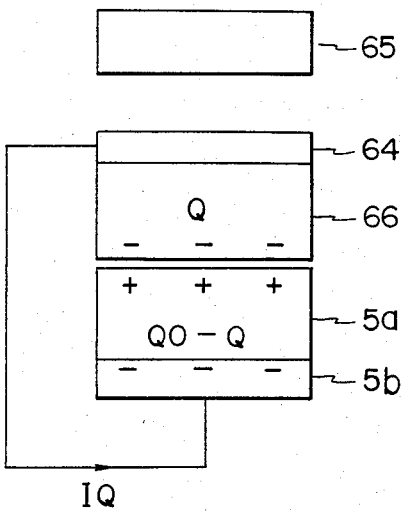
Figure 15:
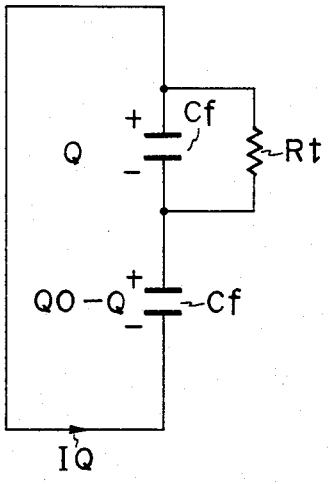
FIG. 15 is an equivalent circuit of developer unit of FIGS. 13 and 14.

The principle of development at the developing point X will be described in more detail referring to FIGS. 13 to 15. FIGS. 13 and 14 show a model of the developing phenomenon. The equivalent circuit of the developer at that time is shown in FIG. 15. In FIGS. 13 and 14, the magnetic roller 65, the sleeve 64, the magnetic toner layer 66, the photoconductive layer 5*a* the conductive layer 5*b* are arranged one upon another. In FIG. 15, CF is an equivalent capacitance of the photoconductive layer 5*a*, CT an equivalent capacitor of the magnetic toner layer 66, and Rr an equivalent resistance of the magnetic toner layer 66. FIG. 13 shows the state immediately before that the latent image l with positive charge Qo present near the magnetic toner layer 66 is transferred to the magnetic toner layer 66. In the case of high resistance magnetic toner, the magnetic toner layer 66 has a large resistance. When the surface potential Vo of the photoconductive layer 5*a* is low, a time constant of the magnetic toner layer 66 is larger then the developing time. For this reason, insufficient charge is transferred to the magnetic toner layer 66, so that insufficient charge is induced in the end portion of the magnetic toner layer 66. On the other hand, when the surface potential Vo is high, the equivalent resistance $R_T$ is low. This is because the resistance of the magnetic toner layer 66 depends on the electric field. A sufficient charge is induced in the end portion of the magnetic toner layer 66. As shown in FIG. 14, the developing current I flows, and the charge Q is tranferred from the photoconductive layer 5*a* to the magnetic toner layer 66. At this time, charge at the surface portion of the magnetic toner layer 66 is influenced by the magnetic force Fm occurring due to the magnetic roller 65 in the direction thereof and the electrostatic force Ff directed toward the photoconductive layer 5*a*. It is assumed that the magnetic force Fm directed toward the roller 65 is fixed, and an electrostatic force Ff toward the photoconductive layer 5*a* is proportional to the surface potential Vo. Accordingly, when the surface potential Vo exceeds a predetermined value, $|Fm<Ff|$ holds. Under this condition, toner particles at the surface portion are attracted to and stuck to the photoconductive layer 5*a* (see toner $t^o$ in FIG. 12), thereby to effect the development.

Figure 16:
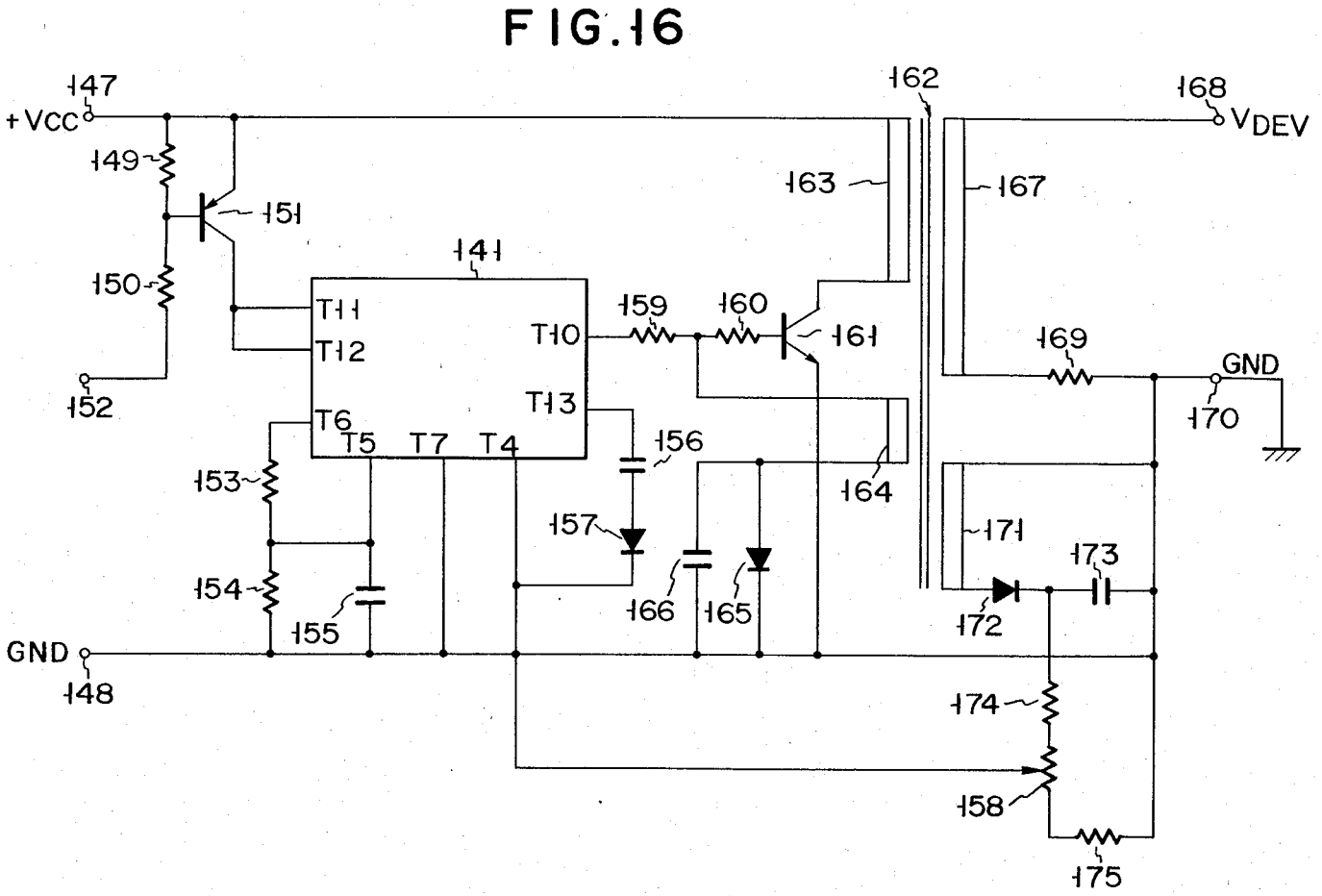
FIG. 16 is a circuit diagram of a bias circuit of a developer unit.

The developing bias power source circuit 68 will be described referring to FIG. 16. In FIG. 16, a known voltage control IC 141, for example, μA 723 manufactured by Texas Instruments, Inc. is composed of a Zener diode 142 forming a reference voltage generating circuit, a constant current circuit 143, an impedance conversion amplifier, an error amplifier (differential amplifier) 145, and an output control transistor 146. The power source terminal 147 is supplied with +Vcc from a power circuit 111 (FIG. 7). A constant current circuit 143 is connected to a ground line of the power circuit 111.

Resistors 149 and 150, and a PNP transistor 151 make up an on-off control circuit of a developing bias voltage. The resistors 149 and 150 are connected in series. The series circuit is connected at one end to the power terminal 147 and at the other end to a remote signal terminal 152. A connection point between the resistors 149 and 150 is connected to the base of a transistor 151. The emitter of the transistor 151 is connected to the power terminal T11 of the voltage control IC 141 and the collector T11 of the output control transistor 146. An output signal from the AND circuit 117 (FIG. 7) is applied to the remote signal terminal 152.

Resistors 153 and 154 are connected in series between a reference voltage generating terminal T6 of the IC 141 and the ground terminal 148. A connection point of these resistors 153 and 154 is connected to the noninverting input terminal T5 of the IC 141. A capacitor 155 is connected between the terminal T5 and the ground terminal 148, for ensuring a stable voltage and a soft start. A capacitor 156 for frequency compensation and a diode directed as shown are connected in series between the inverting input terminal T4 and the frequency compensating terminal T13. The inverting input terminal T4 is connected to a sliding terminal of a variable resistor 153 for adjusting an output voltage. The output terminal T10 of the IC 141 is connected to the base of an NPN transistor for oscillation control through the resistors 159 and 160 in series. The emitter of the transistor 161 is connected to the ground terminal 142. The collector of the same transistor is connected to a power source terminal 147 through a primary winding 163 of a booster transformer 162. A connection point of the resistors 159 and 160 is connected to one end of an oscillation winding 164 of the booster transformer 162. A diode 165 for voltage clamping and a capacitor 166 for oscillation are connected in parallel between the other end of the winding 164 and the ground terminal 142. One end of the output winding 164 of the transformer 162 is connected to a bias voltage output terminal 168 and the other end is connected to a ground terminal 170 through a protective resistor 169 which operates at the time of short-circuiting. The output terminal 163 is connected to the power supply blade 67 (see FIG. 5) of the developer unit 7. The terminal 170 is connected to the ground terminal 143 and to the copying console 1 (FIG. 1). One end of the winding 171 for detecting output voltage of the booster transformer is connected to the ground terminal 170. The other end of the winding 171 is connected to the ground terminal 170. The other end of the winding 171 is connected to the ground terminal 170 through a rectifier diode 172 and a smoothing capacitor 173 in series. A connection point between the diode 172 and the capacitor 173 is connected to one end of the variable resistor 158 through the resistor 174. The other end of the resistor 158 is connected to a ground terminal via a resistor 175. With this connection, the output voltage of the winding 171 is converted into a DC voltage by the combination of the diode 172 and the capacitor 173. The DC voltage converted is divided by the resistors 174 and 175, and variable resistor 158. Then, the voltage at the sliding terminal of the variable resistor 158 is applied as a proper feedback voltage Vfb to the inverting input terminal T4.

The operation of the arrangement as mentioned above will be described with reference to FIG. 16. When the remote signal terminal 151 is low in level, the transistor 151 is turned on and the power source voltage +Vcc is supplied to the terminals T11 and T12 of the IC 141. Then, the IC 141 starts to operate. Accordingly, reference voltage Vref appears at the terminal T6 of the IC 141. The voltage Vref is divided by the resistors 154 and 153 and applied to the noninverting input terminal T5. At this time, the voltage at the noninverting terminal T5 gradually increases at a time constant through the capacitor 155 until it reaches a divided voltage by the resistors 153 and 154. Immediately after the remote signal terminal 152 is low, the feedback voltage Vfb is 0 V. Accordingly, the output terminal T10 is high since the voltage at the inverting input terminal T4 is lower than that at the noninverting input terminal T5. Then, the transistor 161 allows the base current to flow. A given voltage is generated across the output winding 167.

The transistor 161 is repeatedly turned on and off by the feedback voltage at given periods. The period is determined by an inductance of the winding 164 and a capacitance of the capacitor 166.

Figure 17:
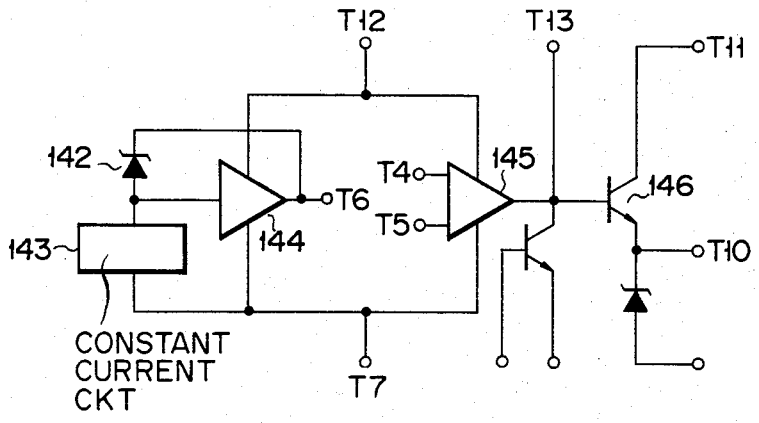
FIG. 17 is a circuit diagram of a voltage control IC of FIG. 16.

An AC developing bias voltage $V_{DEV}$ appears across the output winding 167. The bias voltage is always constant, because it is controlled by the error amplifier 145 and the output control transistor 146 (FIG. 17) so that the feedback voltage Vfb from the winding 171 is equal to the voltage (i.e. operation reference voltage) at the noninverting input terminal T5.

Figure 18:
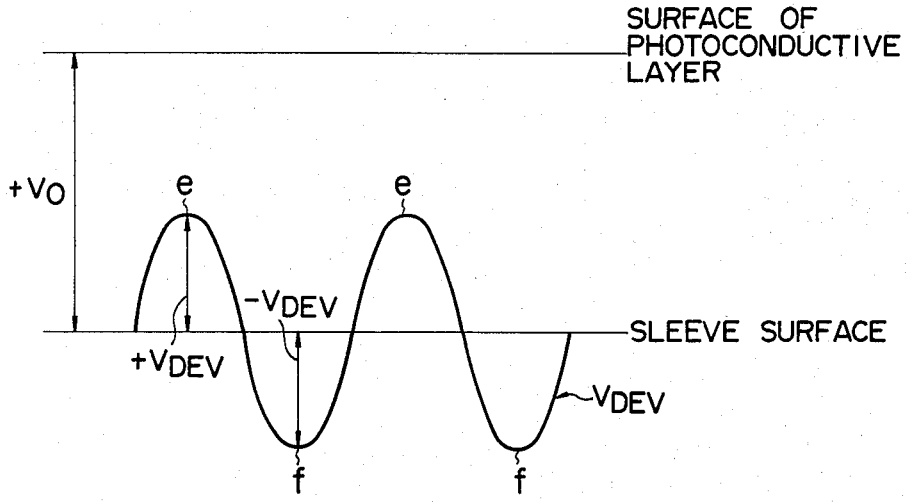
FIG. 18 shows a waveform illustrating a biased state of the developer unit when it operates.
Figure 19:
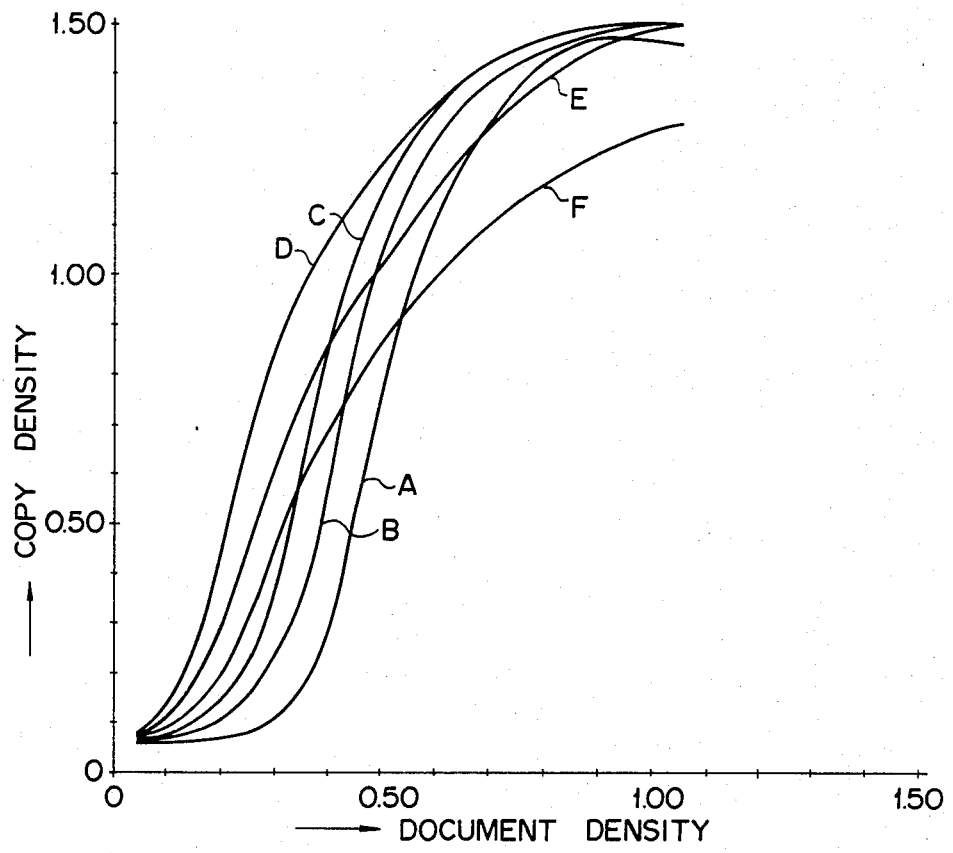
FIG. 19 is a graphical representation of a copy density-document density characteristic (called $\gamma$ characteristic)

The effect of the developing bias voltage $V_{DEV}$ produced from the circuit 68, particularly a relationship between the document density and the copy density, will be described with reference to FIGS. 18 and 19. FIG. 18 illustrates a relationship of the surface potential Vo on the photoconductive layer 5*a* and the developing bias voltage (at 800 Hz). FIG. 19 graphically represents experimental data on a relationship between the document density and the copy density when the developing bias voltage $V_{DEV}$ is changed.

In this paragraph, let us discuss a change in developing conditions when the developing bias voltage is applied to the developer unit. In FIG. 18, when the developing bias voltage $V_{DEV}$ is applied to the sleeve 64 of the developer unit 7, an intensity of an electric field applied to the magnetic toner layer changes in synchronism with the developing bias voltage $V_{DEV}$. At point e (at time point that a positive voltage is applied to the sleeve 64), the intensity of the electric field is weaker than that when no developing bias voltage $V_{DEV}$ is applied to the sleeve. At point f (at time point that a negative voltage is applied), the intensity of the electric field is stronger. Thus, at point f the electric field is intensified, so that the charge transfer to the magnetic toner layer 66 is easily performed compared with the case when no developing bias voltage $V_{DEV}$ is applied to the sleeve 64. At point e, the reverse charge transfer is performed to attract the negatively charged toner to the sleeve 64. As described above, when the developing bias voltage $V_{DEV}$ is applied to the sleeve 64, the force to facilitate the development and the force to hinder the development are alternately generated according to the state of the voltage applied.

FIG. 19 shows data when an amount of exposure light to the document is kept constant, the document density is proportional to the surface potential Vo of the photoconductive layer 5*a*. As shown in the figure, when the developing bias voltage $V_{DEV}$ of the photoconductive layer 5*a* is gradually increased, a characteristic curve shifts toward the left. When the developing bias voltage $V_{DEV}$ is approximately 500 V, the characteristic curve is shifted to the leftmost side. This indicates that the copy density is higher when the developing bias voltage $V_{DEV}$ is applied to the sleeve 64 than when it is not applied thereto. If the developing bias voltage $V_{DEV}$ is above 500 V, a rate of change of the characteristic curve is lower. In FIG. 19, a characteristic curve A indicates the characteristic observed when the developing bias voltage $V_{DEV}$ is 0 V; a characteristic curve B the characteristic observed when voltage $V_{DEV}$ is 100 V; a characteristic curve C the characteristic when voltage $V_{DEV}$ is 200 V; a characteristic curve D the characteristic observed when voltage $V_{DEV}$ is 500 V; a characteristic curve E the characteristic observed when voltage $V_{DEV}$ is 800 V; and a characteristic curve F the characteristic observed when voltage $V_{DEV}$ is 1,000 V. This data indicates that up to about 500 V of the developing bias voltage $V_{DEV}$, a rate of change in the characteristic curve changes little and the characteristic curve shifts to the left. This feature approximates to the case that the amount of exposure light is changed a little, while the developing bias voltage $V_{DEV}$ is not applied to the sleeve 64. When the developing bias voltage $V_{DEV}$ exceeds 500 V, a rate of change in the characteristic curve changes depending on the voltage. This implies that a graduation is improved for the document density.

As described above, when the developing bias voltage $V_{DEV}$ is changed, the force to facilitate the development by the negative voltage (point f) in FIG. 18 is intensive up to about 500 V. In the range of 500 V or more, the development facilitating effect by the negative voltage is of course obtained, but the force to impede the development (at point e) by the positive voltage is also effective. Accordingly, a rate of change in the characteristic curve may be changed. When the developing bias voltage $V_{DEV}$ is applied to the sleeve 64, and the magnetic toner is vibrated, the magnetic toner is loosened, so that the transportation of the magnetic toner is improved. Further, it is possible to compensate for a change in the attraction force to the magnetic toner by the rotation of the magnetic roller. Therefore, the non-uniformity in the development can remarkably be reduced.

Figure 20:
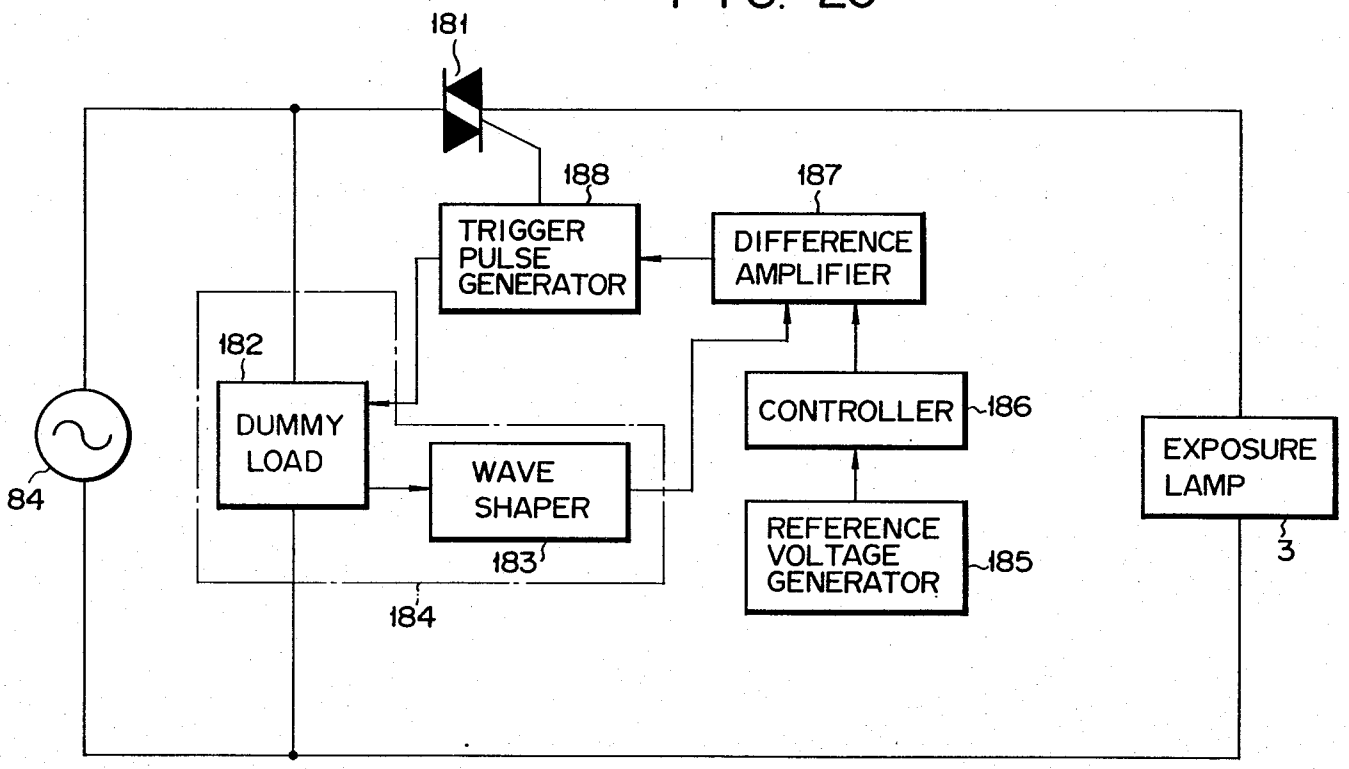
FIG. 20 is a block diagram of a control circuit.
Figure 21:
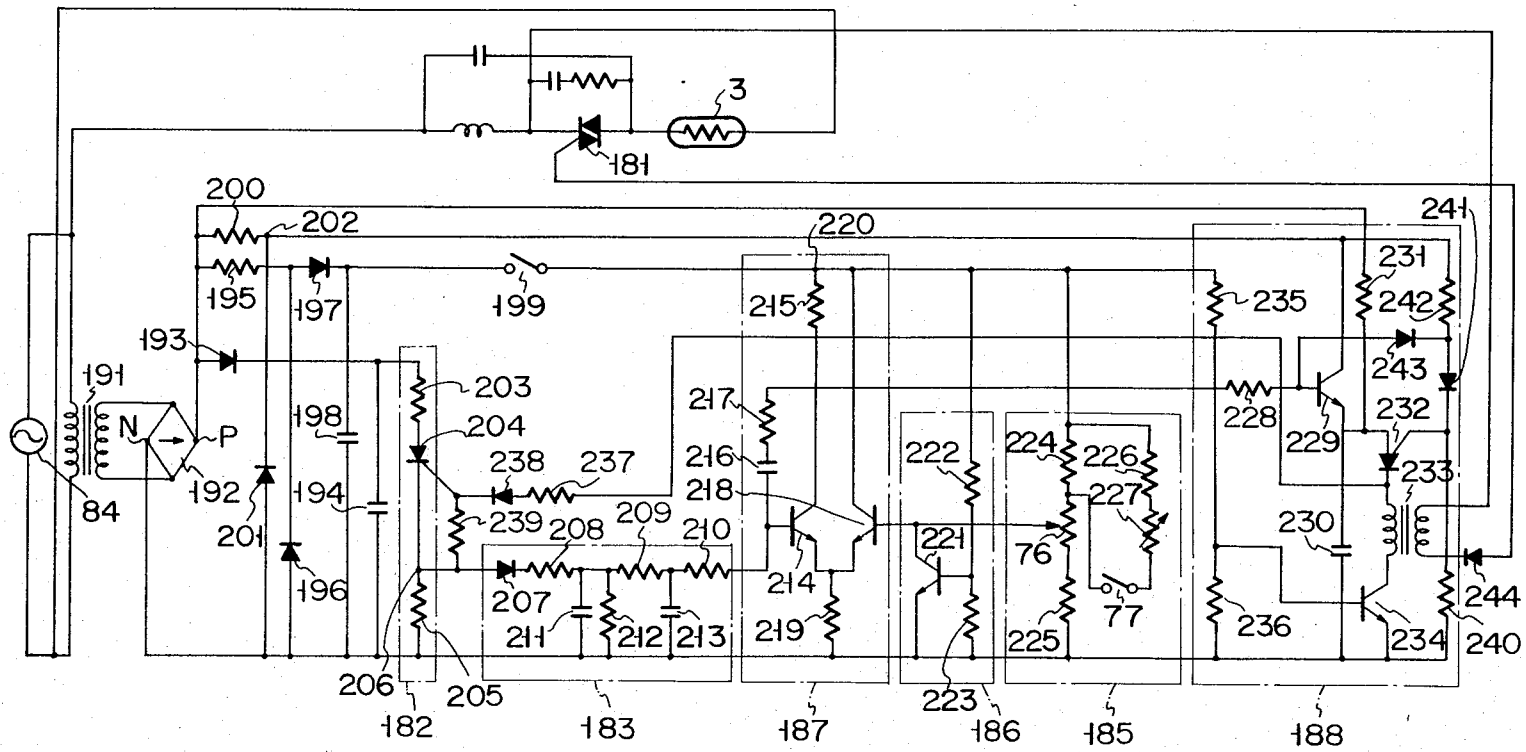
FIG. 21 is a circuit diagram of the control circuit shown in FIG. 20.
Figure 22:
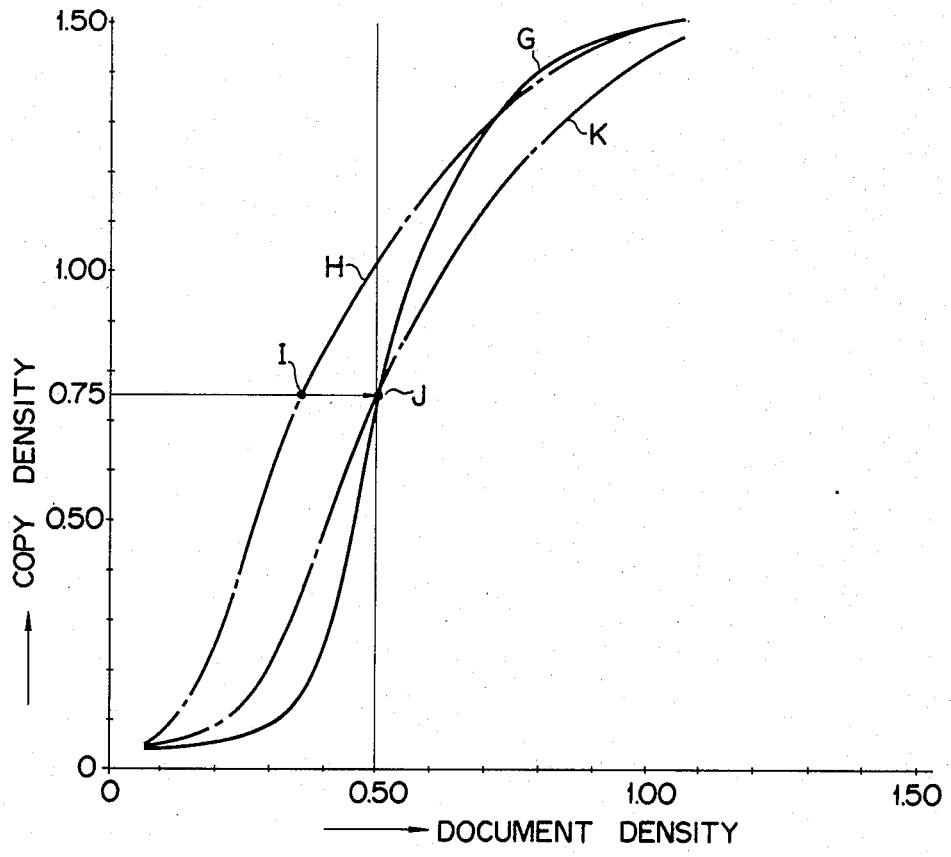
FIG. 22 is a graphical representation of $\gamma$ characteristic when a copy mode of the electrophotographic copying apparatus is switched between a document copy mode and a photograph copy mode.

The description which follows is an elaboration of a select means (the exposure control circuit 102) for selecting a document density-copy density characteristic ($\gamma$ characteristic), which is essential to the present invention, the characteristic when it is selected, and merits resulting from the selection. Reference is made to FIGS. 20 to 22. FIG. 20 schematically shows the exposure control circuit 102 (FIG. 7). The AC power source 84 is connected to the exposure lamp 3, through a bidirectional thyristor 181. The AC power source 84 is connected to a dummy load circuit 182. The dummy load circuit 182 applies a voltage corresponding to the terminal voltage of the exposure lamp 3 to the dummy load when the bidirectional thyristor 181 is turned on. The voltage across the dummy load is produced as an output voltage. The output voltage from the dummy load circuit 182 is supplied to a wave shaping circuit 183. The wave shaping circuit 183 wave-shapes the output voltage of the dummy load circuit 182 and produces a voltage corresponding to the effective value voltage of the exposure lamp 3. The dummy load circuit 182 and the wave shaping circuit 183 make up a voltage generating circuit 184 for generating a voltage corresponding to the terminal voltage of the exposure lamp 3.

A reference voltage generating circuit 185 generates a DC voltage through a manual setting member. The output voltage from the reference voltage generating circuit 185 is supplied through a limiter circuit 186 to a comparator, for example, a differential amplifier or an error amplifier 187. The error amplifier 187 is also supplied with the output voltage from the wave shaping circuit 183. The limiter circuit 186 limits the output voltage of the reference voltage generating circuit 135 supplied to the error amplifier 187. The error amplifier 187 compares the output voltage from the wave shaping circuit 183 with the output voltage from the reference voltage generating circuit 185 supplied through the limiter circuit 186. When there is a difference between them, it produces a voltage corresponding to a magnitude of the difference. The output signal from the error amplifier 187 is applied to a trigger pulse generating circuit 188. The trigger pulse generating circuit 188 produces a trigger pulse in synchronism with the frequency of the power source 84, and controls a phase of the trigger pulse generator according to the output signal of the error amplifier 187. The controlled trigger pulse is supplied to the gate of the thyristor 181.

FIG. 21 shows a practical arrangement of the circuits shown in FIG. 20. The primary coil of the power transformer 191 is connected to the power source 84. The secondary coil of the transformer 191 is connected to the full-wave rectifier 192. A series circuit including the diode 193 and the capacitor 194 is connected between the DC output terminals P and N of the rectifier 192. The series circuit of the Zener diode 197 and the capacitor 198 is connected in parallel with the diode 196. A connection point between the diode 197 and the capacitor 198 is connected to one end of a relay contact 199. A series circuit of a resistor 200 and Zener diode 201 is connected between the output terminals P and N. A trapezoidal waveform voltage in synchronism with the power source 84 is generated at the connection point 202 between the resistor 200 and the diode 201. The capacitor 194 is connected in parallel with a series circuit including the resistor 203 forming the dummy load circuit 182, the monodirectional thyristor 204, and the resistor 205 serving as a dummy load. A connection point between the cathode of the thyristor 204 as the output terminal of the dummy load circuit 182 and the resistor 205 is connected to a resistor 210 through the diode 207, and the resistors 208 and 209. A capacitor 211 and a resistor 212 are connected in parallel between the connection point between the resistors 208 and 209 and the output terminal N. Diode 207, resistors 208 to 210 and 212, and capacitors 211 and 213 make up a wave shaping circuit 183. The other end of the resistor 210 is connected to the base of an NPN transistor 214. The collector of the transistor 214 is connected to the other end of the relay contact 199, through a resistor 215. A series circuit of a capacitor 216 and a resistor 217 for preventing an oscillation is connected between the base and the collector of the transistor 214. The emitter of the transistor 214 is connected to the emitter of another NPN transistor 218. A connection point of these emitters is connected to the output terminal N, through the resistor 219. The collector of the transistor 218 is connected to a connection point of the relay contact 199 and the resistor 215. The transistors 214 and 218 make up an error amplifier 187. The base of the transistor 218 is connected to the collector of the NPN transistor 221, of which the emitter is connected to the output terminal N. The base of the transistor 221 is connected to the connection point 220 through the resistor 222 and through the resistor 223 to the output terminal N. The transistors 221, and the resistors 222 and 223 make up a limiter circuit 186.

The base of the transistor 218 is connected to the sliding terminal of the resistor 76 (FIGS. 6 and 7). One end of the variable resistor 76 is connected through a resistor 224 to the connection point 220. The other end of the same is connected through the resistor 225 to the output terminal N. The resistor 224 is connected in parallel with a series circuit including a resistor 226 for compensating the exposure light amount, a variable resistor 227 and the document select switch 77 (FIGS. 6 and 7). The variable resistors 76 and 227 and the resistors 224 to 226 make up the reference voltage generating circuit 185.

A connection point between the collector of the transistor 214 as an output terminal of the error amplifier 187 and the resistor 215 is connected to the base of the NPN transistor 229 through a resistor 228. The collector of the transistor 229 is connected to the connection point 202. The emitter of the transistor 229 is connected to the output terminal N via a capacitor 230 and to the output terminal P via a resistor 231. The emitter of the transistor 229 is connected to the anode of a programmable unijunction transistor 232 (referred to simply as "PUT"), too. The cathode of the PUT 232 is connected in series to the output terminal N through the primary coil and the NPN transistor 234. The base of the transistor 234 is connected to the connection point 220 through a resistor 235 and to the output terminal N through a resistor 236. The cathode of the PUT 232 is connected to the gate of the thyristor 204 through a resistor 237 and a diode 238. The diode 238 is connected through a resistor 239 to the connection point 206. The gate of the PUT 232 is connected to the output terminal N through a resistor 240 and is connected in series to the connection point 202 through the diode 241 and the resistor 242. A connection point of the diode 241 and a resistor 242 is connected to a connection point between the base of the transistor 229 and the resistor 228 through a diode 243. The secondary coil of the pulse transformer 233 is connected between the gate of the thyristor 181 and the first anode through a diode 244. The transistor 229, the capacitor 230, the PUT 232, the pulse transformer 233 and the transistor 234 cooperate to form the trigger pulse generating circuit 188.

With such an arrangement, the control operation for providing an optimum exposure against a variation of the power source voltage is performed as will be described below, when the document select switch 77 is set to the character side (off state). When the exposure lamp light signal is generated and the relay contact 199 is closed, a voltage obtained by dividing the voltage at the connection point 220 by resistors 235 and 236 is applied to the base of the transistor 234. Then, the transistor is turned on. A voltage at the connection point 220 is applied to the base of the transistor 229 through the resistors 215 and 228. Then, transistor 229 is turned on. The capacitor 230 is charged through the transistor 229. As the capacitor 230 exceeds the gate voltage, the PUT 232 is turned on and pulse current flows through the primary coil of the pulse transformer 233. Accordingly, the pulse is generated in the secondary coil of the pulse transformer 233. This pulse is applied as a trigger pulse to the thyristor 181. As a result, the thyristor 181 is turned on and the exposure lamp 3 lights.

At this time, the trigger pulse is applied to the gate of the thyristor 204 through the resistor 237 and the diode 238. The thyristor 204 is turned on in response to the pulse, thus producing a voltage across the resistor 205, which corresponds to the voltage of the exposure lamp 3. The voltage is wave-shaped by the wave shaping circuit composed of the diode 207, the resistors 208 to 210, and 212 and the capacitors 211 and 213. The wave-shaped voltage is a DC voltage corresponding to the effective voltage of the exposure lamp 3. This voltage is applied to the base of the transistor 214. If the base voltage of the transistor 214 is lower than that of the transistor 218, the collector voltage of the transistor 214 is high and the base voltage of the transistor 229 is also high. And the charging speed of the capacitor 230 is high. As a result, the PUT 232 generates timing pulses at fast timing, so that the conduction angle of the thyristor 181 increases. Further, the exposure lamp 3 increases its light amount as a higher voltage is applied. A signal representing the increase of the conduction angle of the thyristor 181 is fed back to the thyristor 204. The base voltage of the transistor 214 rises. The moment the base voltage of the transistor 214 reaches the base voltage of the transistor 218, the base voltages at the transistors 214 and 218 are well balanced. A reference voltage adjusted to the voltage level satisfying the characteristic curve G (developing bias voltage is 0 V) shown in FIG. 22, which is set by the variable resistor 76, has been applied to the base of the transistor 218. The reference voltage is kept constant against the voltage variation of the power source 84. Accordingly, it operates to render the base voltage of the transistor 214 constant. That is, the voltage applied to the exposure lamp 3 is constant. In this way, the voltage applied to the exposure lamp 3 is controlled and rendered always constant. As a result, an optimum amount of the exposure is always obtained, irrespective of the variation of the power source voltage, merely by setting the variable resistor of the reference voltage generating circuit 185 to a desired resistance. The $\gamma$ characteristic at this time is indicated by a characteristic curve G shown in FIG. 22.

When the document select switch 77 is set to the photograph side (on state), the AND circuit is enabled (FIG. 7) and the developing power source circuit 63 is turned on. The developing bias voltage $V_{DEV}$ of about 800 V is then applied from the power source circuit 68 to the sleeve 64 of the developer unit 7. In this case, the copy is made by setting the amount of light from the exposure lamp 3 to that for the character. The $\gamma$ characteristic is as shown by the curve H in FIG. 22. The copy image is dark as a whole. Therefore, when the document select switch 77 is on the photograph side (on state), the above problem can be solved by moving the point I to the point J in FIG. 22. More specifically, the output voltage of the reference voltage generating circuit 185 is set to be slightly higher than when the switch 77 is set to the character side.

When the switch 77 is turned on, a series circuit including the resistor 226 and the variable resistor 227 is connected across the resistor 224. The output of the reference voltage generating circuit 185 is high. At this time, if the variable resistor 227 is adjusted, the point I in the $\gamma$ characteristic curve H at the time of application of the developing voltage is moved to the point J, as illustrated in FIG. 22, so as to obtain the $\gamma$ characteristic curve K. In the present embodiment, a cross point (J point) on the characteristic curves observed when the document select switch 77 is turned on (photograph side) and off (character side) corresponds to the case that the document density is about 0.50 and the copy density is about 0.75.

The limiter circuit operates in the following way. When the base voltage of the transistor 218 (the collector voltage of the transistor 221) exceeds the voltage set by the resistors 222 and 223 (the base voltage of the transistor 221), current flows into the transistor 221 and the base voltage of the transistor 218 falls. Therefore, the base voltage of the transistor does not exceed the set value. Thus, the transistor 221 forcibly clamps the base voltage. The base voltage of the transistor 218 does not exceed the voltage set by the resistors 222 and 223. Accordingly, the base voltage of the transistor 218 does not exceed a predetermined voltage. As a result, the maximum conduction angle of the thyristor 181 is limited and the applied voltage of the exposure lamp 3 is automatically limited to one below a given value (that is, less than the rated voltage). In short, the limiter circuit 186 limits the voltage applied to the exposure lamp 3 to one below the rated voltage by limiting the reference voltage from the reference voltage generating circuit 185 to the error amplifier 187. The limiter circuit 186 is used to limit the voltage to one below the rated value to ensure the life of the exposure lamp 3 when the lamp 3 used has a rated voltage which is below the commercial AC voltage.

As described above, the copying apparatus according to the present invention is provided with the $\gamma$ characteristic control means. Therefore, the following effects are attained. The type of document, such as character documents or photograph documents, is selected by the document select switch 77. The $\gamma$ characteristic is changed according to the select state of the switch 77.

For copying documents of the type in which a density rate of the background to the document pattern such as characters, numerals or photographs is low, or copying documents of the type in which a density distribution of the document pattern is wide and a graduation characteristic is required, the document select switch 77 is turned to the photograph side. Diazo copy documents and low density color documents containing blue, green and yellow in the pattern, and the like may be enumerated for the documents with small density ratio. The documents requiring a graduation contain, for example, photographs and multicolor documents. In the former, a reproducibility of the copy density to the low density document and a rate of change in the characteristic are low. The contents of the document pattern can exactly be reproduced, with blurs or a density difference in the copied image reduced remarkably. In the latter, the $\gamma$ characteristic is almost linear for all densities. Therefore, the graduation is remarkably improved and the information of the photograph can exactly be reproduced.

For ordinary documents with a large density ratio of the background to the document pattern containing mainly characters and numerals (called "line copy documents"), the select switch 77 is turned to the character side. When the switch 77 is on this side, a rate of change in the $\gamma$ characteristic is large. Therefore, a contrast ratio of the document background to the document pattern is high and a copy image reproduced is a little foggy.

Further, an amount of exposure light is selected optimally according to the type of the selected document, so that an adjusting operation of the amount of exposure is remarkably simplified.

Figure 23A:
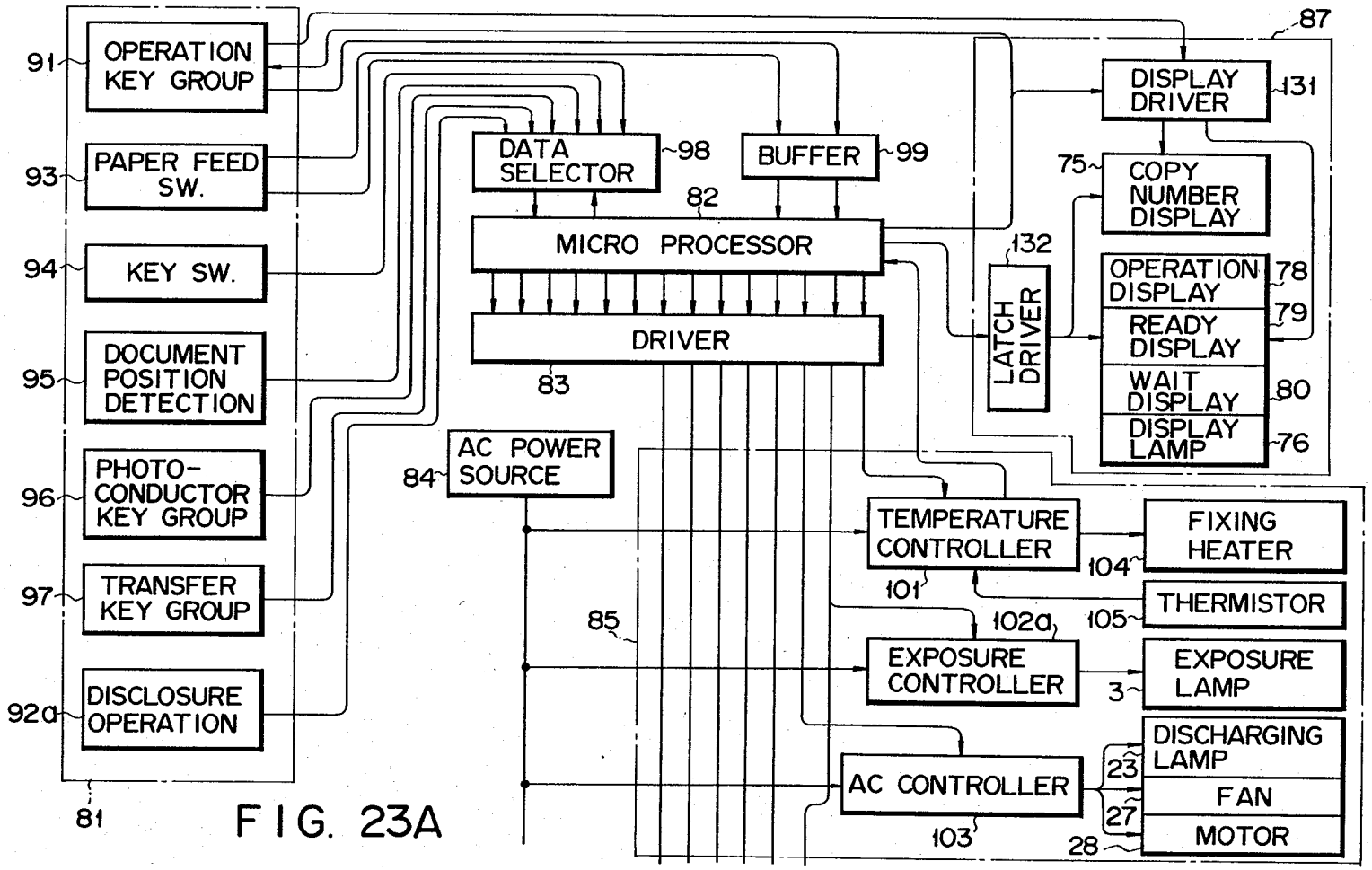
FIGS. 23A and 23B are block diagrams of an electrophotographic copying apparatus according to another embodiment of the invention.
Figure 23B:
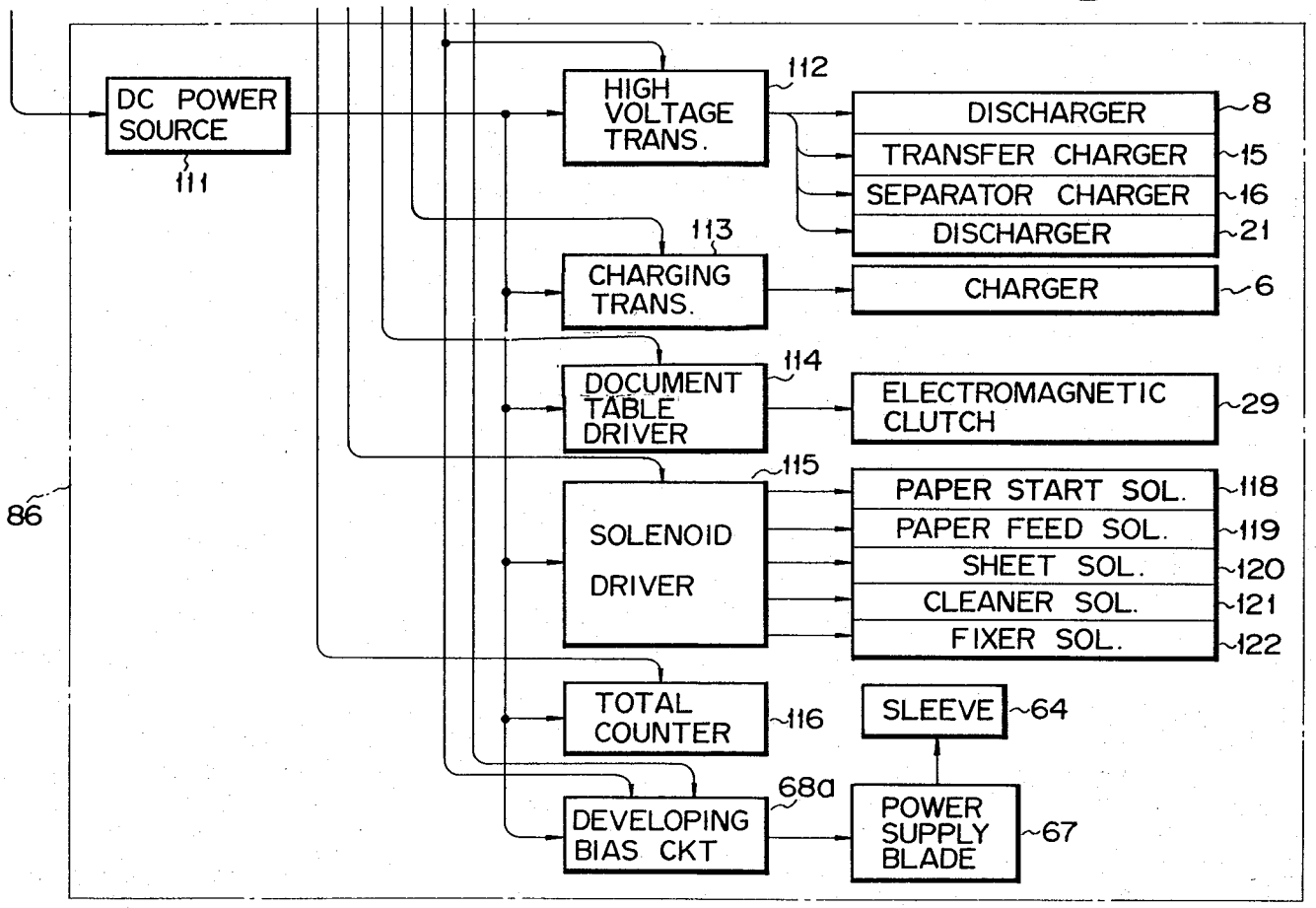
Figure 24A:
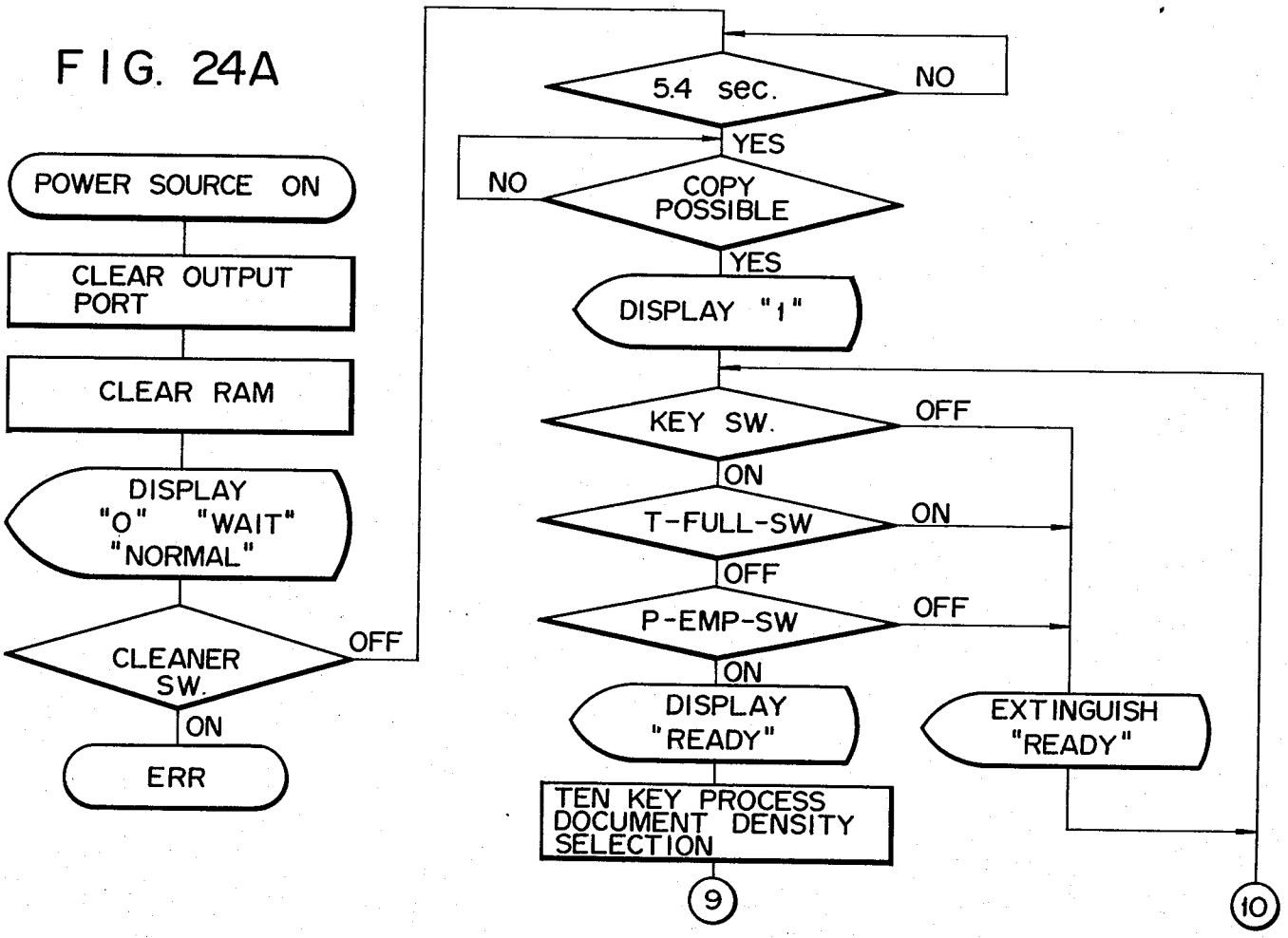
FIGS. 24A and 24B are flowcharts illustrating the operation of the electrophotographic copying apparatus of FIGS. 23A and 23B.
Figure 24B:
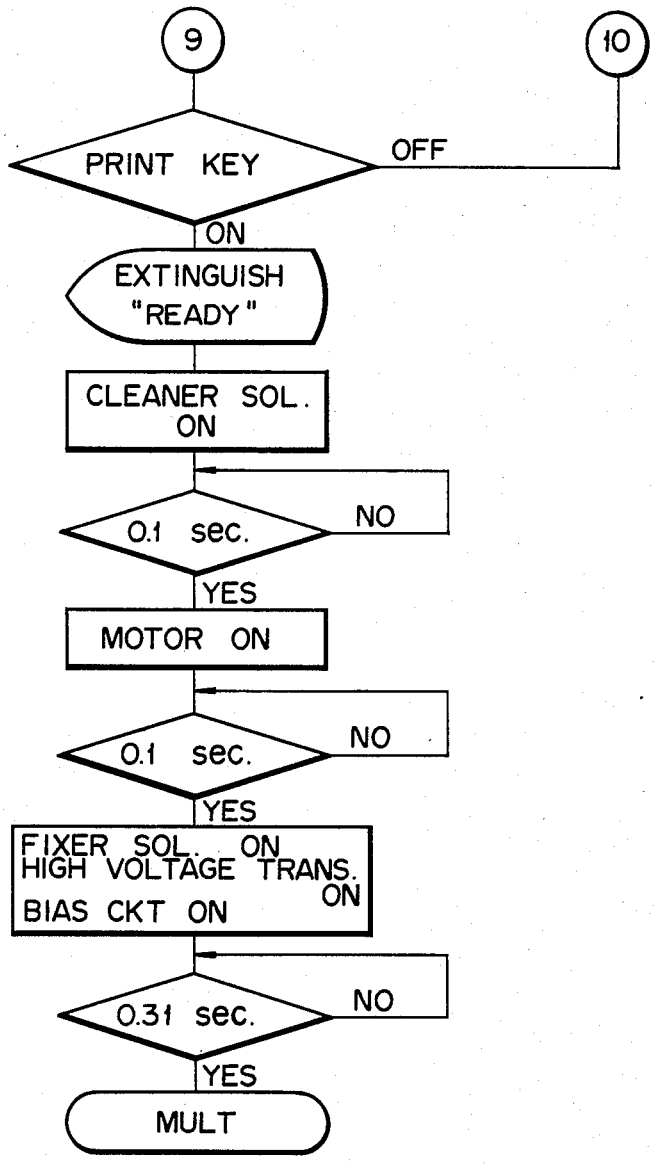
Figure 25:
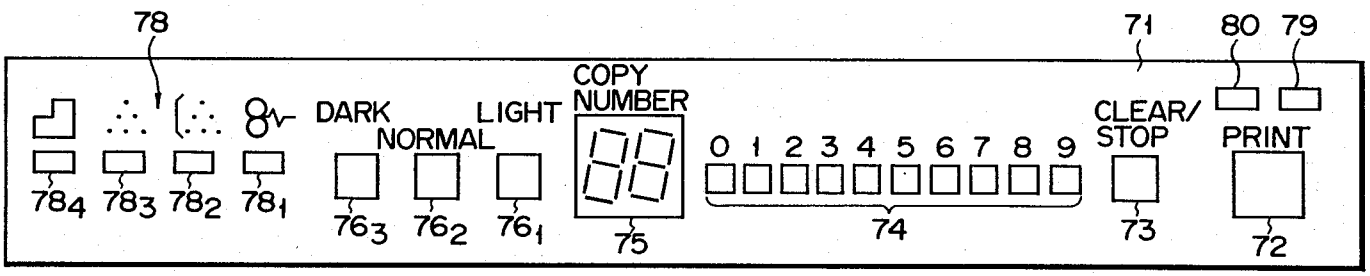
FIG. 25 is a plan view of an operation panel of the apparatus shown in FIG. 23A.

In the present embodiment, the $\gamma$ characteristic can be switched according to the type of the document. In an embodiment to be described later, an amount of the exposure light is selected according to the document density and the $\gamma$ characteristic is set according to the exposure amount selected. In the present embodiment, the control system has such a structure as shown in FIGS. 23A and 23B. As shown in FIGS. 23A and 23B, the developing bias circuit 68 is controlled by a microprocessor through a driver 83. The control system controls copy operation as illustrated in flowchart of FIGS. 23A and 23B. The flowchart is much the same as that of the first embodiment. When "COPY READY" is indicated and the number of copies is set by depressing the ten keys, the document density select switch, such as light key $\mathbf{76}_1$, normal key $\mathbf{76}_2$ and dark key $\mathbf{76}_3$ is operated, thus selecting a density corresponding to the density of the document. The density selection corresponds to an exposure amount selection. When the print key is depressed, the copying operation is started according to the process similar to that in the first embodiment. In the copying operation, upon lapse of 0.1 second after the motor 28 has been driven, the fusing solenoid 122, the high voltage transformer 12, and the developing bias circuit 68 are energized. The bias circuit 68 is comprised of a voltage control IC 141, a Zener diode 142 for forming the reference voltage generating circuit, a constant current circuit 143, an impedance conversion amplifier 144, an error amplifier (differential amplifier) 145, and an output control transistor 146. The power source terminal 147 is supplied with +Vcc from a power source circuit 111 (FIG. 23B). A ground terminal 148 is connected to a ground line of the power source circuit 111. The exposure control relay 153 is energized by a dark signal which is low only when the dark key $\mathbf{76}_3$ is pushed. The exposure control relay 154 is energized by a light signal which is low only when the write key $\mathbf{76}_1$ is pushed. When the normal key $\mathbf{76}_2$ is pushed, the dark signal and the write signal are both high, and both relays 153 and 154 are both quenched. The dark signal and light signal are supplied from the driver 83 (FIG. 23A).

Voltage dividing resistors 176 to 179 are connected in series between the reference voltage generating terminal T6 of the voltage control IC 141 and the ground terminal 148. A connection point P1 between the resistors 176 and 177 is connected to an NO (normal open) contact of the first contact $\mathbf{154}_1$ of the relay 154. A connection point P2 between the resistors 177 and 178 is connected to an NC (normal close) contact of the first contact $\mathbf{154}_1$. A connection point P3 of the resistors 178 and 179 is connected to the NO contact of the first contact $\mathbf{153}_1$ of the relay 153. The CO (common) contact of the first contact $\mathbf{154}_1$ is connected to an NC contact of the first contact $\mathbf{153}_1$. The CO contact of the first contact $\mathbf{153}_1$ is connected to the noninverting input terminal T5 of the voltage control IC 141. The remaining circuit arrangement is the same as that of FIG. 16.

Figure 26:
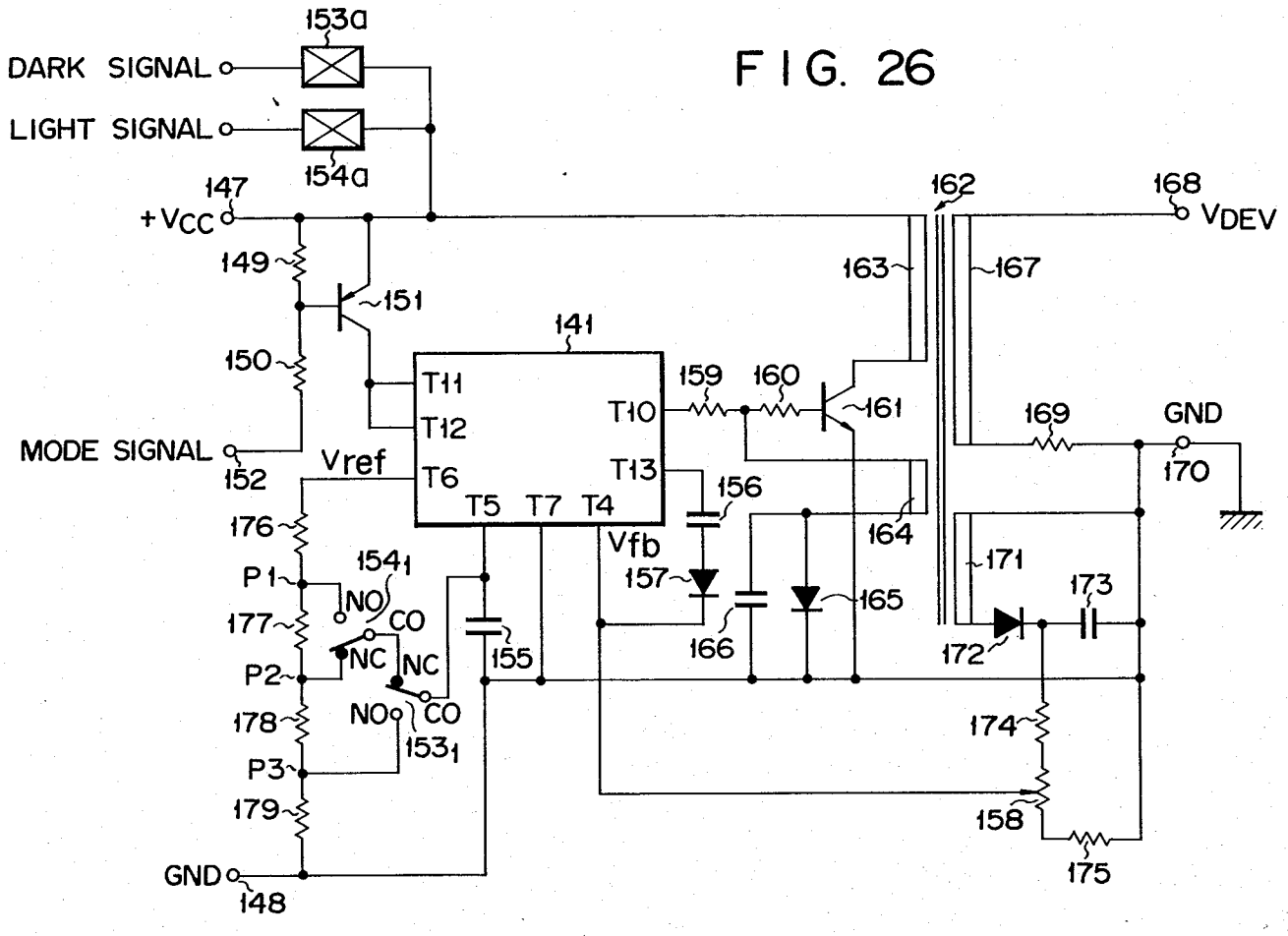
FIG. 26 is a circuit diagram of the developer unit of FIG. 23B.

The operation of the developing bias circuit shown in FIG. 26 will be described.

When the remote signal terminal 152 is low in level, the transistor 151 is on and the power source voltage +Vcc is applied to the terminals T11 and T12 of the IC 141. Then, the IC 141 starts to operate. Reference voltage Vref appears at the terminal T6 of the IC 141. The voltage Vref is divided by the resistors 176 and 179 and then applied to the noninverting input terminal T5. At this time, the voltage at the noninverting terminal T5 gradually rises at a time constant through the capacitor 155 until it reaches a voltage at the selected voltage dividing point. Immediately after the remote signal terminal 152 becomes low in level, the feedback voltage Vfb is 0 V. Accordingly, the output terminal T10 is high in level since the voltage at the inverting input terminal T4 is lower than that at the noninverting input terminal T5. The transistor 161 then allows the base current to flow. A given voltage is thus generated across the output winding 167. The transistor 161 is repeatedly turned on and off by the feedback voltage at given periods generated by the oscillation winding 164 and the capacitor 166. An AC developing bias voltage $V_{DEV}$ appears across the output winding 167. The bias voltage is always constant, because it is controlled by the error amplifier 145 and the output control transistor 146 (FIG. 17) so that the feedback voltage Vfb from the winding 171 is equal to the voltage at the noninverting input terminal T5 (i.e. operation reference voltage). Accordingly, the developing bias voltage $V_{DEV}$ may be varied by changing the voltage at the input terminal T5.

The operation reference voltage applied to the noninverting input terminal T5 is selected by relays 153*a* and 154*a*. The operating condition of the relays 153*a* and 154*a* are determined by the light key $\mathbf{76}_1$ for the document density selection, the normal key $\mathbf{76}_2$, and the dark key $\mathbf{76}_3$. When the document density is high and the dark key $76_3$ is pushed, only the dark signal is low and the relay 153 is turned on. The voltage at the voltage dividing point P3 is applied as the operation reference voltage to the noninverting input terminal T5. When the document density is normal and the normal key $76_2$ is depressed, the dark signal and the light signal is low and the relays 153 and 154 are both de-energized. The voltage at the voltage dividing point P2 is applied to the terminal T5. When the document density is low and the light key $76_1$ is pushed, only the light signal is low and the relay 154 is energized. The voltage at the voltage dividing point P1 is applied to the terminal T5. Therefore, when the light key $76_1$ is depressed, the developing bias voltage $V_{DEV}$ applied to the sleeve 64 of the developer unit 7 is 800 V. When the normal key $76_2$ is pushed, it is 500 V. When the dark key $76_3$ is depressed, it is 100 V.

The effect of the developing bias voltage $V_{DEV}$ applied from the developing bias power source circuit 68, a relationship between the document density and the copy density, will be described with reference to FIGS. 18 and 19.

Figure 27:
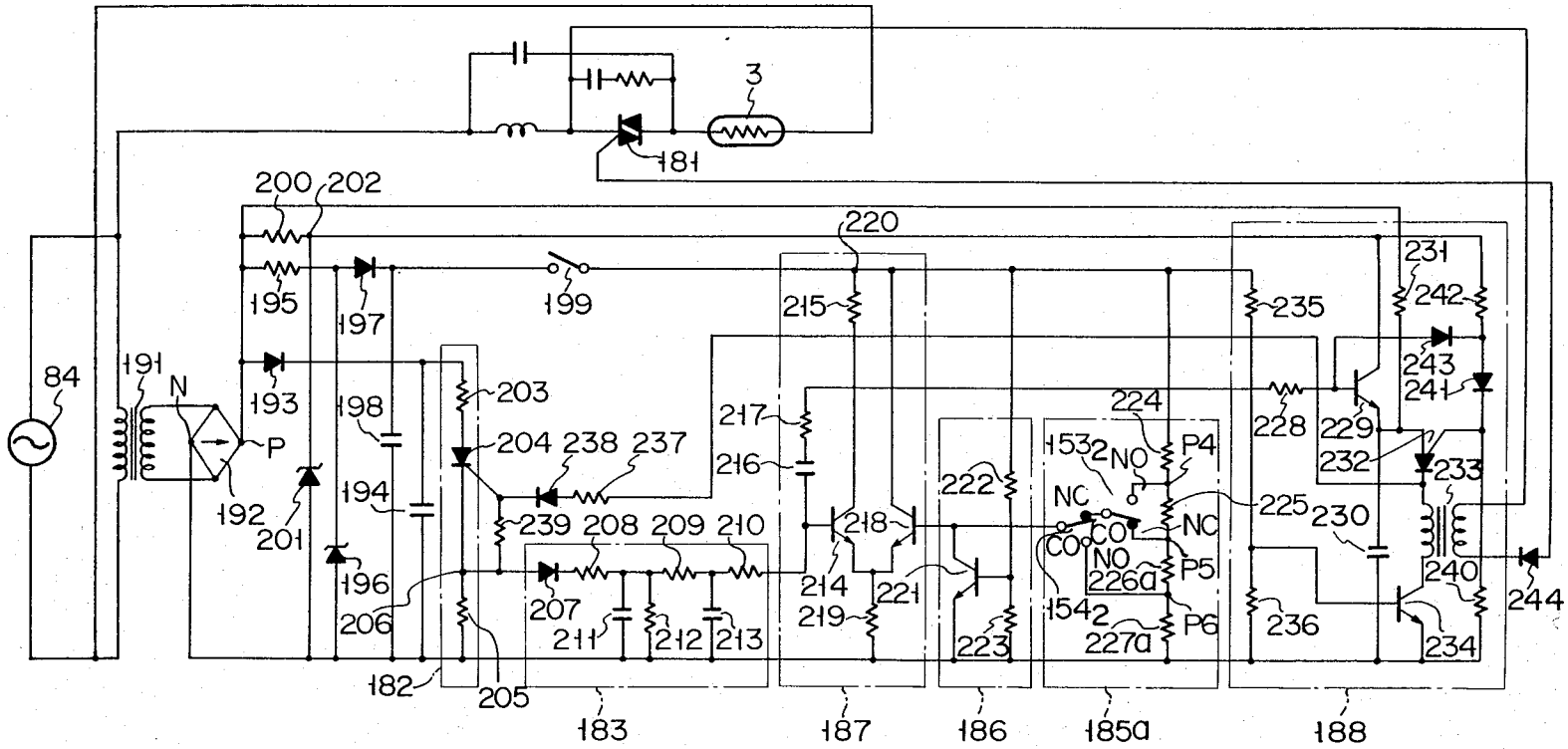
FIG. 27 is a circuit diagram of the exposure control circuit of FIG. 23A.

The $\gamma$ characteristic changing control circuit, i.e. the exposure control circuit 102, will be described. The exposure control circuit 102 is basically the same as the circuit shown in FIG. 21. A reference voltage generating circuit 185*a* is different from the circuit 185 shown in FIG. 21. In the circuit 185*a* shown in FIG. 27, voltage dividing resistors 224 to 227 are connected in series between the connecton point 220 and the output terminal N. A connection point between the resistors 224 and 225 is connected to the NO point of the second contact $153_2$ of the relay 154*a*. The CO contact of the second contact $154_2$ is connected to the base of the transistor 218. The resistors 224, 225, 226*a* and 227*a* and the second contacts $153_2$ and $154_2$ make up the reference voltage generating circuit 185*1*. In the exposure control circuit 102 in FIG. 27, it is assumed that the exposure lamp light signal is produced and the relay contact 199 is closed. A voltage obtained by dividing the voltage at the connection point 220 is applied to the base of the transistor 234. Then, the transistor 234 is turned on. A voltage at the connection point 220 is applied to the base of the transistor 229 through the resistors 215 and 228. This transistor 229 is then turned on, too. The capacitor 230 is charged through the transistor 229. As the capacitor 230 is charged, the anode voltage of the PUT 232 exceeds the gate voltage. The PUT 232 is turned on and pulse current flows through the primary coil of the pulse transformer 233. Accordingly, the pulse is generated in the secondary coil of the pulse transformer 233 and this pulse is applied as a trigger pulse to the thyristor 181. As a result, the thyristor 181 is turned on and the exposure lamp 3 is lit.

At this time, the trigger pulse is applied to the gate of the thyristor 204 through the resistor 237 and the diode 238. The thyristor 204 is turned on in response to the pulse, thus generating a voltage across the resistor 205 which corresponds to the voltage of the exposure lamp 3. The voltage thus generated is wave-shaped by the wave shaping circuit composed of the diode 207, the resistors 208 to 210, and 212, and the capacitors 211 and 213. The voltage wave-shaped is a DC voltage corresponding to the effective voltage of the exposure lamp 3. This voltage is applied to the base of the transistor 214. If the base voltage of the transistor 214 is lower than that of the transistor 218, the collector voltage of the transistor 214 is high and the base voltage of the transistor 229 is also high. The charging speed of the capacitor 230 is thus high. As a result, the PUT 232 generates timing pulses at fast timing. The conduction angle of the thyristor 181 increases. Further, the exposure lamp 3 emits more light in proportion to the voltage supplied to it. A signal representing the increase of the conduction angle of the thyristor 181 is fed back to the thyristor 204. The base voltage of the transistor 214 rises. The moment the base voltage of the transistor 214 reaches that of the transistor 218, the base voltages of the transistors 214 and 218 are well balanced. Any one of the voltages at the voltage dividing points P4, P5 and P6 selected by the relays 153*a* and 154*a* is applied as a reference voltage to the base of the transistor 218. The reference voltage is kept constant despite a voltage variation of the power source 84. Accordingly, the exposure control circuit 102 operates to make the voltage applied to the exposure lamp 3 constant and thus render the base voltage of the transistor 214 constant, too. In this way, the applied voltage to the exposure lamp 3 is always constant. Irrespective of the variation of the power source voltage, an optimum exposure amount set by the reference voltage generating circuit 185*a* is reliably obtained.

The reference voltage selected by the relays 153*a* and 154*a* is the voltage appearing at the voltage dividing point P4 when the dark key $76_3$ is depressed since the relay 153*a* is energized. When the normal key $76_2$ is pushed, the relays 153*a* and 154*a* are both de-energized, and the voltage at the voltage dividing point P5 is used for the reference voltage. When the light key $76_1$ is pushed, the relay 154 is energized, the voltage at the voltage P6 is selected. The voltages at the voltage dividing points P4, P5 and P6 are related as $|P4>P5>P6|$. Therefore, the lamp 3 may emit: The light amount when the dark key $76_3$ is greater than the light amount when the normal key $76_2$ is pushed; the light amount when the normal key $76_2$ is greater than the light amount when the light key $76_1$ is depressed.

Figure 28:
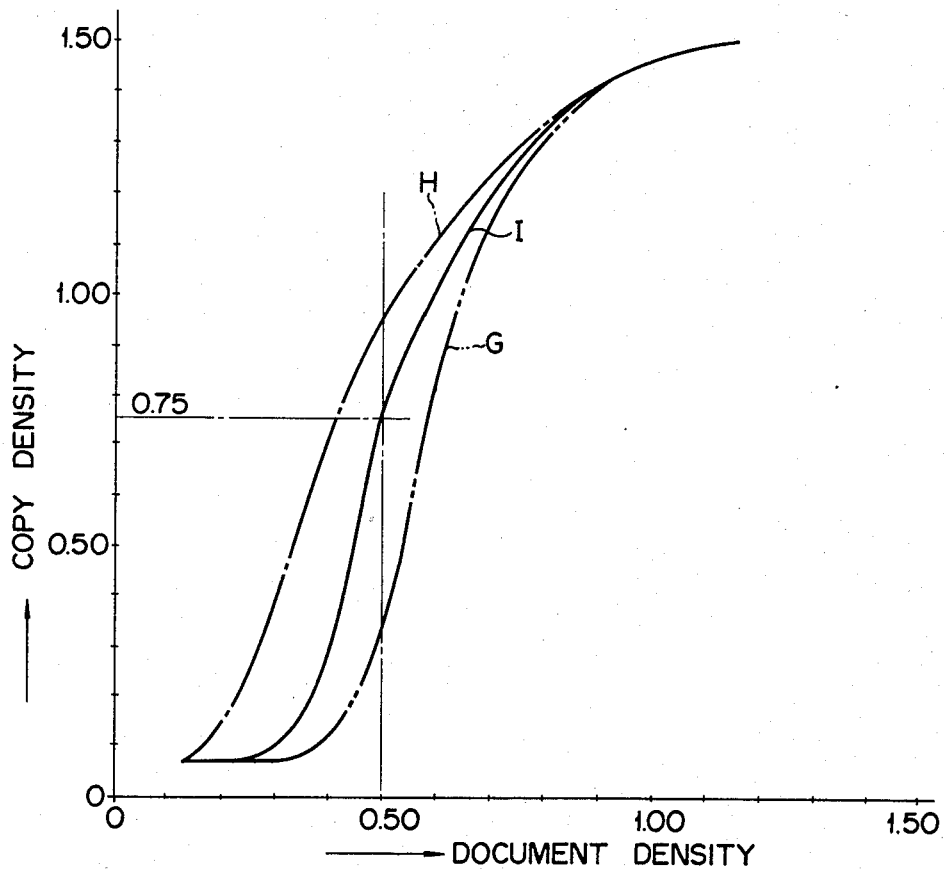
FIG. 28 is a graphical representation of $\gamma$ characteristic when the exposure amount is switched.

The $\gamma$ characteristic due to the interaction between the developing bias voltage $V_{DEV}$ and the amount of the exposure is illustrated as shown in FIG. 28. In FIG. 28, a curve G indicates a characteristic curve observed when the dark key $76_3$ is pushed, or $V_{DEV}=100$ V, applying the greatest amount of light to the document with the highest rate of change in characteristic. A curve H shows the characteristic observed when the write key $76_1$ is depressed, or when $V_{DEV}=800$ V. In this case, the amount of light applied to the document is smallest and the rate of change in characteristic is lowest. A curve I indicates the characteristic observed when the normal key $76_2$ is pushed, or $V_{DEV}=500$ V. In this case, the amount of light to the document is smallest and the rate of change in characteristic is between the rate for the light key $76_1$ and the rate for the dark key $76_3$.

The limiter circuit 186 operates like its counterpart of the first embodiment. It limits the voltage applied to the exposure lamp 3.

According to the copying apparatus of the second embodiment, the provision of the $\gamma$ characteristic control means has the following effects.

(1) The density (small amount of the exposure light) is set to a low value by the document selection key. An inclination of the $\gamma$ characteristic curve is made gentle (the change rate in the characteristic is made low). Under this condition, when copying a document with a low density ratio of the background to the pattern, the reproducibility of the copy is remarkably improved. The copy image has little blur and improved uniformity of density, and good contrast.

(2) The density is set to a standard value (medium amount of exposure light) and the inclination of the $\gamma$ characteristic curve is set to a medium point (the change rate in characteristic is set to a medium point). Under this condition, the problem of fog and contrast of the copy image is solved when an ordinary document is copied which has a relatively low background density and which contains mainly characters and numerals. The application of the bias voltage improves the graduation. Because of this feature, the copying apparatus may cope with copying documents with a wide variety of densities such as photographs.

(3) A density is set to a high value (the large amount of exposure light) by the select switch. The inclination of the $\gamma$ characteristic curve is made sharp (large change rate in characteristic). Under this condition, the document with high background density can be copied to have a copy image with high contrast and little fog.

In the second embodiment, the exposure amount is manually set. This may automatically be set. An embodiment of the invention to be described later is designed to allow the selection of an automatic exposure mode or a manual exposure mode.

Figure 29A:
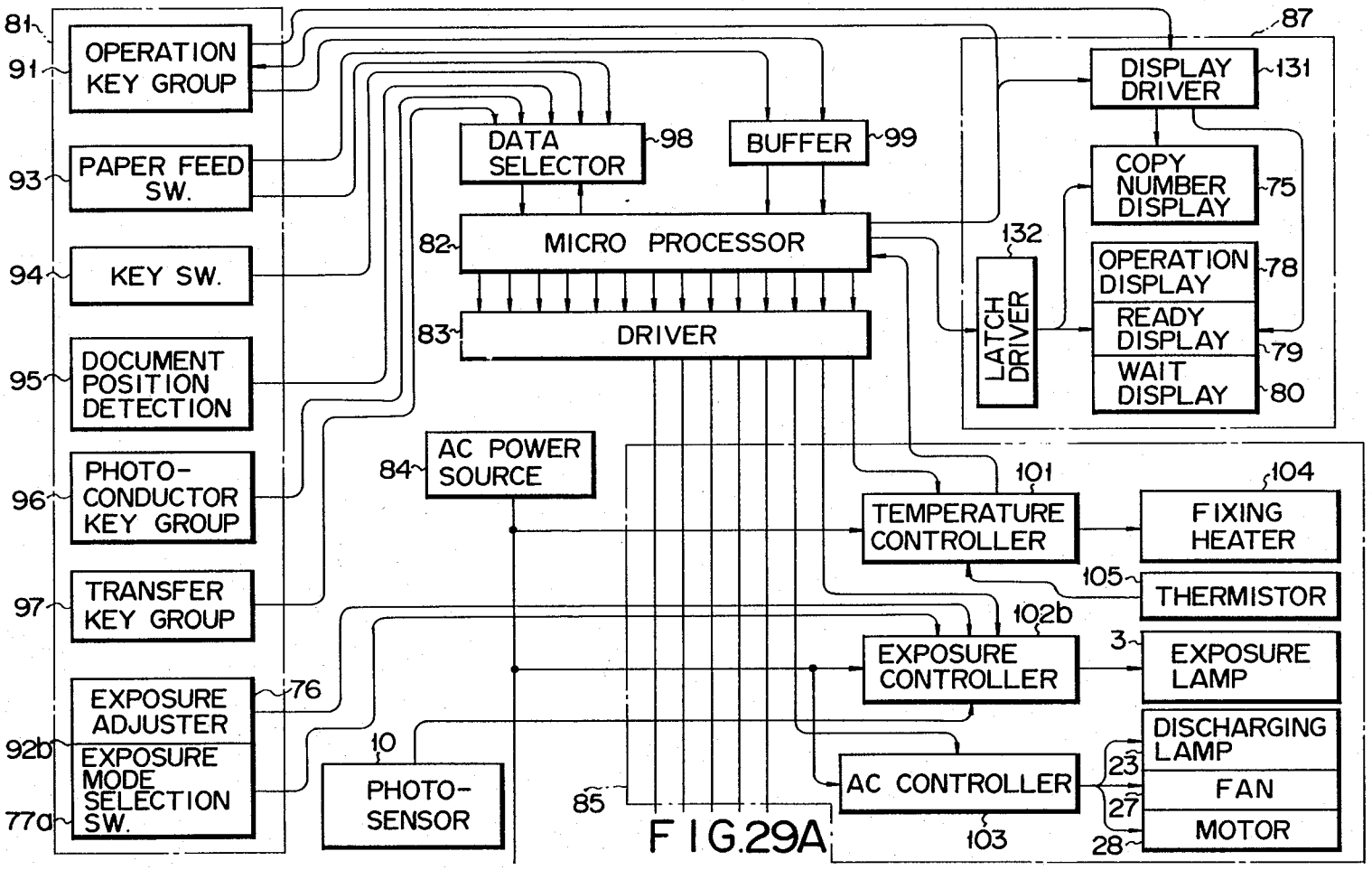
FIGS. 29A and 29B are block diagrams of an electrophotographic copying apparatus according to yet another embodiment of the invention.
Figure 29B:
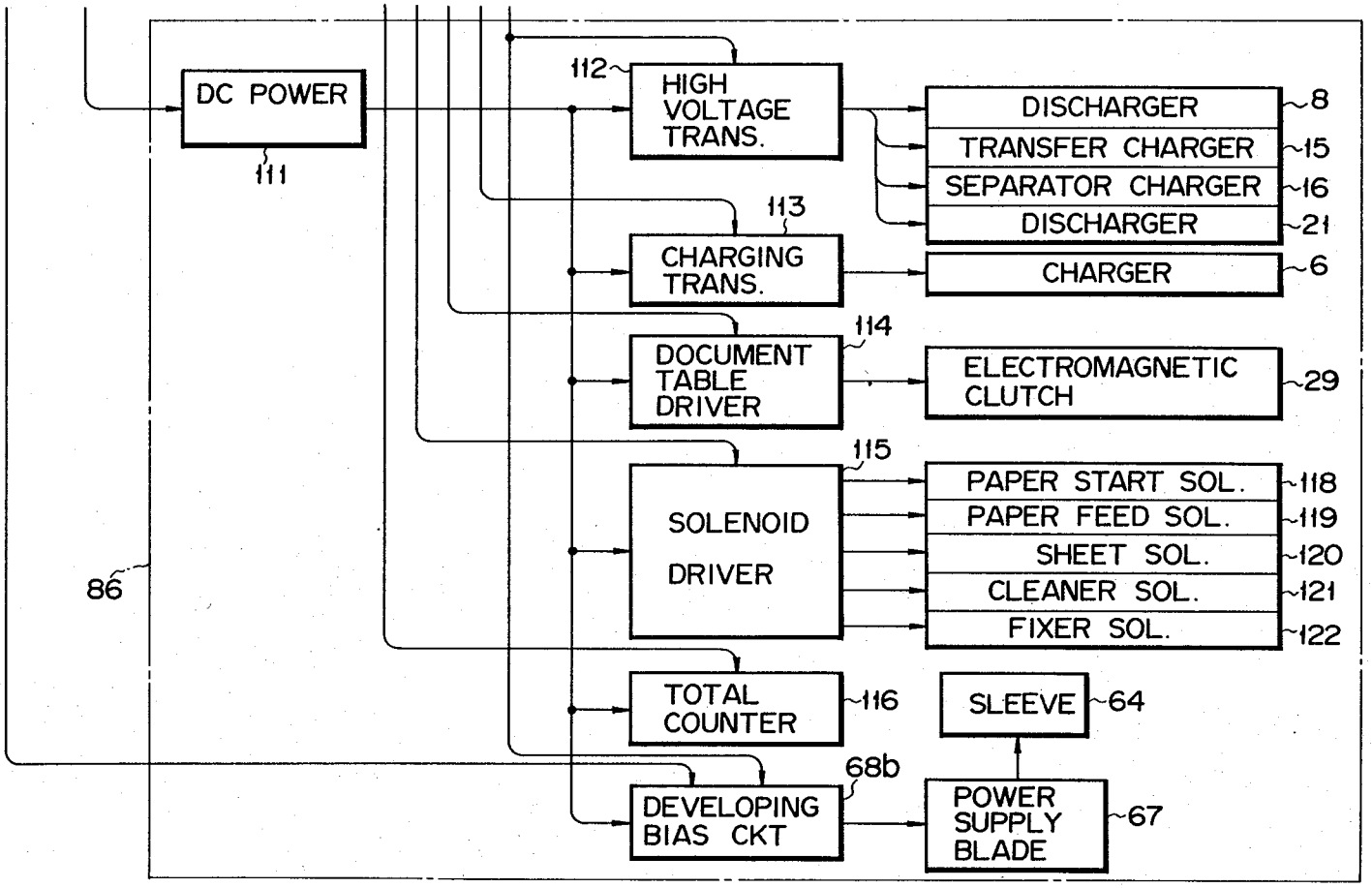
Figure 30:
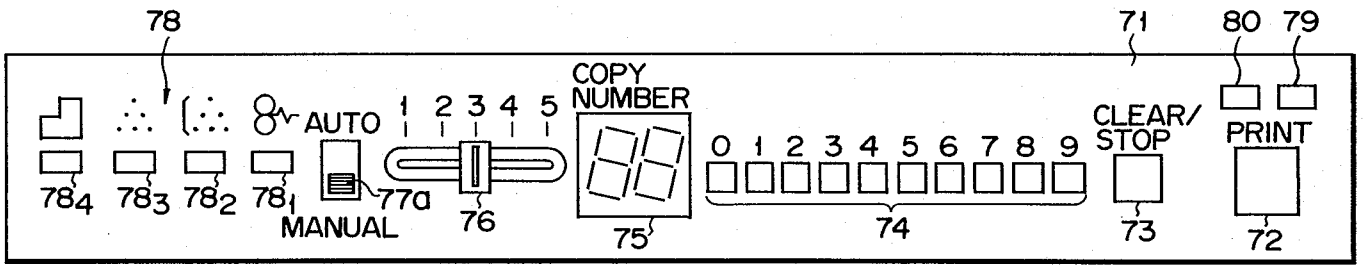
FIG. 30 is a plan view of an operation panel of the apparatus shown in FIG. 29A.

A control system for this embodiment is designed as shown in FIG. 29, and an operation panel is arranged as shown in FIG. 30. As shown in FIG. 29, an exposure mode select switch 77*a* is connected to an exposure control circuit 102 and a developing bias circuit 68.

Figure 8A:
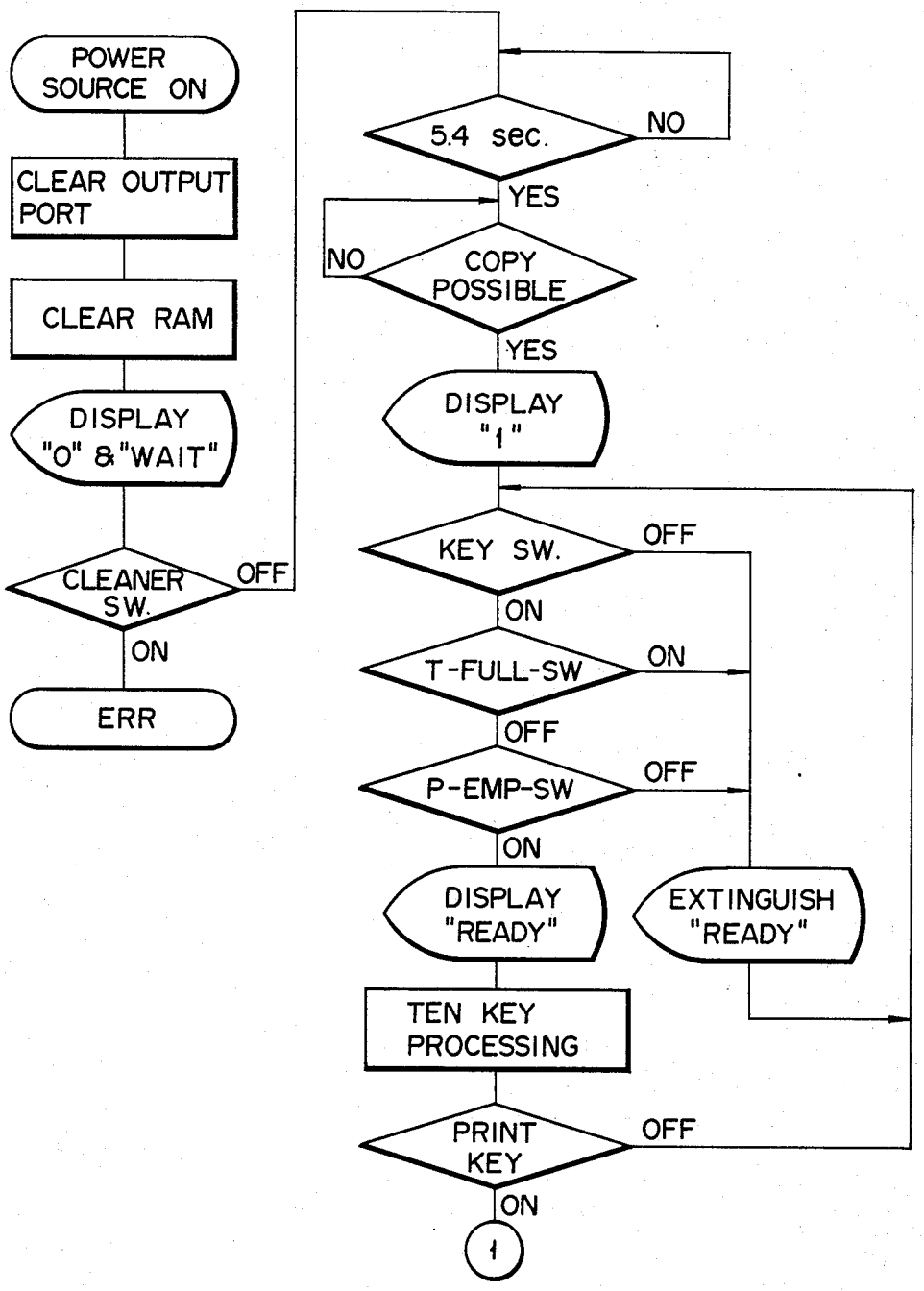
FIGS. 8A and 8B are flowcharts illustrating the operation of the block diagram of FIGS. 7A and 7B.
Figure 8B:
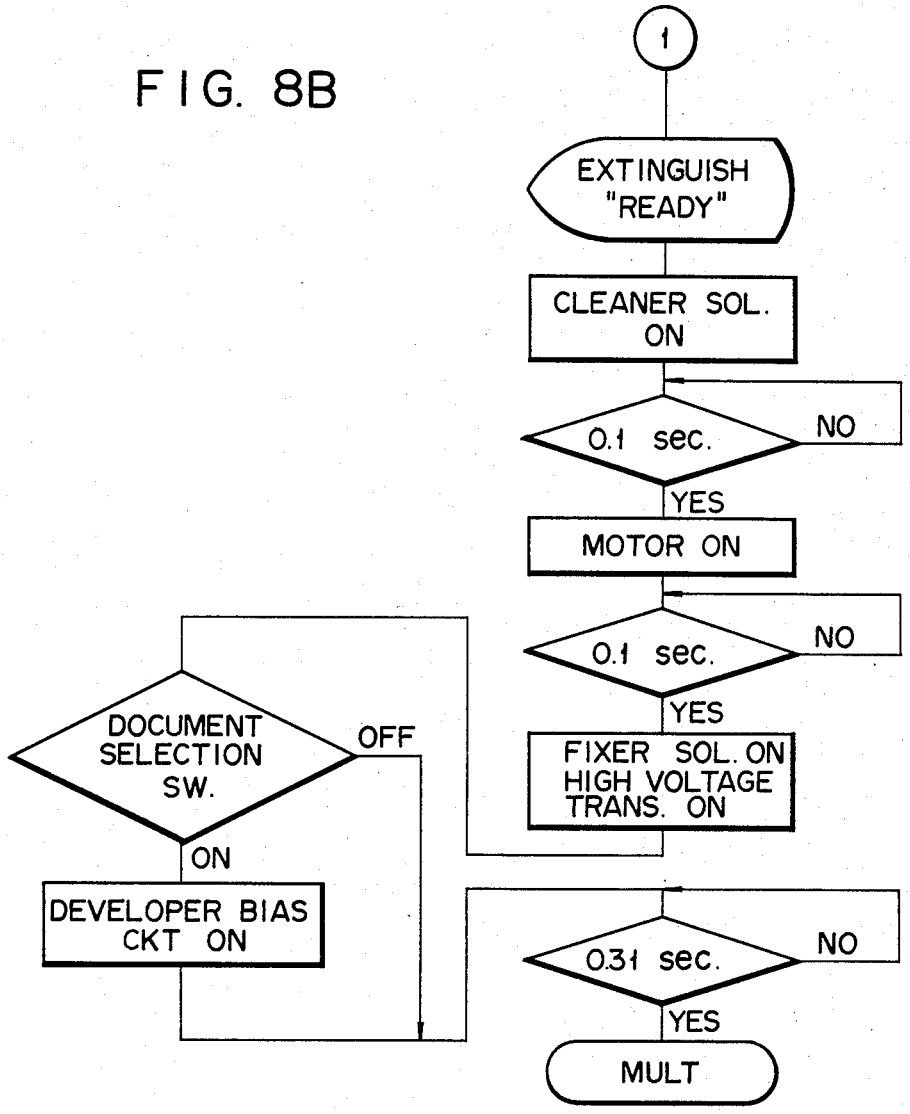
Figure 9A:
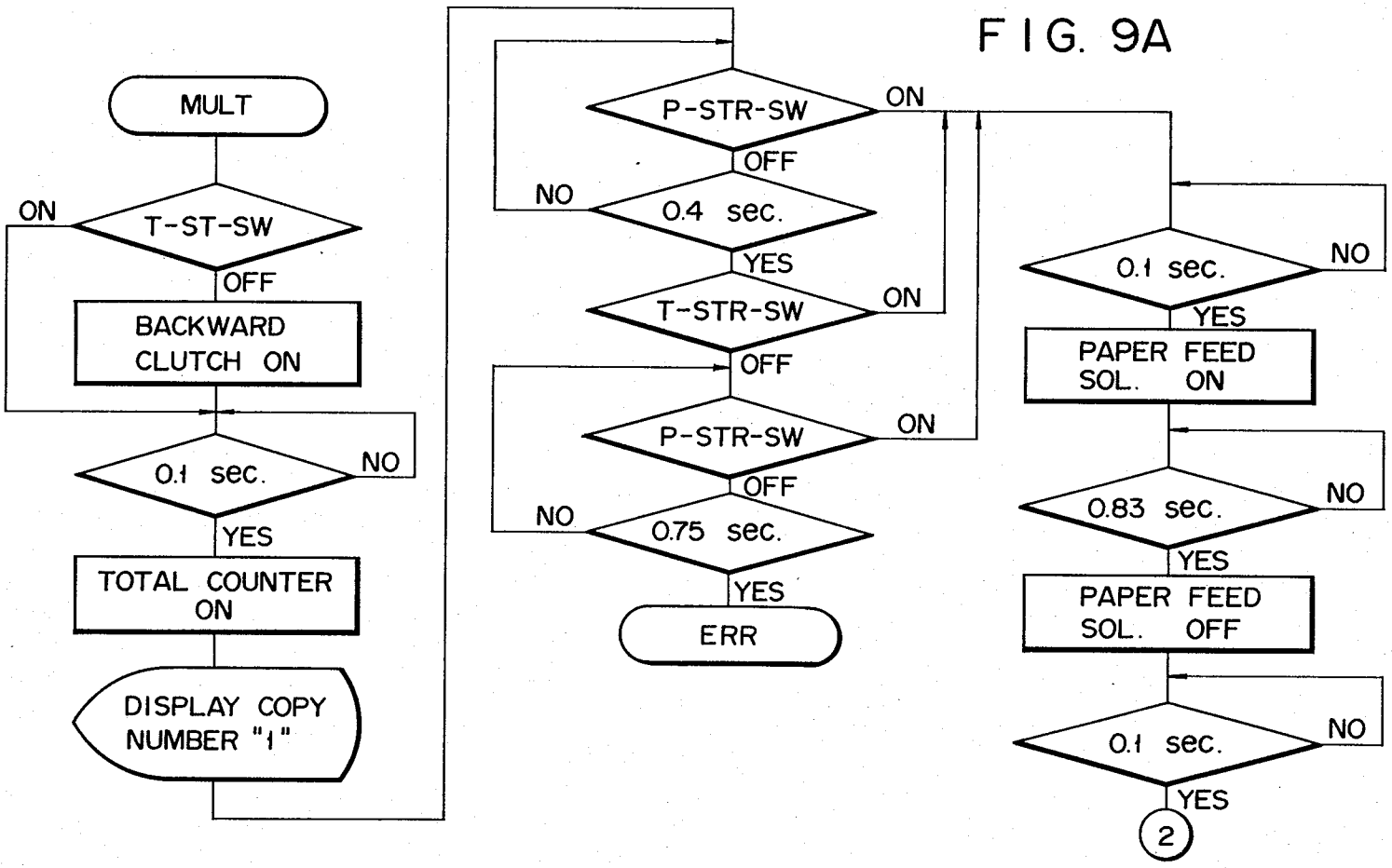
FIGS. 9A to 11B are flowcharts illustrating a multi-copying operation.
Figure 9B:
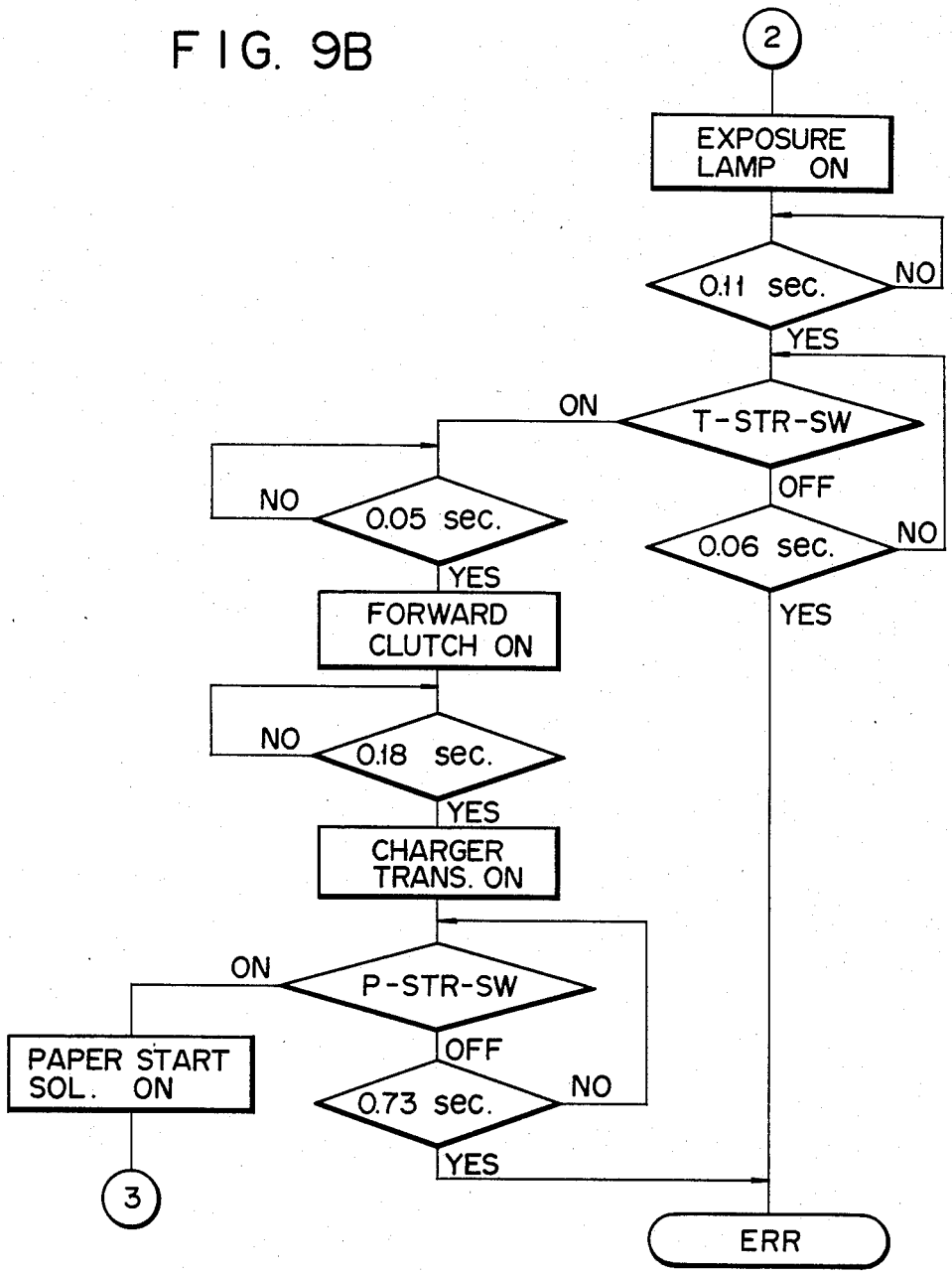
Figure 10A:
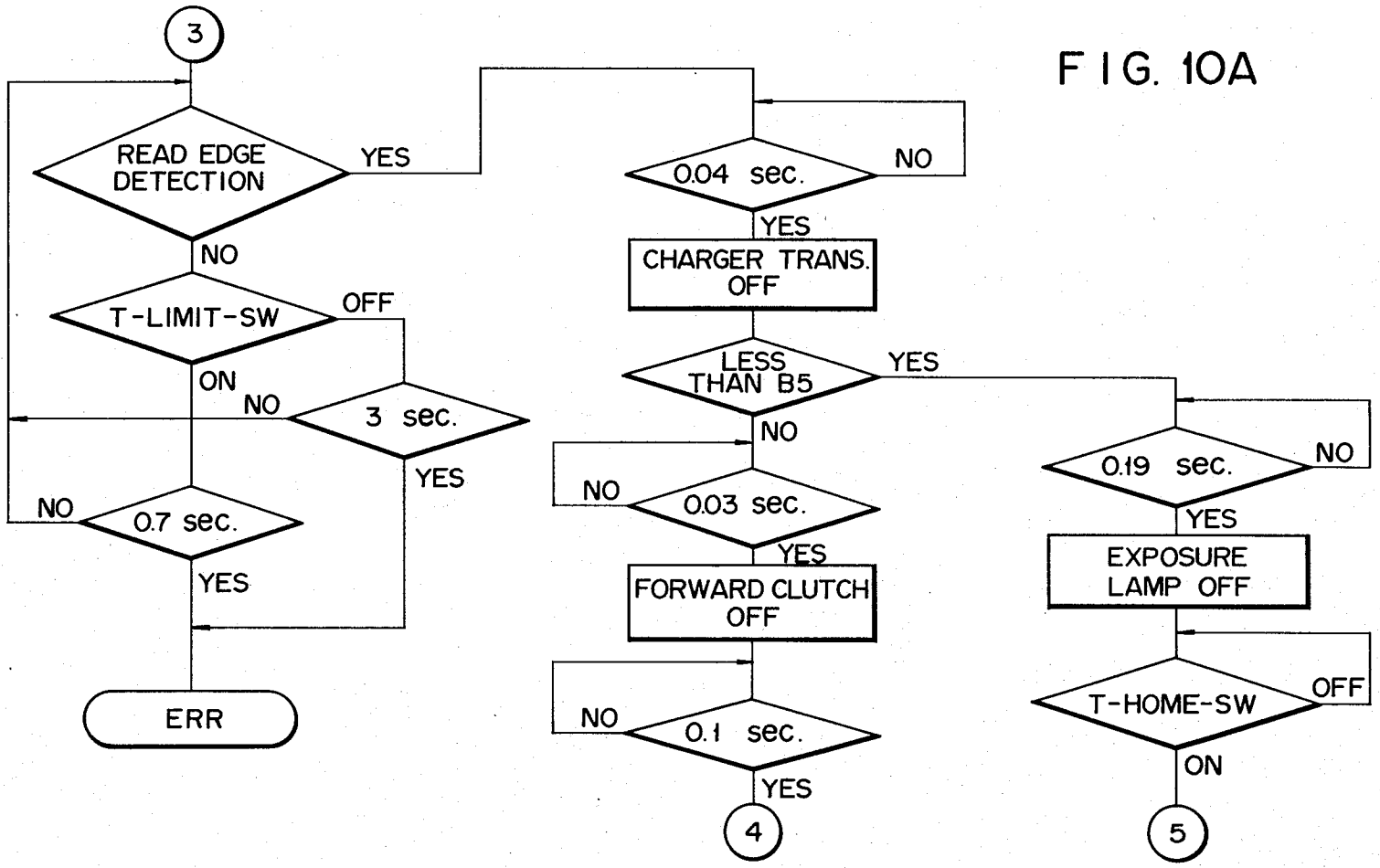
Figure 10B:
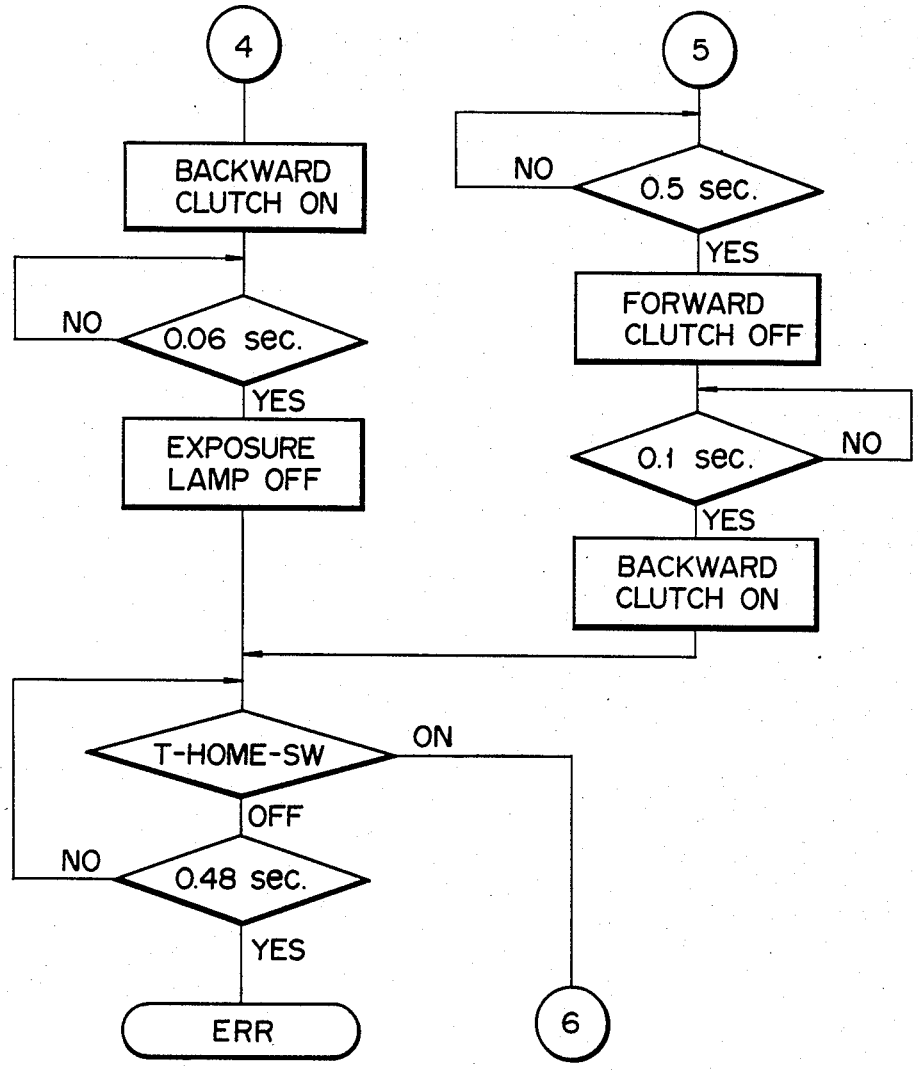
Figure 11A:
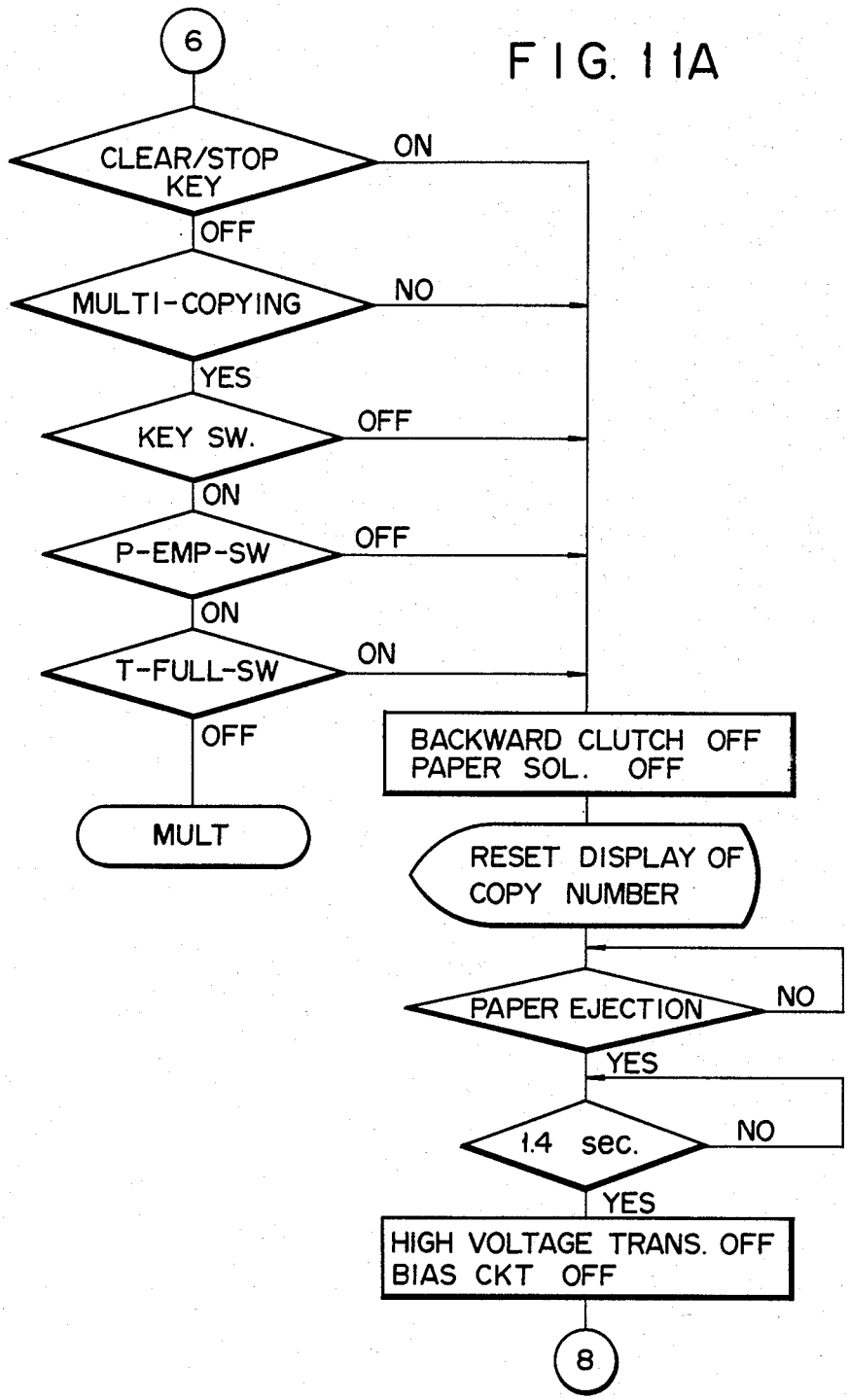
Figure 11B:
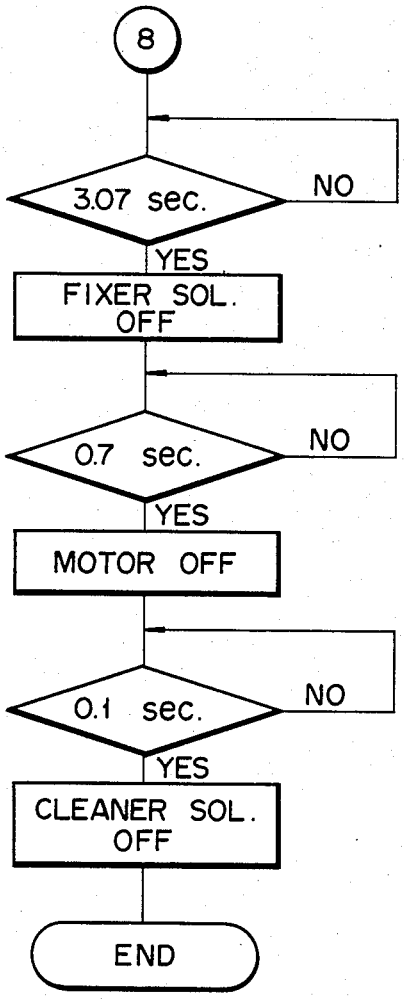
Figure 31:
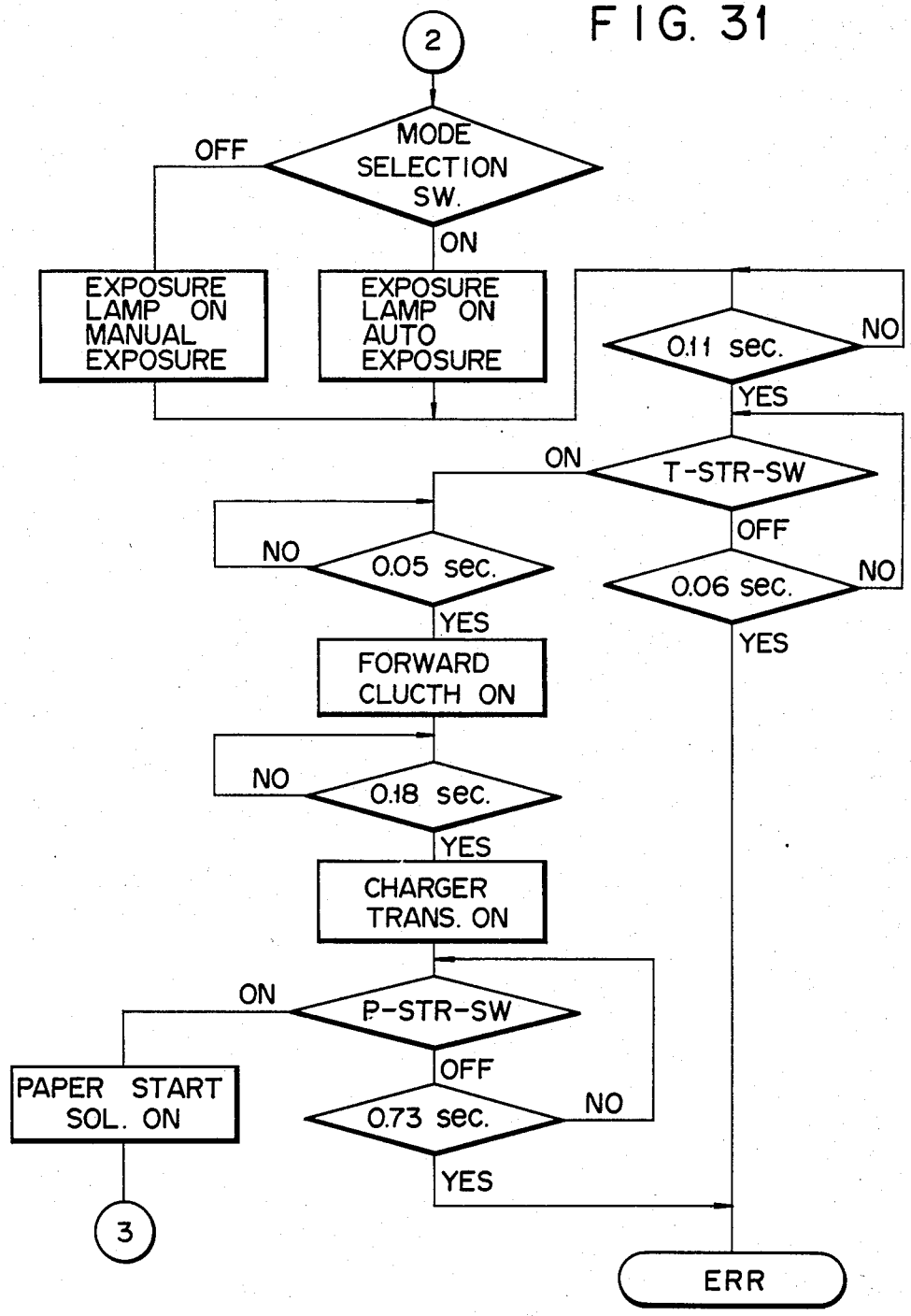
FIG. 31 shows a part of flowchart illustrating the operation of the electrophotographic copying apparatus shown in FIGS. 29A and 29B.
Figure 32:
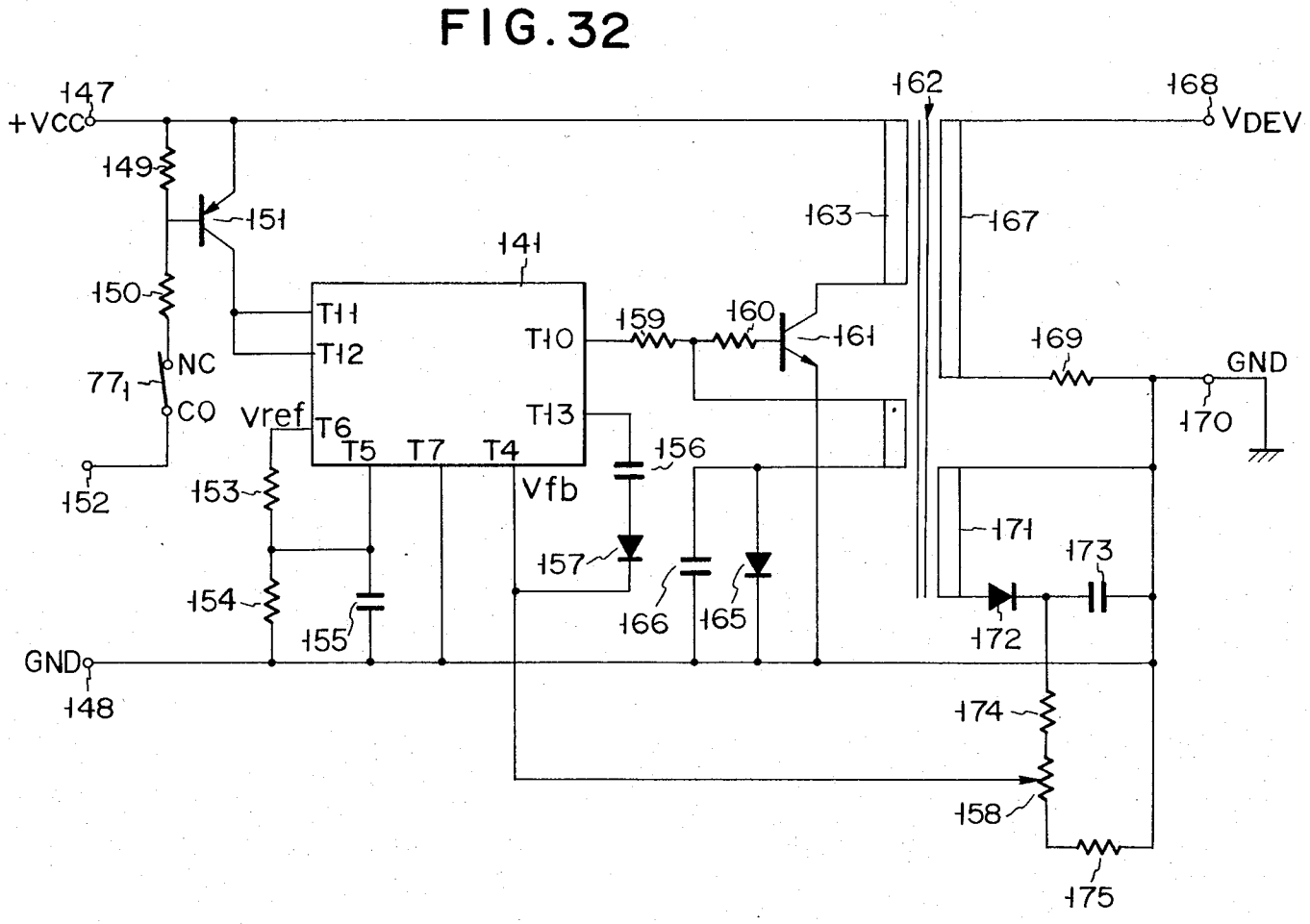
FIG. 32 is a circuit diagram of the developer unit shown in FIG. 29B.

In the control system shown in FIG. 29, a copy start flow is substantially the same as shown in FIG. 8. After the fusing solenoid and the high voltage transformer are turned on, the state of the document select switch 77 is checked in the flow of FIG. 8. In the present embodiment, however, the state of the exposure mode select switch 77*a* is checked. If the exposure mode select switch 77*a* is turned on (manual exposure mode), the developing bias power source circuit 68 is turned on and an AC bias voltage is applied to the sleeve 64 of the developer unit 7. If the exposure mode select switch 77*a* is turned on (automatic exposure mode), the sleeve 64 of the developer unit remains connected to the ground potential (0 V), as will be described later. After a given time (0.31 sec.), the CPU steps to the multiple continuous copy mode (MULT). In the FIG. 31 flowchart, the same operation as that in the FIG. 9 flowchart is performed till 0.1 second elapses after the paper feed solenoid has been de-energized. After 0.1 second, the mode select switch 77*a* is checked. When the mode select switch 77*a* is turned off, the exposure is performed with the exposure amount set by the variable resistor 76. When it is turned on, the exposure (automatic exposure) is performed with an optimum amount of exposure at a density of the document detected by the photosensor 10. The same operation as that in the FIGS. 9A and 9B will then follow. The developing bias circuit 68*b* is basically the same as that of FIG. 16. In the developing bias circuit 68*b* of FIG. 32, a first contact $77_1$ of the exposure mode select 77*a* is connected between the resistor 150 and the terminal 152. The first contact $77_1$ is closed when the manual exposure mode is selected. At this time, the same operation as that of the bias circuit 68 of FIG. 16 is performed in the bias circuit 68*b* of FIG. 32. An exposure control circuit 102*a* shown in FIG. 29A will be described with reference to FIG. 33.

Figure 33:
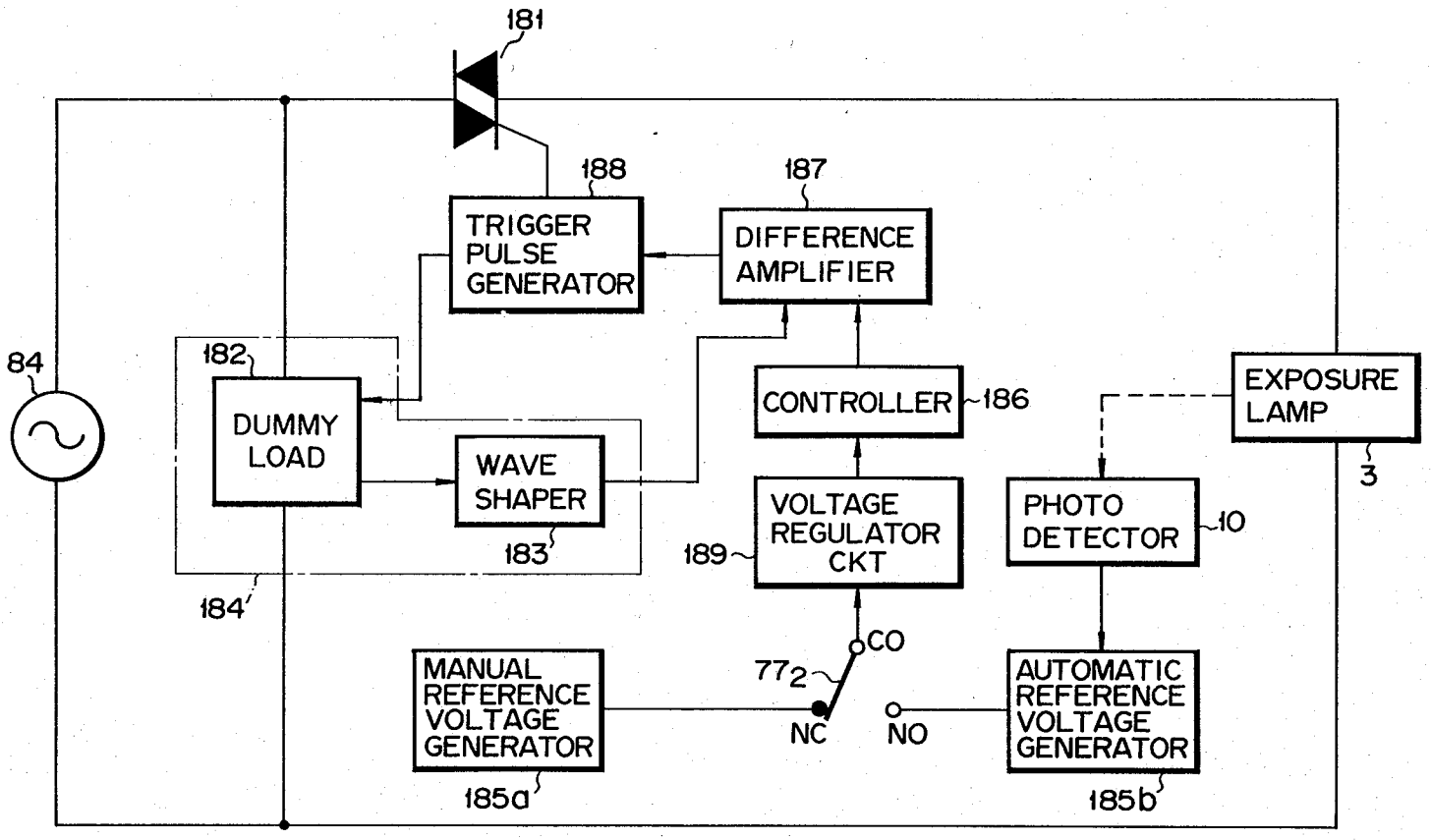
FIG. 33 is a block diagram of an exposure control circuit shown in FIG. 29A.

As shown in FIG. 33, the exposure lamp 3 is connected to an AC power source 84 through the bi-directional thyristor 181. The dummy load circuit 182 is connected to the power source 84. The dummy load circuit 182 receives a voltage corresponding to the terminal voltage of the exposure lamp 3 when the thyristor 181 is turned on. The dummy load circuit thus produces a voltage. The output voltage of the circuit 181 is supplied to the wave shaping circuit 183. The wave shaping circuit 183 wave-shapes the output voltage from the dummy load circuit 182, thus generating voltage corresponding to the effective voltage of the exposure lamp 3. The manual reference voltage generating circuit 185 may produce a DC voltage through a manual setting operation. The automatic reference voltage generating circuit 185*c* subtracts from a predetermined voltage the voltage proportional to the current signal produced from the photodiode (photosensor element) 10 and produces a voltage representing the difference. The output voltages from both the reference voltage generating circuits 185*b* and 185*c* are selected by the second contact $77_2$ of the exposure select switch 77*a* and applied to a voltage regulating circuit 189. The voltage regulating circuit 189 regulates the output voltage from the manual reference voltage generating circuit 185*b* or the output voltage from the automatic reference voltage generating circuit 185*c*, which is selected by the exposure mode select switch to an optimum voltage level. This allows for difference of the optimum exposure amount when the parameters vary in an optical system and a process system of the copy apparatus. The output voltage from the voltage regulating circuit 189 is applied to a comparator, for example, an error differential amplifier, through a limiter circuit 186. The output voltage from the wave shaping circuit 183 is also applied to the amplifier 187. The limiter circuit 186 limits the output voltage from the voltage regulating circuit 189 to a voltage below a predetermined voltage. The differential amplifier 187 compares the output voltage from the wave shaping circuit 183 with the output voltage from the voltage regulating circuit 189 through the limiter circuit 186. When there is a difference between them, it produces a signal representing the difference. The output pulse from the amplifier 187 is supplied to the trigger pulse generating circuit 188. The trigger pulse generating circuit 188 produces a trigger pulse in synchronism with the frequency of the power source 84. The circuit 188 controls a phase of the generation of the trigger pulse according to the output signal from the error amplifier 187. The trigger pulse controlled is supplied to the gate of the thyristor 181.

Figure 34:
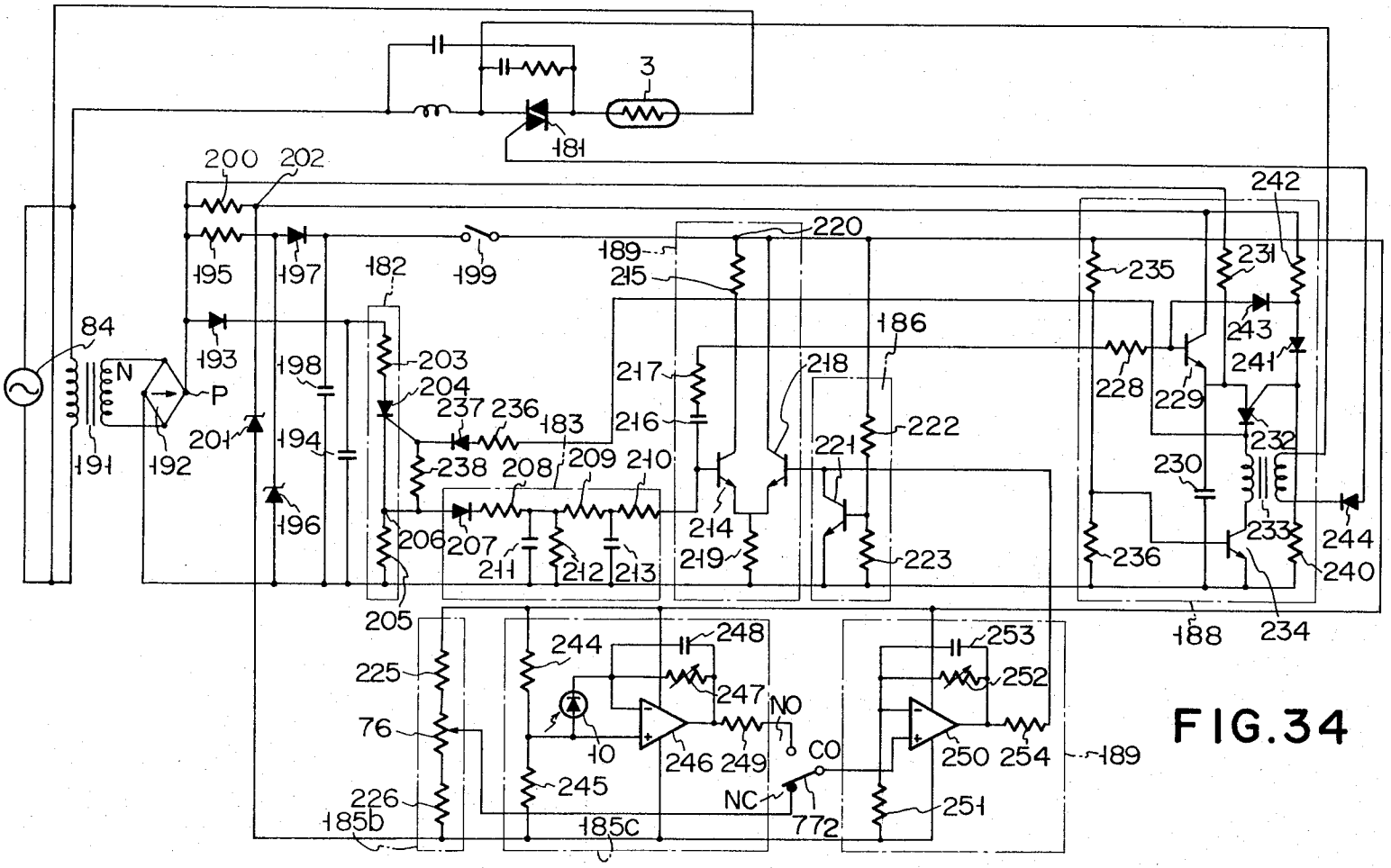
FIG. 34 is a circuit diagram of the exposure control circuit shown in FIG. 33.

FIG. 34 shows an actual arrangement of the circuits shown in FIG. 33. The primary coil of the power transformer 191 is connected to the power source 84. The secondary coil of the transformer 191 is connected to the full-wave rectifier 192. A series circuit including the diode 193 and the capacitor 194 is connected between the DC output terminals P and N of the rectifier 192. The series circuit of the Zener diode 197 and the capacitor 198 is connected in parallel to the diode 196. A connection point between the diode 197 and the capacitor 198 is connected to one end of a relay contact 199. A series circuit of a resistor 200 and Zener diode 201 is connected between the output terminals P and N. A trapezoidal waveform voltage is generated in synchronism with the power source 84 at the connection point 202 between the resistor 200 and the diode 201. The capacitor 194 is connected in parallel to a series circuit including the resistor 203 forming the dummy load circuit 182, the mono-directional thyristor 204, and the resistor 205 serving as a dummy load. A connecton point between the cathode of the thyristor 204 and the resistor 205 is connected to a resistor 210 through the diode 207 and the resistors 208 and 209. The thyristor 204 is used as the output terminal of the dummy load circuit 182. A capacitor 211 and a resistor 212 are connected in parallel between the connection point between the resistors 208 and 209 and the output terminal N. The diode 207, resistors 208 to 210 and 212, and capacitors 211 and 213 make up a wave shaping circuit 183. The other end of the resistor is connected to the base of an NPN transistor 214. The collector of the transistor 214 is connected to the other end of the relay contact 199, through a resistor 215. A series circuit of a capacitor 216 and a resistor 217 is connected between the base and collector of the transistor 214 for preventing an oscillation. The emitter of the transistor 214 is connected to the emitter of another NPN transistor 218. A connection point of these emitters is connected to the output terminal N through the resistor 219. The collector of the transistor 218 is connected to a connection point of the relay contact 199 and the resistor 215. The transistors 214 and 218 make up an error amplifier 187. The base of the transistor 218 is connected to the collector of the NPN transistor 221. The emitter of the transistor 221 is connected to the output terminal N. The base of the transistor 221 is connected to the connection point 220 through the resistor 222 and to the output terminal N through the resistor 223. The transistors 221 and the resistors 222 and 223 make up a limiter 186. Connected between the connection point 220 and the output terminal N is a series circuit of the variable resistor 76 and the resistors 225 and 226. These components form the manual reference voltage generating circuit 185*b*.

A connection point between the collector of the transistor 214 and the resistor 215 is connected to the base of the NPN transistor 229 through a resistor 228. The collector of the transistor 214 is used as an output terminal of the error amplifier 187. The collector of the transistor 229 is connected to the connection point 202. The emitter of the transistor 229 is connected to the output terminal N via a capacitor 230, and via a resistor to the output terminal P 231. The emitter of the transistor 229 is further connected to the anode of a programmable unijunction transistor 232 (referred to simply as "PUT"). The cathode of the PUT 232 is connected in series to the output terminal N through the primary coil and the NPN transistor 234. The base of the transistor 234 is connected to the connection point 220 through a resistor 235 and to the output terminal N through a resistor 236. The cathode of the PUT 232 is connected to the gate of the thyristor 204 through a resistor 236' and a diode 237. The diode 237 is connected through a resistor 238 to the connection point 206. The gate of the PUT 232 is connected to the output terminal N through a resistor 240, and to the connection point 202 in series through the diode 241 and the resistor 242. A connection point of the diode 241 and a resistor 242 is connected to a connection point between the base of the transistor 229 and a resistor 228 through a diode 243. The secondary coil of the pulse transformer 233 is connected between the gate of the thyristor 181 and the first anode through a diode 244. The transistor 229, capacitor 230, PUT 232, pulse transformer 233 and transistor 234 form the trigger pulse generating cicuit 188.

The anode of the photodiode 10 is connected to the connection point 220 through the resistor 244 and to the output terminal N through the resistor 245. The resistors 244 and 245 are to divide the power source voltage so as to obtain a predetermined voltage. The anode of the pholodiode 10 is connected to the noninverting input terminal (+) of an operational amplifier 246. The cathode is connected to the inverting input terminal (−) of the operational amplifier 246. A variable resistor 247 and a capacitor 248 are connected in parallel between the inverting input terminal and output terminal of the operational amplifier 246. The operational amplifier 246, the variable capacitor 247 and the capacitor 248 form a current-voltage converting circuit. The output terminal of the operational amplifier 246 is connected to the NO (normal open) contact of the second contact $77_2$ of the exposure mode select switch 77 through the resistor 249. The resistors 244 and 245 and the operational amplifier 246 form an automatic reference voltage generating circuit 185*c*. The NC contact of the contact $77_2$ is connected to the sliding terminal of the variable resistor 76 in the manual reference voltage generating circuit 185*b*.

The CO contact of the second $77_2$ of the exposure mode select switch 77 is connected to the noninverting input terminal of the operational amplifier 250. The inverting input terminal of the operational amplifier 250 is connected to the output terminal N through the resistor 251. A variable resistor 252 and a capacitor 253 are connected in parallel between the inverting input terminal and output terminal of the operational amplifier 250. The operational amplifier 250, resistor 251, variable resistor 252 and capacitor 253 form a positive phase amplifier. A variation in parameters in the optical system and the process system of the copying apparatus is corrected by changing a gain of the variable resistor 252. The variable resistor 252 matches the impedance with that of the succeeding stage of the circuit. The output terminal of the operational amplifier 250 is connected to the base of the transistor 218 through a resistor 254. The operational amplifier 250, variable resistor 252, capacitor 253, and resistors 251 and 254 form the voltage regulating circuit 189.

The operation of the arrangement described above will be described. A manual exposure mode for keeping an optimum exposure amount constant despite the power source voltage will be described. In this case, the second contact $77_2$ of the exposure select switch 77 is turned to the NC contact side. Therefore, the automatic reference voltage generating circuit 185*a* has no relation with the exposure control which will be described later. Assume that the exposure lamp light signal is generated and the relay contact 199 is closed. A voltage obtained by dividing the voltage at the connection point 220 by resistors 235 and 236 is applied to the base of the transistor 234. Then, the transistor 234 is on. A voltage at the connection point 220 is applied to the base of the transistor 229, through the resistors 215 and 228. This transistor 229 is then turned on, too. The capacitor 230 is charged through the transistor 229. As the capacitor 230 is charged, the anode voltage of the PUT 232 exceeds the gate voltage. The PUT 232 is thus turned on, whereby pulse current flows through the primary coil of the pulse transformer 233. Accordingly, the pulse is generated in the secondary coil of the pulse transformer 233. This pulse is applied to and triggers the thyristor 181. As a result, the thyristor 181 is turned on and the exposure lamp 3 is lit.

At this time, the trigger pulse is applied to the gate of the thyristor 204 through the resistor 236 and the diode 237. The thyristor 204 is turned on, thereby producing a voltage across the resistor 205. This voltage corresponds to the voltage of the exposure lamp 3. The voltage is wave-shaped by the wave shaping circuit composed of the diode 207, resistors 208 to 210 and 212, and capacitors 211 and 213. The wave-shaped voltage is a DC voltage corresponding to the effective voltage of the exposure lamp 3. This voltage is applied to the base of the transistor 214. If the base voltage of the transistor 214 is lower than that of the transistor 218, the collector voltage of the transistor 214 is high and the base voltage of the transistor 229 is also high. And the charging speed of the capacitor 230 is high. As a result, the PUT 232 generates timing pulses at fast timing. And the conduction angle of the thyristor 181 increases. Further, the exposure lamp emits more light in proportion to the voltage applied to it. A signal representing the increase of the conduction angle of the thyristor 181 is fed back to the thyristor 204. The base voltage at the transistor 214 rises. The moment the base voltage of the transistor 214 reaches that of the transistor 218, the base voltages of the transistors 214 and 218 are well balanced. A reference voltage adjusted to the voltage level satisfying the characteristic curve G (developing bias voltage is zero V) shown in FIG. 22, which is set by the variable resistor 76, has been applied to the base of the transistor 218. The reference voltage is kept constant despite the voltage variation of the power source 84. Accordingly, the base voltage of the transistor 214 is constant. That is, the voltage applied to the exposure lamp 3 is constant. In this way, the voltage applied to the exposure lamp 3 is controlled to be constant all the time. As a result, an optimum amount of the exposure is set by the variable resistor of the manual reference voltage generating circuit 185*b*, irrespective of the variation of the power source voltage. The $\gamma$ characteristic at this time is indicated by a characteristic curve G shown in FIG. 35.

It will be described how an optimum exposure amount is automatically provided according to a variation of the power source voltage and a change in reflectivity when the apparatus is set to an automatic exposure mode. In this case, the second contact of the exposure mode select switch 77*a* is turned to the NO contact. The lamp 3 is therefore controlled by the output voltage of the automatic reference voltage generating circuit 185*b*. The exposure lamp 3 illuminates the document on the document table 2. The light reflected from the document, the amount of which is proportional to the reflectivity of the document, is led to the drum 5. Part of the light is incident on the photodiode 10 and is thus converted into electric current. At this time, the current-voltage converting circuit comprised of the operational amplifier converts the output current from the photodiode 10 into voltage. The voltage obtained by subtracting the voltage from the voltage set by the resistors 244 and 245 is applied to the voltage regulating circuit 189 through the second contact $77_2$. The circuit 189 regulates the output voltage of the automatic reference voltage generating circuit 188 into optimum voltage. This allows for a variation of parameters in the optical and process systems of the copying apparatus. The regulated voltage is applied to the base of the transistor 218 which forms the error amplifier 187. At this time, the dummy load circuit 182 and the wave shaping circuit 183 have operated, as described above. The voltage corresponding to the voltage across the exposure lamp 3 is applied to the base of the transistor 214.

Figure 35:
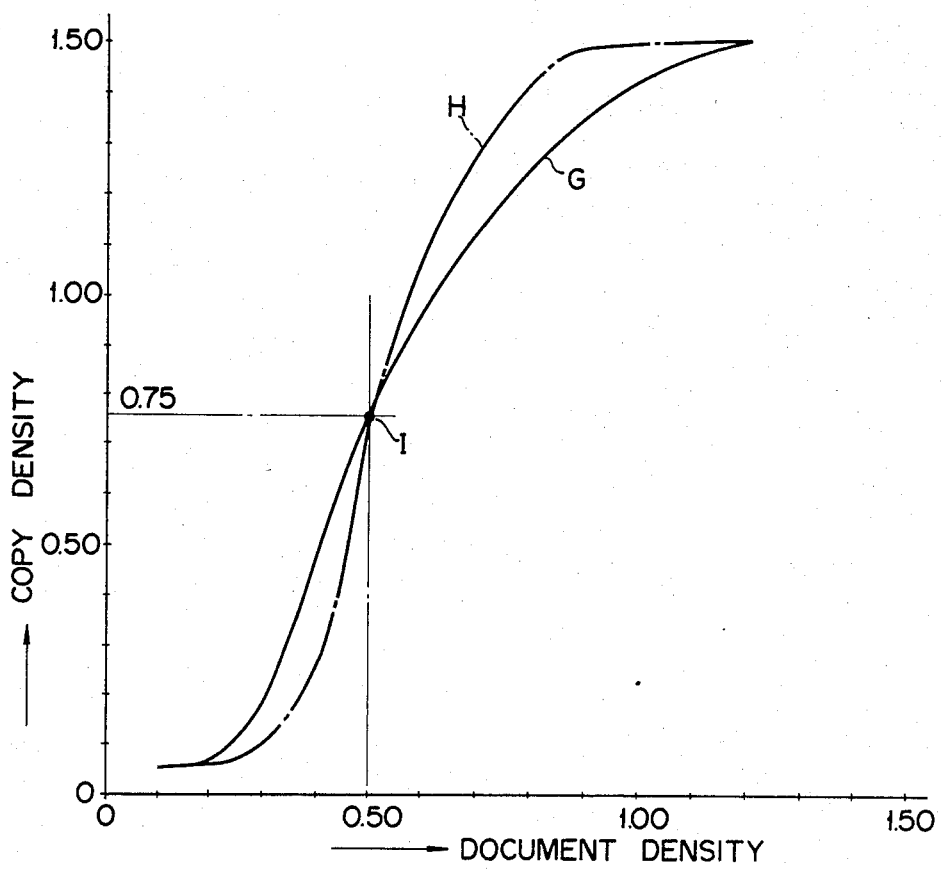
FIG. 35 is a graph representing $\gamma$ characteristic in a manual mode.

The automatic reference voltage generating circuit 186 rises when the amount of the incident light to the photodiode 10 is small. In the case of the document with a high density and low reflectivity, the amount of the light reflected from the document is small and the amount of light supplied to the photodiode 10 is also small. Accordingly, the output voltage from the operational amplifier is high. The output voltage of the voltage regulating circuit 137 rises. That is, the base voltage of the transistor 214 also rises. Hence, if the base voltage of the transistor 214 is lower than the base voltage of the transistor 218, the voltage applied to the lamp 3 rises as the conduction angle of the thyristor 181 increases. The light amount increases. The increase of light, i.e. the increase of the conduction angle of the thyristor 181, is fed back to the thyristor 204. As a result, the base voltage of the transistor 214 increases, too. When it is equal to the base voltage of the transistor 218, the base voltages of the transistors 214 and 218 are balanced. Under this condition, when the voltage of the power source 84 varies, the base voltages of the transistors 214 and 218 are not equal to each other. Therefore, the voltage applied to the lamp 3 is made constant. The base voltages of the transistors 214 and 218 are constant. As a result, the voltage applied to the exposure lamp 3 is constant even if the power source voltage changes. The amount of exposure automatically changes to render the light amount to the photoconductive drum 5 constant. In this way, the voltage applied to the lamp 3 is always constant and the amount of light reflected from the document is kept constant. Thus, an optimum exposure light is secured even if the power source voltage and the reflectivity of the document vary. The characteristic in this case is shown in FIG. 35.

The limiter 186 operates in the following manner. When the base voltage of the transistor 218 (the collector voltage of the transistor 221) exceeds a voltage (base voltage of the transistor 221) set by the resistors 222 and 223, current flows into the transistor 221 to reduce the base voltage of the transistor 218. As a result, the base voltage of the transistor 218 is controlled and kept below the set voltage. The transistor 221 forcibly clamps the base voltage of the transistor 218 and makes it below the voltage set by the resistors 222 and 223. Accordingly, the base voltage of the transistor 218 never exceeds a predetermined voltage. The maximum conduction angle of the thyristor 181 is thus restrictively controlled and kept below a predetermined voltage (rated voltage) automatically. The limiter 186 limits the reference voltage generating circuit 185*b* or the automatic reference voltage generating circuit 185*c* to the error amplifier 187 and it controls the voltage applied to the exposure lamp 3, keeping the voltage below the rated voltage. The limiter 186 is provided because the applied voltage does not exceed the rated voltage, ensuring long life of the lamp 3, when the exposure lamp 3 has a rated voltage which is below the AC voltage.

Figure 36:
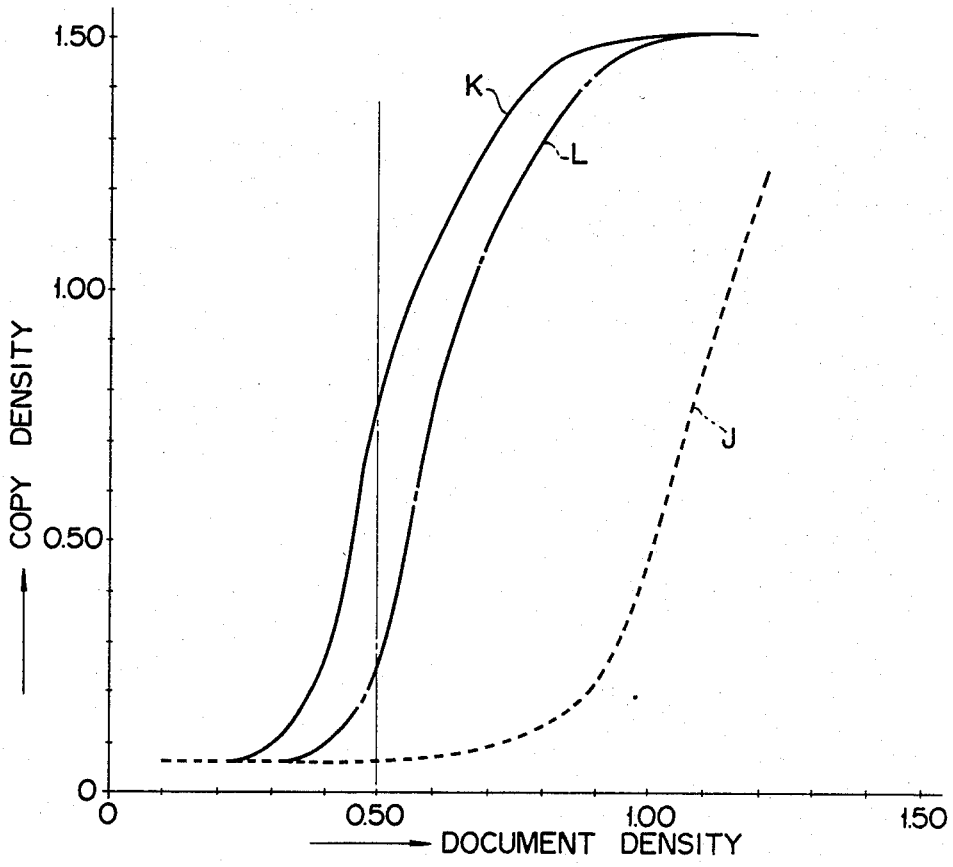
FIG. 36 shows a graph of $\gamma$ characteristic in an automatic exposure mode.
Figure 37A:
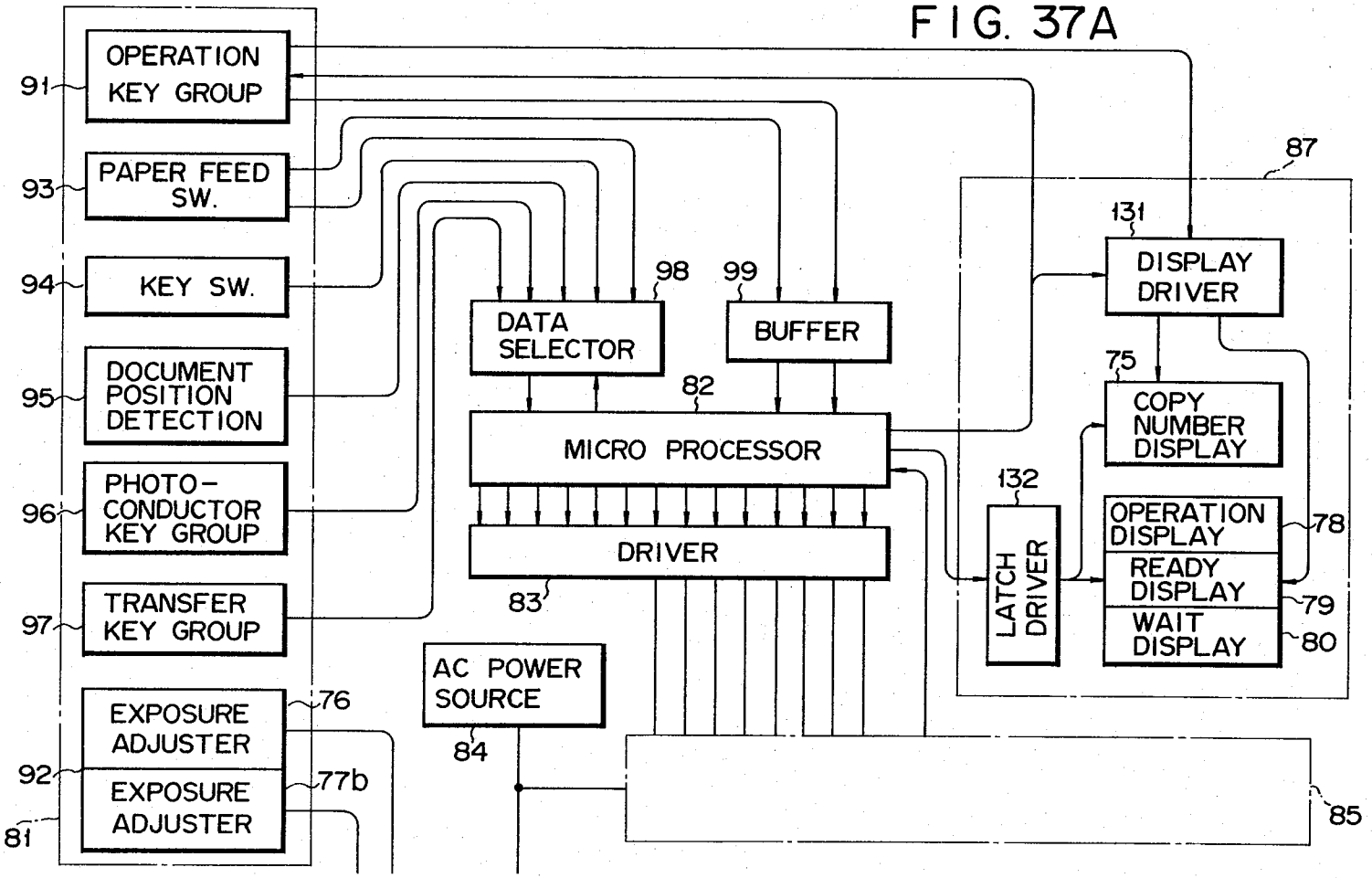
FIGS. 37A and 37B are block diagrams of an electrophotographic copying apparatus according to a further embodiment of the invention.
Figure 37B:
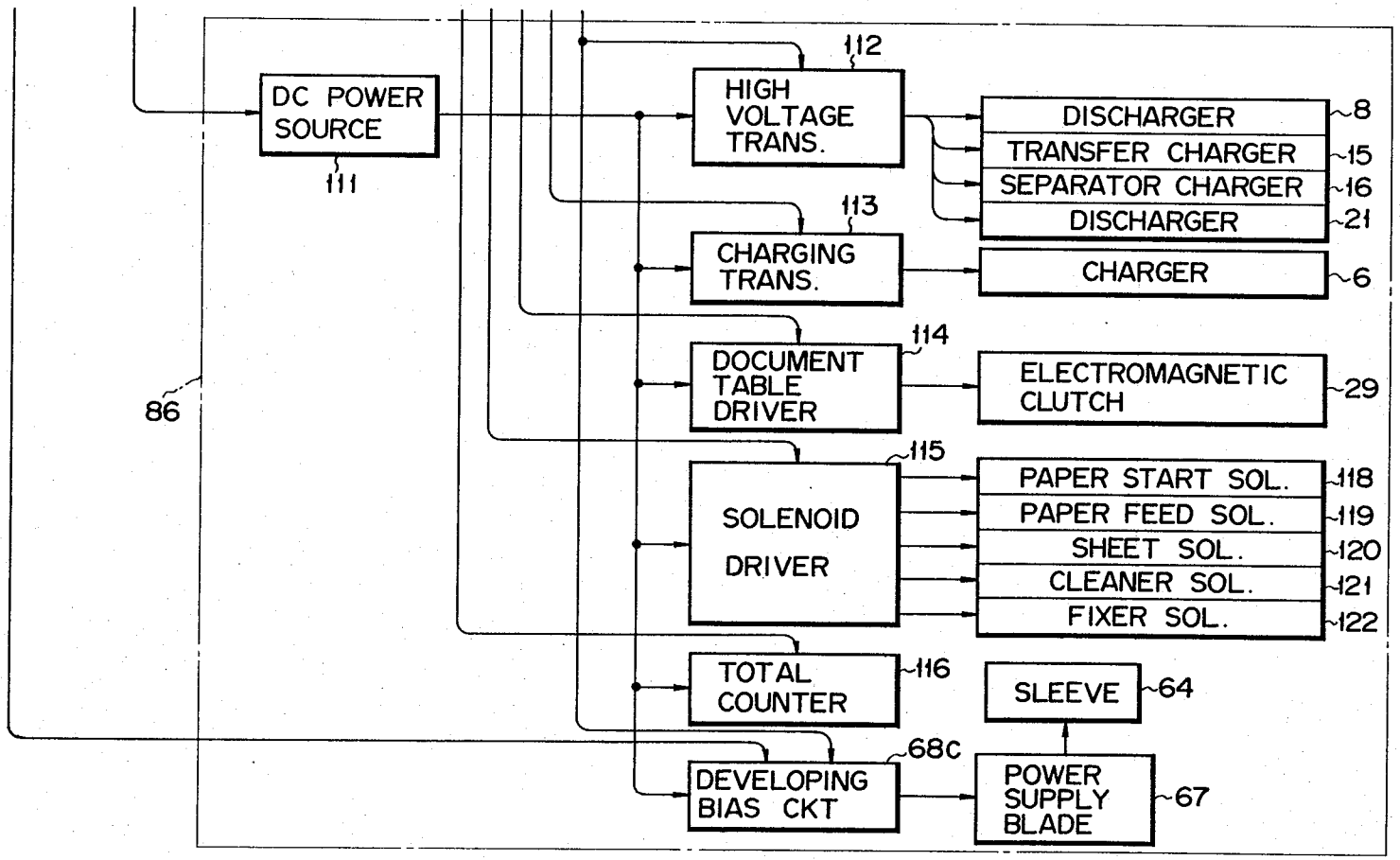
Figure 38:
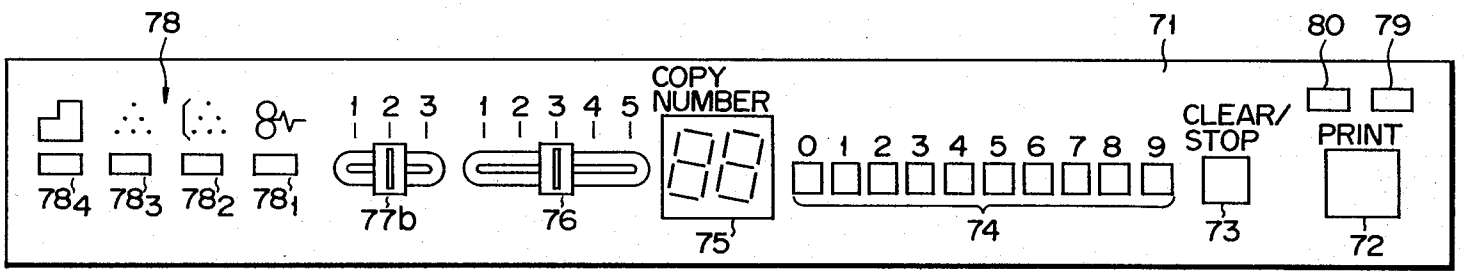
FIG. 38 is a plan view of the operation panel shown in FIG. 37A.
Figure 39:
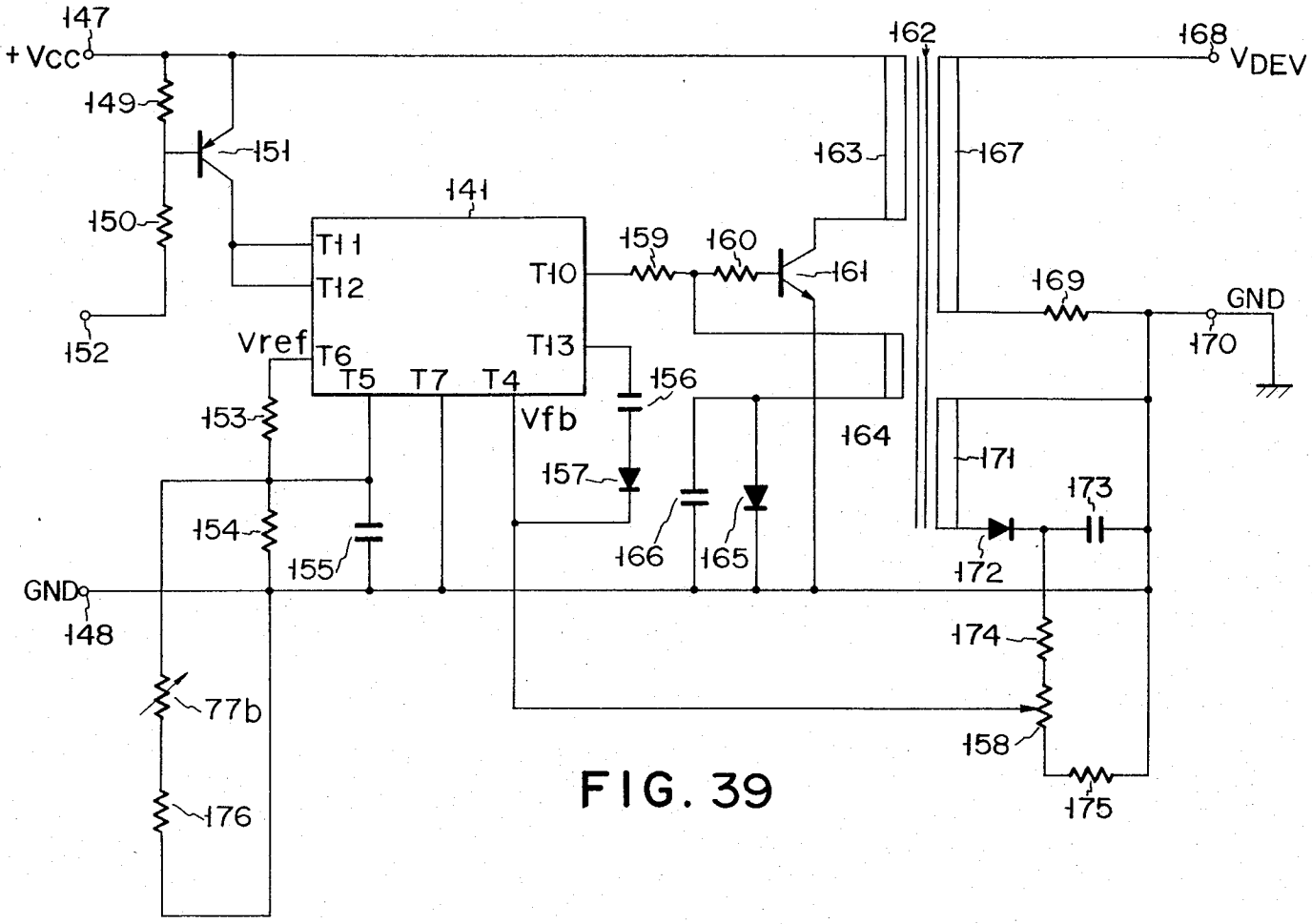
FIG. 39 is a circuit diagram of a developer bias circuit shown in FIG. 38B.

Let us consider a $\gamma$ characteristic (document density-copy density characteristic) when the $\gamma$ characteristic is changed according to the exposure mode (manual or automatic). In FIG. 35, a curve G indicates the $\gamma$ characteristic observed when the exposure mode is the manual and the developing bias voltage $V_{DEV}$ is 800 V and the rate of change in characteristic is low. A curve H indicates the characteristic observed when the exposure mode is automatic and the developing bias voltage $V_{DEV}$ is 0 V. In this case, the rate of change in characteristic is high. As shown in FIG. 35, the variable resistor is adjusted to that the copy density is about 0.75 for the document density 0.50 when a reference density test chart for automatic exposure is copied. The curve H crosses the curve G at point I. FIG. 36 shows a $\gamma$ characteristic in the automatic exposure mode. A curve J represents the $\gamma$ characteristic observed when the density is uniform over the entire surface of the document and is used as a reference in the automatic exposure mode. In other words, the characteristic curve J indicates the ratio of the copy density to the background density of the document when the documents is actually copied. An amount of exposure light in the automatic exposure mode is controlled by the density obtained when it is integrated over the entire surface of the document on the basis of the light incident to the photodiode 10. Therefore, the characteristic in this case is as indicated by characteristic curve K or L shown in FIG. 23. A curve K indicates the characteristic of the reference density test chart (a chart containing mainly characters with the background density of 0.1 to 0.15). A curve L indicates the $\gamma$ characteristic of a document with a relatively high background density such as newspaper. The $\gamma$ characteristic in the automatic exposure mode is such that the $\gamma$ characteristic curve K horizontally shifts with respect to the $\gamma$ characteristic curve J according to the background density.

As described above, the copying apparatus according to the present invention is provided with the $\gamma$ characteristic control means for changing the $\gamma$ characteristic in a manner that in the automatic exposure mode, a rate of change in characteristic is set high and in a manual exposure mode it is set low. Therefore, the following effects are attained.

In an automatic exposure mode, the density integrated over the entire surface of the document is used for controlling the copying operation. Accordingly, the copying operation in this mode is suitable for copying line copy document. This type of document mainly contains characters and numerals and its background density is not uniform. An ideal copy has its density restricted low but its document density is high, so that the copy image has good contrast. To this end, a rate of change in characteristic is set high in the automatic exposure mode. Thus, the copy density is set remarkably low for the density below a predetermined value. The copy density is set high for the density above the predetermined value. Therefore, a copy image formed has little fog and high contrast.

The automatic exposure can cover 80% or 90% of all types of documents.

In the present embodiment, a variable resistor 77 for adjusting a density and a resistor 76 are connected in series between the noninverting input terminal T5 and the ground 148. Therefore, by changing the resistance of the variable resistor 77, the voltage at the noninverting input terminal T5 is changed. When the resistance of the variable resistor 77 is increased, the output voltage $V_{DEV}$ (developing bias voltage) rises. On the other hand, if it is made small, the output voltage $V_{DEV}$ falls.

The effects of the developing bias voltage $V_{DEV}$ from the developing bias power source 68, particularly a relationship between the document density and the copy density (called "$\gamma$ characteristic") have been described with reference to FIGS. 18 and 19.

Figure 40:
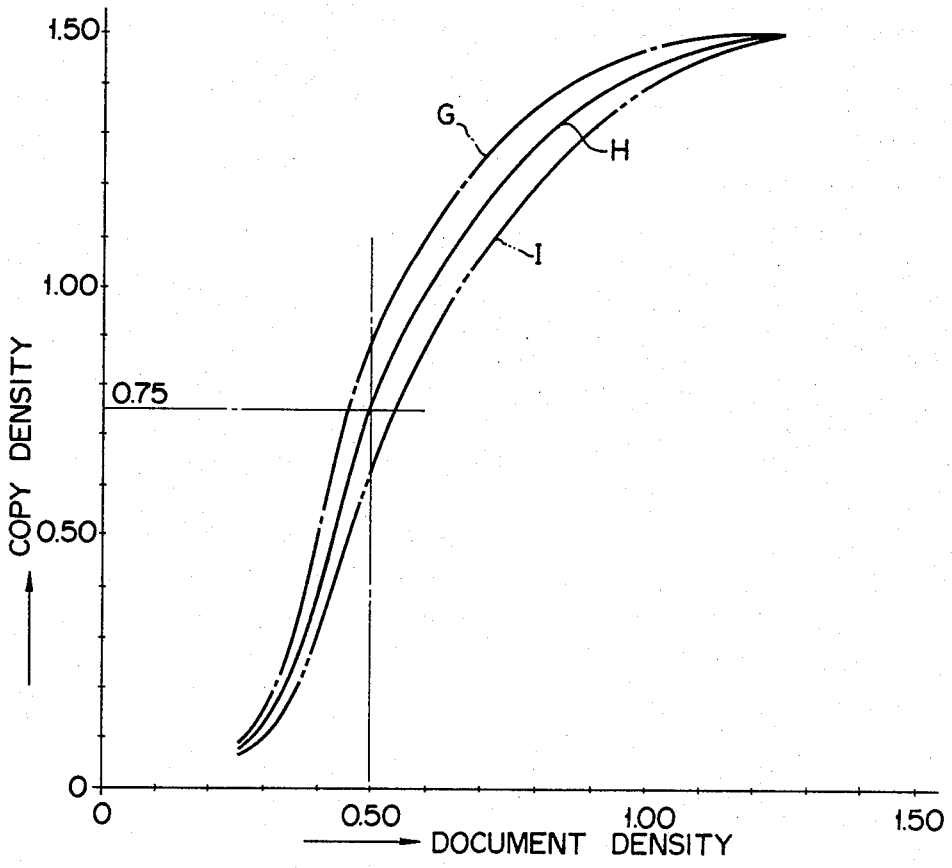
FIG. 40 is a graph representing $\gamma$ characteristic in a manual bias adjusting mode.

A rate of change in copy density by the voltage $V_{DEV}$ in the embodiment will be described with reference to FIGS. 19 and 40. An amount of light to the document is kept constant in FIG. 19. At this time, if the voltage applied to the sleeve 64 of the developer unit 7 is above 500 V, a rate of change in $\gamma$ characteristic changes its voltage value. Therefore, if the voltage (the developing bias voltage $V_{DEV}$) to the sleeve 64 is changed by the resistor **77*b*, a rate of change in $\gamma$ characteristic can be changed. FIG. 40 shows an example of $\gamma$ characteristic observed when the developing bias voltage $V_{DEV}$ is changed from 500 V to 800 V. In the figure, a curve G indicates the case that the developing bias voltage $V_{DEV}$ is 500 V and the change rate is high. A curve H indicates the case where the developing bias voltage $V_{DEV}$ is 600 V and the change rate is medium. A curve I indicates the case where the developing bias voltage $V_{DEV}$ is 800 V and the change rate is low. For adjusting the copy density of the document at a standard density, the curves G, H and I shown in FIG. 40 are shifted to the right by increasing the exposure of the $\gamma$ characteristic curves D and E in FIG. 19**, and a characteristic curve (not shown) observed when the developing bias voltage $V_{DEV}$ is 600 V.

The $\gamma$ characteristic control means brings about the following effects. When the $\gamma$ characteristic (density change rate) is adjusted as shown by curve I shown in FIG. 40 by means of the resistor **77*b*, the inclination of the curve I is small. Therefore, when the document with a low density ratio of the document background to the document pattern, the reproducibility of the copy is good and scurs and nonuniformity of density may be lessened. When the characteristic is adjusted by curve H in FIG. 40, the inclination of the curve H is medium. Accordingly, the copy image of an ordinary document has no fog and good contrast. When the $\gamma$ characteristic is adjusted like the curve G in FIG. 40, the inclination of curve G is large. In this case, the document with a high background density can be copied with good contrast and little fog. A feature of the continuous adjustment of the $\gamma$ characteristic by the variable resistor 77 allows an operator to have the characteristic which can give the best reproducibility of the document. This further ensures an exact copy image. Further, the developing condition can be improved by applying the AC bias voltage to the sleeve 64**. This can provide a minimum of developing nonuniformity (density change) particularly at a low density.

As described above, according to the present invention, the $\gamma$ characteristic control means is provided for changing a rate of change in $\gamma$ characteristic. Because of this, the document with a low ratio of the document background to the document pattern can be copied with improved reproducibility of copy, and with the copy image having less scurs and less density nonuniformity. For the document with a high background density, the copy image obtained has good contrast and little fog. For the document with a wide variety of densities, a high reproducibility of the copy image can be ensured.

What we claim is:

1. An electrophotographic copying apparatus comprising:

photoconductive means;

charging means disposed close to said photoconductive means for electrically charging said photoconductive means;

exposure means for exposing said photoconductive means to form a latent image on said photoconducitve means, said image corresponding to the pattern of a document;

developer means disposed close to said photoconductive means for developing the latent image, thus forming a developed image, using one-component developer;

means for applying a bias voltage on said developer means;

transfer means disposed close to said photoconductive means for transferring the developed image to a paper sheet;

means for selecting whether a document should be copied with contrast or gradation; and $\gamma$ characteristic setting means for setting $\gamma$ characteristic (i.e. document density-copy density characteristic) corresponding to the selection by said selecting means and varying at least one of the bias voltage of said bias applying means and the exposure amount of said exposure means in accordance to the set $\gamma$ characteristic, thereby achieving a developing process suitable process suitable to the quality of the document being occupied.

2. An electrophotographic copying apparatus according to claim 1, wherein said $\gamma$ characteristic setting means sets the $\gamma$ characteristic according to the type of the document such as photographic document or character document and varies the exposure amount of the exposure means according to the set $\gamma$ characteristic.

3. An electrophotographic copying apparatus according to claim 1, wherein said $\gamma$ characteristic setting means sets the $\gamma$ characteristic according to the density of the document and varies the bias voltage of said bias applying means and the exposure amount of said exposure means according to the set $\gamma$ characteristic.

4. An electrophotographic copying apparatus according to claim 1, wherein said $\gamma$ characteristic setting means comprises means for photoelectrically detecting the density of the document and means for automatically setting the $\gamma$ characteristic according to an output signal from said means.

5. An electrophotographic copying apparatus according to claim 4, wherein said $\gamma$ characteristic setting means comprises mode selecting means for manually setting the $\gamma$ characteristic and for automatically setting the $\gamma$ characteristic.

6. An electrophotographic copying apparatus according to claim 1, wherein said $\gamma$ characteristic setting means is means which comprises manually operated to vary the bias voltage of said bias applying means according to the density of the document.

7. An electrophotographic copying apparatus according to claim 1, wherein said exposure means comprises an exposure lamp, a current supply control element connected between the exposure lamp and a power source, dummy load means connected to the power source for generating a voltage corresponding to the terminal voltage of said exposure lamp and trigger means for triggering the current supply control means according to the output voltage from the dummy load means thereby supplying a constant current to the exposure lamp.

8. An electrophotographic copying apparatus according to claim 7, wherein said $\gamma$ characteristic setting means comprises means for changing the triggering timing of said trigger means according to the $\gamma$ characteristic.

* * * * *